US008931667B2

(12) United States Patent
Smith et al.

(10) Patent No.: US 8,931,667 B2
(45) Date of Patent: Jan. 13, 2015

(54) METHODS AND APPARATUSES FOR DISPENSING FLUIDS

(75) Inventors: Christopher Lawrence Smith, Liberty Township, OH (US); Brian Joseph Roselle, Fairfield, OH (US); Stephan James Andreas Meschkat, Hessen (DE); Corey Michael Bischoff, Cincinnati, OH (US); Kenneth Eugene Lamb, Lebanon, OH (US); William Peter Wurzelbacher, Hamilton, OH (US); Douglas Arthur Marsden, Marblehead, MA (US)

(73) Assignee: The Procter & Gamble Company, Cincinnati, OH (US)

( * ) Notice: Subject to any disclaimer, the term of this patent is extended or adjusted under 35 U.S.C. 154(b) by 1513 days.

(21) Appl. No.: 12/564,946

(22) Filed: Sep. 23, 2009

(65) Prior Publication Data

US 2010/0071777 A1 Mar. 25, 2010

Related U.S. Application Data

(60) Provisional application No. 61/099,602, filed on Sep. 24, 2008.

(51) Int. Cl.
*D06F 39/02* (2006.01)

(52) U.S. Cl.
CPC ..... *D06F 39/022* (2013.01)
USPC ..... 222/325; 222/83; 68/17 R

(58) Field of Classification Search
USPC ..... 222/64–66, 80, 81, 83, 83.5, 85, 86, 87, 222/88, 89, 90, 82, 160, 162, 165, 325; 68/5 C, 17 R
See application file for complete search history.

(56) References Cited

U.S. PATENT DOCUMENTS

| | | | |
|---|---|---|---|
| 3,207,373 | A | 9/1965 | Dannenmann |
| 4,566,149 | A | 1/1986 | Fitzwater |
| 4,883,203 | A | 11/1989 | Kittscher |
| 5,007,559 | A | 4/1991 | Young |

(Continued)

FOREIGN PATENT DOCUMENTS

| | | | |
|---|---|---|---|
| DE | 4435672 | A1 | 6/1995 |
| DE | 29713157 | U1 | 10/1997 |

(Continued)

OTHER PUBLICATIONS

U.S. Appl. No. 12/475,689, filed Jun. 1, 2009, Roselle et al.

(Continued)

*Primary Examiner* — Paul R Durand
*Assistant Examiner* — Charles P Cheyney
(74) *Attorney, Agent, or Firm* — Gary J. Foose

(57) ABSTRACT

A fluid dispensing system can be used with a container comprising at least one camming surface. In various embodiments, the fluid dispensing system can have a housing which can accept at least a portion of the container in a fixed orientation and a track which can be engaged with the housing. In at least one embodiment, the housing can be slidably movable along the track at least between a first position and a second position. In various embodiments, the fluid dispensing system can have a tube which can be engaged with at least a portion of the container to withdraw fluid therefrom when the housing is in the second position and can also have a fluid system in fluid communication with the tube.

13 Claims, 37 Drawing Sheets

(56) References Cited

U.S. PATENT DOCUMENTS

| | | | | |
|---|---|---|---|---|
| 5,085,358 | A | 2/1992 | Lam | |
| 5,253,494 | A | 10/1993 | Frucco et al. | |
| 5,305,484 | A | 4/1994 | Fitzpatrick et al. | |
| 5,344,054 | A | 9/1994 | Nutter | |
| 5,369,892 | A | 12/1994 | Dhaemers | |
| 5,511,701 | A | 4/1996 | Lam | |
| 5,664,710 | A | 9/1997 | Lam | |
| 5,815,961 | A | 10/1998 | Estes et al. | |
| 6,189,346 | B1 | 2/2001 | Chen et al. | |
| 6,379,632 | B1 * | 4/2002 | Kinoshita et al. | 422/300 |
| 6,386,392 | B1 | 5/2002 | Argentieri et al. | |
| 6,491,840 | B1 | 12/2002 | Frankenbach et al. | |
| 6,495,058 | B1 | 12/2002 | Frankenbach et al. | |
| 6,628,908 | B2 | 9/2003 | Matsumoto et al. | |
| 6,726,186 | B2 | 4/2004 | Gaaloul et al. | |
| 6,745,496 | B2 | 6/2004 | Cassella | |
| 6,817,497 | B2 | 11/2004 | Grasso et al. | |
| 6,840,068 | B2 | 1/2005 | Pasin et al. | |
| 6,925,737 | B2 | 8/2005 | Bolduan et al. | |
| 6,964,360 | B2 | 11/2005 | Tubman et al. | |
| 6,971,549 | B2 | 12/2005 | Leifheit et al. | |
| 6,971,589 | B2 | 12/2005 | Incardona | |
| 7,043,855 | B2 | 5/2006 | Heilman et al. | |
| 7,093,467 | B2 * | 8/2006 | Kim et al. | 68/17 R |
| 7,137,211 | B2 | 11/2006 | Johnson et al. | |
| 7,140,121 | B2 | 11/2006 | Cassella | |
| 7,308,990 | B2 | 12/2007 | Mazooji et al. | |
| 7,328,822 | B2 | 2/2008 | Stokes | |
| 7,367,137 | B2 | 5/2008 | Jonsson et al. | |
| 7,658,212 | B2 * | 2/2010 | Meuleners et al. | 141/82 |
| 7,739,891 | B2 | 6/2010 | Luckman et al. | |
| 8,052,805 | B2 * | 11/2011 | Hendrickson et al. | 134/57 R |
| 2004/0163184 | A1 | 8/2004 | Waldron et al. | |
| 2005/0023310 | A1 | 2/2005 | Noda | |
| 2005/0120757 | A1 | 6/2005 | Jackson | |
| 2005/0229652 | A1 * | 10/2005 | Kim et al. | 68/237 |
| 2005/0257440 | A1 | 11/2005 | Seiffert et al. | |
| 2005/0262671 | A1 | 12/2005 | Redlin | |
| 2006/0080860 | A1 | 4/2006 | Clark | |
| 2006/0272359 | A1 | 12/2006 | Kang | |
| 2007/0020040 | A1 | 1/2007 | Sacks | |
| 2007/0108310 | A1 | 5/2007 | Tollens et al. | |
| 2008/0000616 | A1 | 1/2008 | Nobile | |
| 2008/0256989 | A1 | 10/2008 | Jeong et al. | |
| 2009/0038083 | A1 | 2/2009 | Roselle et al. | |
| 2009/0100881 | A1 * | 4/2009 | Dahlke | 68/17 R |
| 2010/0018262 | A1 | 1/2010 | Beihoff et al. | |
| 2010/0186176 | A1 | 7/2010 | Wright et al. | |
| 2010/0242302 | A1 | 9/2010 | Meschkat et al. | |

FOREIGN PATENT DOCUMENTS

| | | | |
|---|---|---|---|
| EP | 587173 | A1 | 3/1994 |
| EP | 670135 | A1 | 9/1995 |
| EP | 683999 | A1 | 11/1995 |
| EP | 812556 | A2 | 12/1997 |
| EP | 953669 | B1 | 9/2003 |
| EP | 1528145 | A2 | 5/2005 |
| EP | 1288367 | B1 | 8/2005 |
| GB | 2 189 522 | A | 10/1987 |
| GB | 2 321 954 | A | 8/1998 |
| GB | 2 377 927 | A | 1/2003 |
| GB | 2 394 271 | A | 4/2004 |
| JP | 10156096 | A2 | 6/1998 |
| JP | 11057299 | A2 | 3/1999 |
| WO | WO 99/49123 | A1 | 9/1999 |
| WO | WO 00/19001 | A1 | 4/2000 |
| WO | WO 02/072940 | A1 | 9/2002 |
| WO | WO 2006/073885 | A | 7/2006 |

OTHER PUBLICATIONS

U.S. Appl. No. 61/138,539, filed Dec. 18, 2008, Smith et al.
U.S. Appl. No. 12/767,974, filed Apr. 27, 2010, Roselle et al.
U.S. Appl. No. 12/791,123, filed Jun. 1, 2010, Roselle et al.
U.S. Appl. No. 12/791,135, filed Jun. 1, 2010, Hollinger et al.

* cited by examiner

METHODS AND APPARATUSES FOR DISPENSING FLUIDS

CROSS REFERENCE TO COPENDING APPLICATIONS

The present application claims the benefit of U.S. Provisional Application No. 61/099,602, filed on Sep. 24, 2008.

FIELD OF THE INVENTION

The present invention relates to methods and apparatuses for dispensing fluids and, more particularly, relates to methods and apparatuses for dispensing fluids to an appliance or other machine such that the appliance or other machine can use the fluid while running a cycle. Non-limiting examples of suitable appliances and machines include laundry machines, dish washers, fabric refreshing devices, industrial cleaning systems, commercial car wash systems, and so forth.

BACKGROUND OF THE INVENTION

Various appliances or other machines, such as a washer or a dryer or other fabric treatment devices or hard surface cleaning devices, for example, can be configured to receive fluids. The fluids can comprise detergents, fabric softeners, bleaches, and/or fragrances, for example. In other various embodiments, any other suitable type of fluid can be provided to the various appliances or other machines.

The appliances or machines can use the fluids in various operating cycles. In various embodiments, these fluids can be manually inserted into portions of the appliances or machines, for example such as a fluid container or manually poured into a receiving area or into the fabric treatment area (such as the washing basin). Known devices for supplying a fluid for appliances include those disclosed in: US Patent Pub. 2006/0272359 to Je Nam King; U.S. Pat. No. 4,883,203 to Peter Kisscher; U.S. Pat. No. 5,007,559 to Cecil B. Young; and U.S. Pat. No. 3,207,373 to Dannenmann.

Despite these and other attempts to provide containers for fluid for use in these appliances, there remains a need for a device which is user friendly yet decreases the potential for user error and is more space efficient. Further, as devices become more complex the types of fluids and compositions supplied to the appliance and/or machine becomes important as the wrong fluid or wrong performance setting can cause performance deterioration as well as improper distribution if the device is designed for a specific type of fluid. As such, there is a need for an apparatus for dispensing fluids which is easy to use, user safe, decreases the likelihood for spillage and leakage, and can be configured to accommodate specific cartridges for use therein.

SUMMARY OF THE INVENTION

In at least one general aspect, a container for use with a fluid dispensing system for an appliance or other machine can comprise a neck and a closure mechanism. In various embodiments, the neck, the closure mechanism, and/or other portion of the container can form at least one camming surface extending therefrom. In at least one embodiment, an annular ring can extend at least partially around a portion of a periphery of the neck and/or the closure mechanism. In various embodiments, the closure mechanism can be configured to puncturably seal the container. In at least one embodiment, the container can comprise a container body connected to the neck.

In at least one general aspect, a fluid dispensing system can be configured to be used with a container having a fluid therein, wherein the container can comprise at least one camming surface. In various embodiments, the fluid dispensing system can comprise a housing configured to accept at least a portion of the container in a fixed, or a substantially fixed, orientation and a track which can be engaged with at least a portion of the housing. In at least one embodiment, the housing can be movable along the track at least between a first position and a second position. In various embodiments, the fluid dispensing system can comprise at least one tube which can be engaged with at least a portion of the container to withdraw the fluid therefrom at least when the housing is in the second position. In at least one embodiment, the fluid dispensing system can also comprise a fluid system in fluid communication with the at least one tube. In various embodiments, the at least one camming surface can actuate the fluid system at least when the housing is in the second position to allow the at least one tube to withdraw the fluid from the container.

In at least one general aspect, a fluid dispensing system configured to withdraw fluid from a container can comprise at least one camming surface having a first portion and a second portion. In various embodiments, the fluid dispensing system can comprise a housing configured to accept at least a portion of the container. In at least one embodiment, the fluid dispensing system can also comprise an alignment track configured to be engaged with at least a portion of the housing such that the housing can be movable along the track to align the container with at least a portion of the fluid dispensing system. In various embodiments, the fluid dispensing system can comprise at least one electro-mechanical switch such that a first portion of the at least one camming surface can be engaged with the at least one electro-mechanical switch to cause the fluid dispensing system to run a first cycle, and such that a second portion of the at least one camming surface can be engaged with the at least one electro-mechanical switch to cause the fluid dispensing system to run a second cycle. In various embodiments, an adapter can be provided, wherein the adapter can be positioned at least partially onto a neck and/or other portion of the container. In such an embodiment, the at least one camming surface can be included on the adapter.

BRIEF DESCRIPTION OF DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
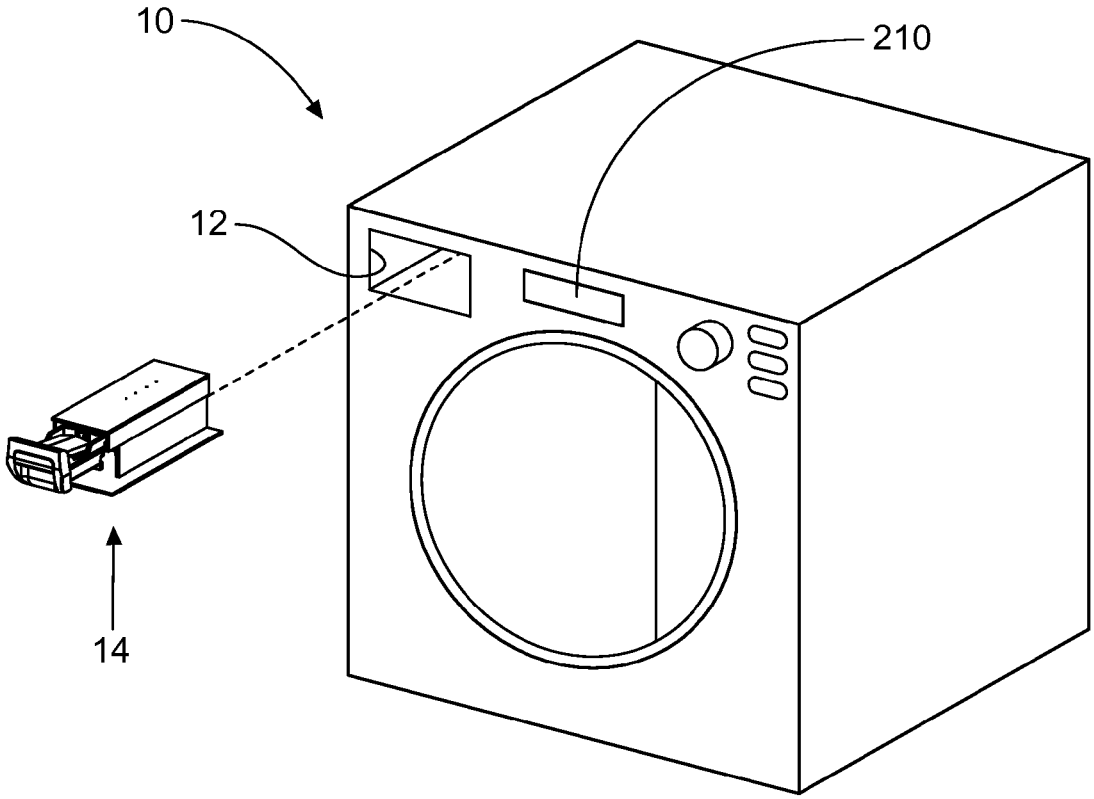
FIG. 1 is a perspective view of an appliance or other machine configured to receive, or be provided with, a fluid dispensing system in accordance with one non-limiting embodiment of the present invention.

Certain exemplary embodiments will now be described to provide an overall understanding of the principles of the structure, function, manufacture, and use of the apparatuses and methods disclosed herein. One or more examples of these embodiments are illustrated in the accompanying drawings. Those of ordinary skill in the art will understand that the devices and methods specifically described herein and illustrated in the accompanying drawings are non-limiting exemplary embodiments and that the scope of the various embodiments of the present invention is defined solely by the claims. The features illustrated or described in connection with one exemplary embodiment may be combined with the features of other embodiments. Such modifications and variations are intended to be included within the scope of the present invention.

Various appliances or other machines (hereinafter referred to as "appliances") can be configured to receive and/or withdraw a fluid from a container using a fluid dispensing system so that the appliance can use the fluid during an operating cycle. Non-limiting examples of suitable the appliances for use herein include a fabric refreshing cabinet, for example, such as the fabric refreshing cabinet disclosed in U.S. Patent Application Ser. No. 60/076,321, filed on Jun. 27, 2008 and titled "Fabric Refreshing Cabinet Device", to Roselle et al.; or the clothing treating apparati such as disclosed in EP 1491677 and U.S. Pat. No. 6,189,346; a hard surface treating system such as a dish washer or an automatic car wash system. In at least one embodiment, the fluid can include a detergent, a bleach, a fabric softener, a fragrance, a wrinkle control fluid, and/or any other suitable fluid, for example. In such an embodiment, the fluids can include the fluids disclosed in U.S. Pat. No. 6,491,840, entitled "Polymer Compositions Having Specified pH for Improved Dispensing and Improved Stability of Wrinkle Reducing Compositions and Methods of Use", issued on Dec. 10, 2002, and U.S. Pat. No. 6,495,058, entitled "Aqueous Wrinkle Control Compositions Dispensed Using Optimal Spray Patterns", issued on Dec. 17, 2002. In various embodiments, the operating cycle can be a washing cycle, a drying cycle, and/or any other suitable cycle, for example. In at least one embodiment, the container can be fully, or at least partially, filled with the fluid. In such embodiments, a user can refill and/or replace the container once all of, or at least most of, the fluid within the container has been used by the appliance. The term "fluid" may be defined as a liquid, a slurry, a semi-fluid substance (e.g., a flowable paste or a gel), and/or any suitable aqueous solution such as water. In at least one embodiment, the container can include multiple chambers or compartments containing different fluids. In such an embodiment, the fluid dispensing system can include fluid extracting elements and vent tubes, which can be configured to withdraw the fluid from the different compartments at different times during particular operating cycles, for example.

In various embodiments, referring to FIG. 1, an appliance 10 can include a receiving portion 12 into which a fluid dispensing system 14 can be inserted. In other various embodiments, the fluid dispensing system 14 can be formed integral with the receiving portion 12 of the appliance 10 and configured to receive a container of fluid, for example. In at least one embodiment, the receiving portion 12 can be configured to receive the fluid dispensing system 14 in a horizontal orientation, or a substantially horizontal orientation, a vertical orientation, or a substantially vertical orientation, and/or any other suitable orientation, with respect to the appliance 10. The terms "substantially horizontal" and "substantially vertical" can mean positioned at angles in the range of about zero to about fifteen degrees, alternatively about one to about eleven degrees, alternatively at about five to about twelve degrees, alternatively about seven degrees from their respective horizontal axis or vertical axis. In still other various embodiments, the terms "substantially horizontal" and "substantially vertical" can mean positioned at any other suitable angle from the horizontal axis or the vertical axis, for example to allow fluid to be transferred out of the container.

In at least one embodiment, referring to FIG. 1, the appliance 10 may comprise a user interface 210. As will be appreciated by those skilled in the art, the user interface 210 comprises the aggregate means by which users can interact with the appliance 10, including, for example, any device or computer program portion of the appliance. In various embodiments, the use interface 210 may comprise an input, an output, or a combination thereof. The input allows the user to enter information into the appliance 10 to manipulate or control the operation of the appliance. The output allows the appliance 10 to produce effects for the benefit of the user. In various embodiments, the input and output may comprise visual, audio, and tactile devices. In one embodiment, the input may be configured as a touch keypad and the output may be configured as a display, light emitting indicator, and/or audible alarm.

Figure 14:
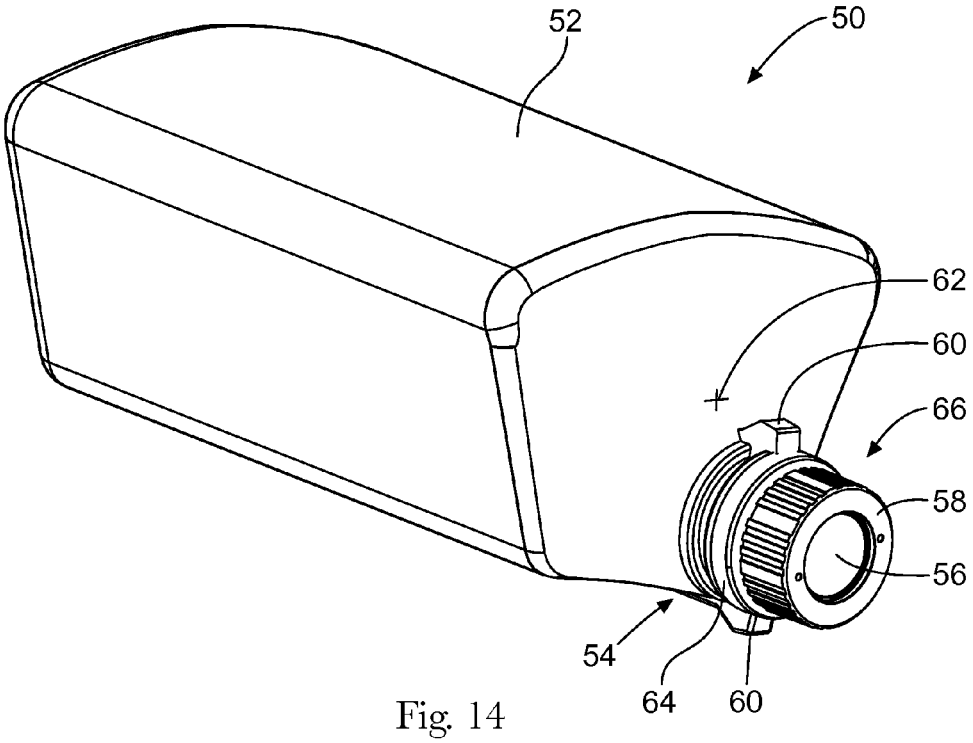
FIG. 14 is a perspective view of a container in accordance with one non-limiting embodiment of the present invention.
Figure 15:
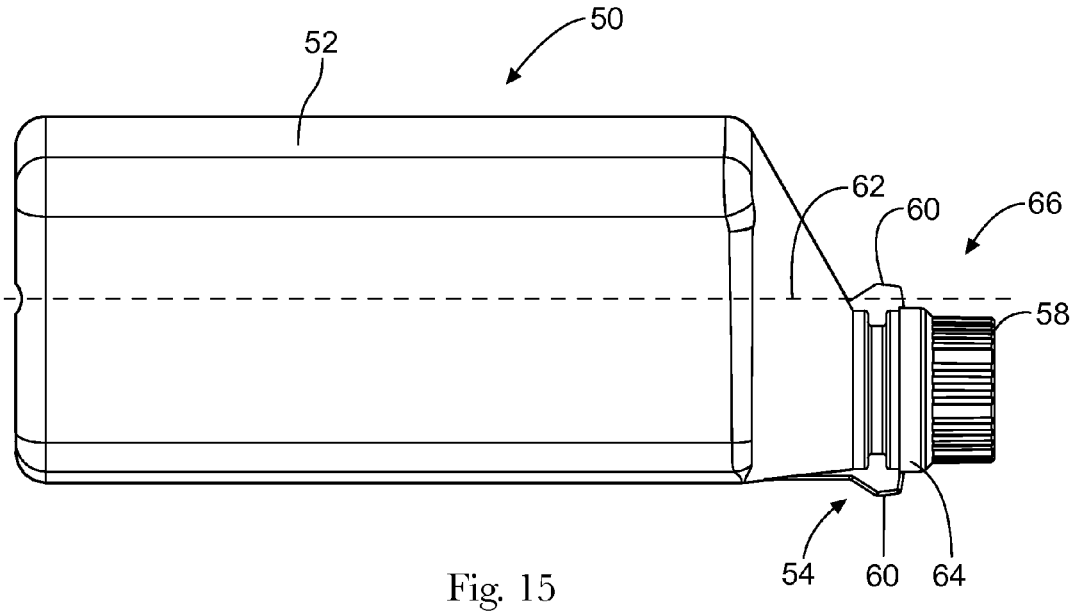
FIG. 15 is a side view of the container of FIG. 14.
Figure 16:
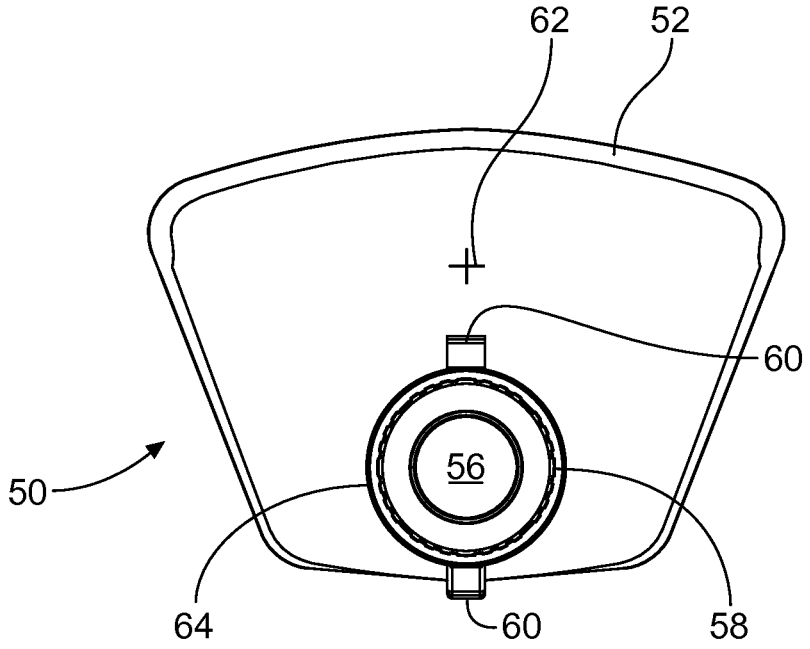
FIG. 16 is a top view of the container of FIG. 14.
Figure 17:
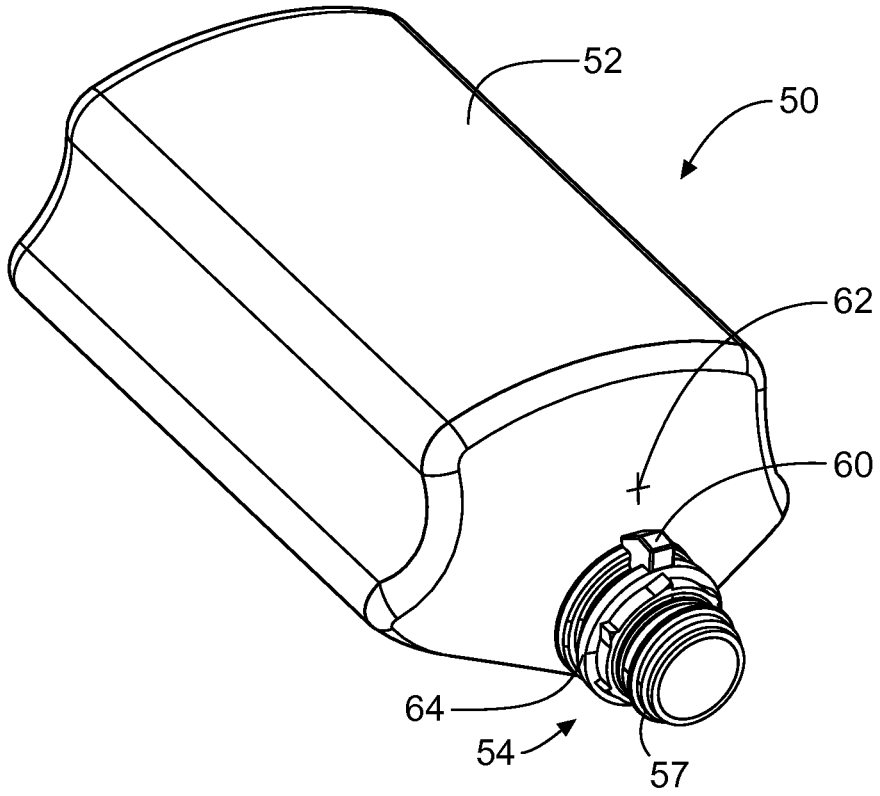
FIG. 17 is a perspective view of the container of FIG. 14 with the closure mechanism removed.
Figure 18:
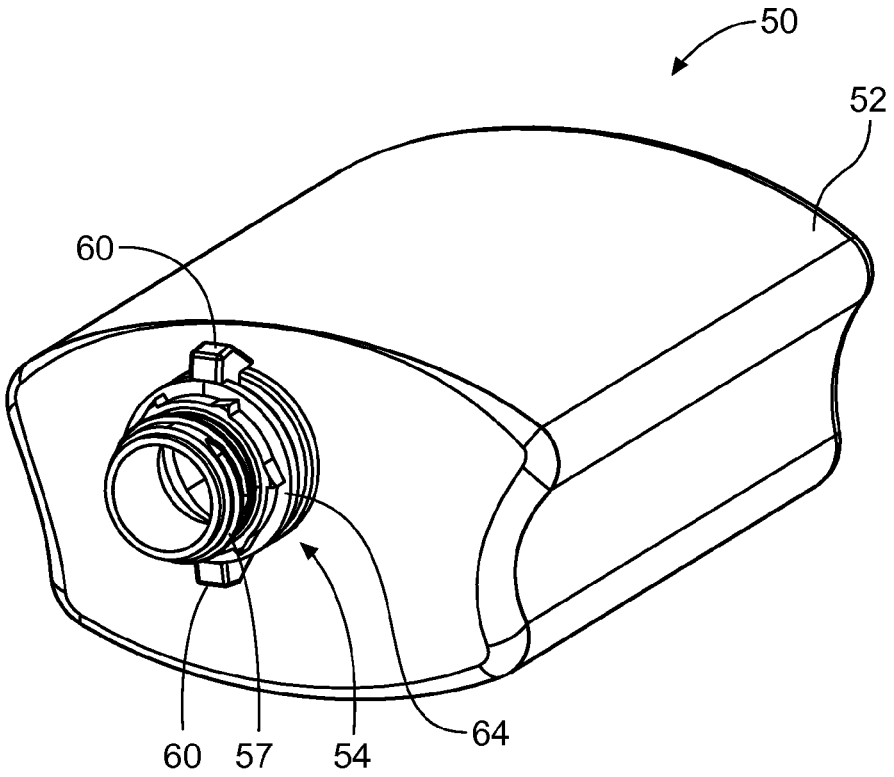
FIG. 18 is another perspective view of the container of FIG. 14 again with the closure mechanism removed.
Figure 19:
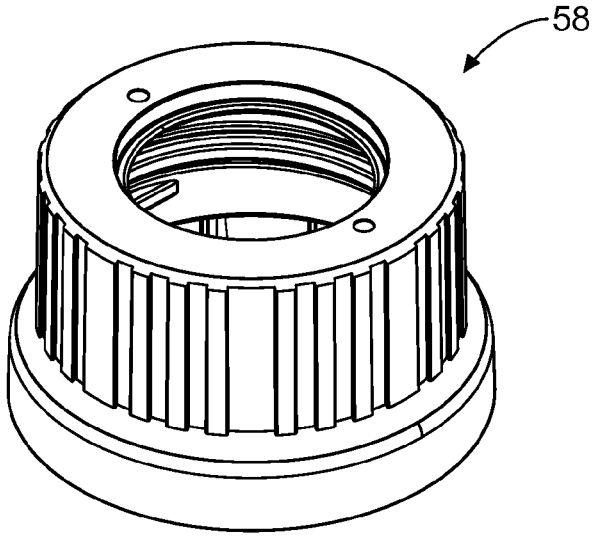
FIG. 19 is a perspective view of a closure mechanism of the container of FIG. 14 without the self-sealing mechanism therein.
Figure 20:
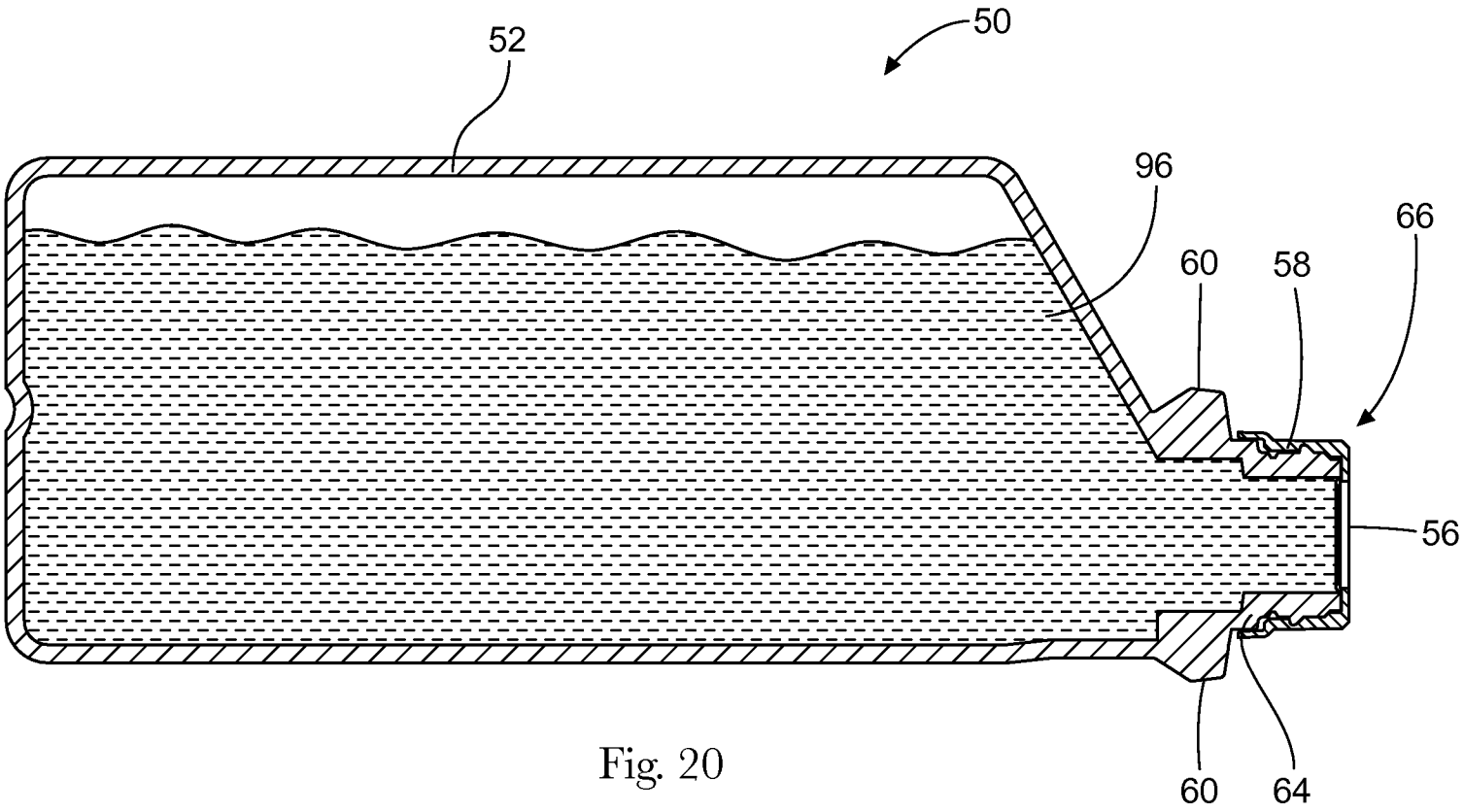
FIG. 20 is a cross-sectional view of the container of FIG. 14 having the closure mechanism including a seal-sealing mechanism and having a fluid in an interior space thereof.

In various embodiments, referring to FIGS. 2-5, the fluid dispensing system 14 can include an outer shell 16 configured to protect and/or contain various internal components of the fluid dispensing system. In at least one embodiment, the outer shell can define a track, including at least one and, preferably, two rails, and/or a slot 18. In such an embodiment, the rails and/or the slot can be configured to slidably accept a drawer or a housing 20. In various embodiments, the housing 20 can be slid along the rails and/or the slot within the outer shell 16 between at least a first position and a second position, for example. In at least one embodiment, the outer shell can be formed by internal walls or portions of the appliance, for example. In at least one embodiment, the housing 20 can at least partially extend from the outer shell 16 when in the first position and can be at least partially positioned within the outer shell 16 when in the second position. In such an embodiment, the second position can be a closed position. In various embodiments, the housing can also be slid into a third, intermediate position between the first position and the second position, for example. In at least one embodiment, the housing 20 can comprise a first end 22, a second end 24, and a cavity 26 intermediate the first end 22 and the second end 24. In such an embodiment, the cavity 26 can be configured to receive at least a portion of the container. In various embodiments, a container, such as container 50 of FIG. 14, for example, can be inserted and/or rocked into the cavity 26 in a substantially horizontal orientation, a substantially vertical orientation, and/or any other suitable orientation. In at least one embodiment, the housing can also include a handle 28 positioned on, or positioned proximate to, the first end 22 such that a user can slide the housing 20 along the track at least between the first position, through the third, intermediate position, and into the second position.

In yet another embodiment the fluid dispensing system comprises a hinged door to receive at least a portion of the refill container. The door can be configured to pivot or rotate at a specific point or direct the movement of the container along circular pathway (forming a track) from an open position to closed position. In order to decrease the possibility of fluid leakage at the point where the container is accessed by the fluid extracting member(s) (i.e. at the membrane or septum) the fluid extracting member can be designed to pivot together with any circular movement of the container as it moves along the track (i.e. the circular pathway). By providing a fluid extracting member which pivots simultaneously to the container and hinged door proper alignment can be achieved. For example, such as Fabric Article Treating Device and System disclosed in US Patent Appl. No. 2006/0080860 Clark et al.

In various embodiments, referring to FIGS. 6-13, the housing 20 and/or the outer shell 16 can include various alignment elements configured to aid the housing's alignment with at least one tube configured to retract the fluid from the container. The at least one tube will be discussed in further detail below. In at least one embodiment, the housing 20 can include at least one projection member 30 extending outwardly from the second end 24 of the housing 20. In such an embodiment, the projection member 30 can act against and/or be abutted with a wall 32 or other portion internal to the outer shell 16 to ensure that the container within the housing 20 is aligned with the at least one tube such that the fluid can properly be withdrawn from the container and provided to the appliance.

In various embodiments, a lower portion 34 of the housing 20 can include a fin 36 extending downwardly therefrom. In at least one embodiment, the fin 36 can include an aperture 38 defined therein. In various embodiments, a post 40 including a spring-loaded member 42 can extend inwardly from the outer shell 16. In such an embodiment, the spring-loaded member 42 can be biased towards the fin 36 by a spring and/or other biasing member, for example. In at least one embodiment, referring to FIG. 10, the fin 36 of the housing can be slid over the spring-loaded member 42, as the housing is moved along the track at least between the first position and a second position, until the aperture 38 in the fin 36 engages the spring-loaded member 42 and the spring loaded member biases itself into the aperture to thereby engage the fin 36 and essentially lock and/or retain the housing 20 in the second position. In other various embodiments, additional alignment elements can be included to align the housing with the at least one tube. In at least one embodiment, the various alignment elements can prevent, or at least inhibit, misalignment of the container with the at least one tube, for example. In various embodiments, the alignment elements can prevent, or at least inhibit, fluid from leaking out of the container, out of the outer shell, and/or being wasted, for example.

Figure 2:
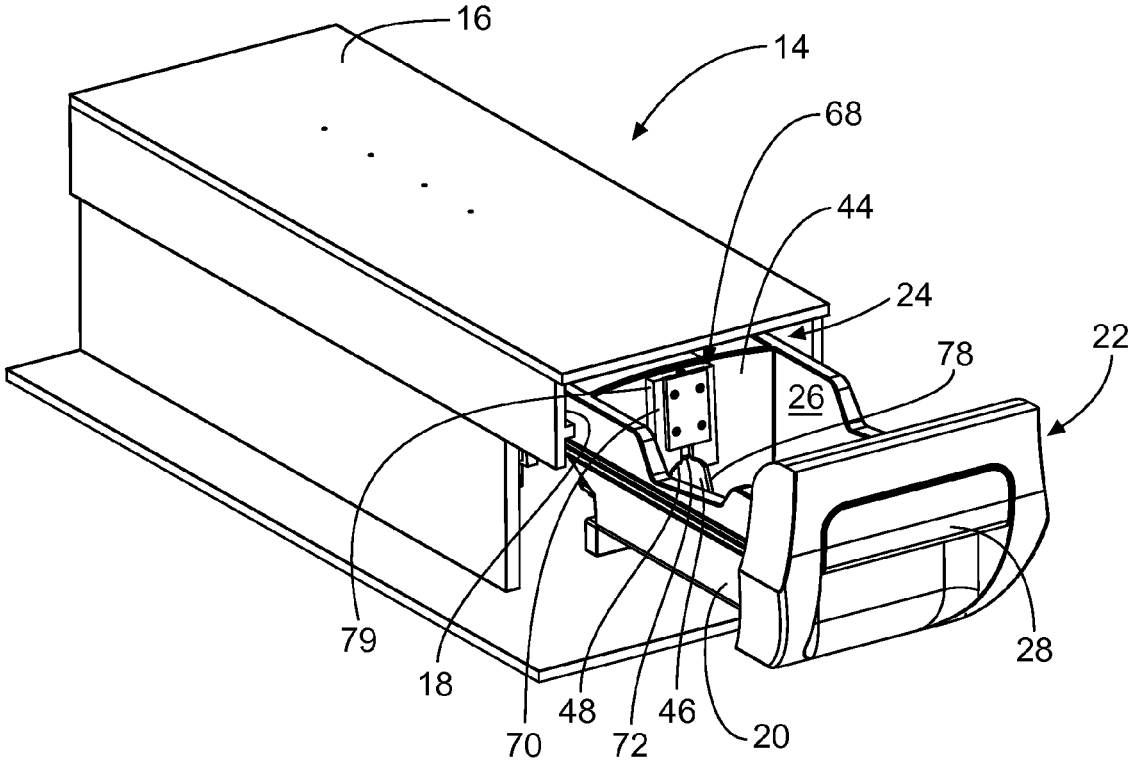
FIG. 2 is a perspective view of a fluid dispensing system without a container positioned within a housing in accordance with one non-limiting embodiment of the present invention.
Figure 3:
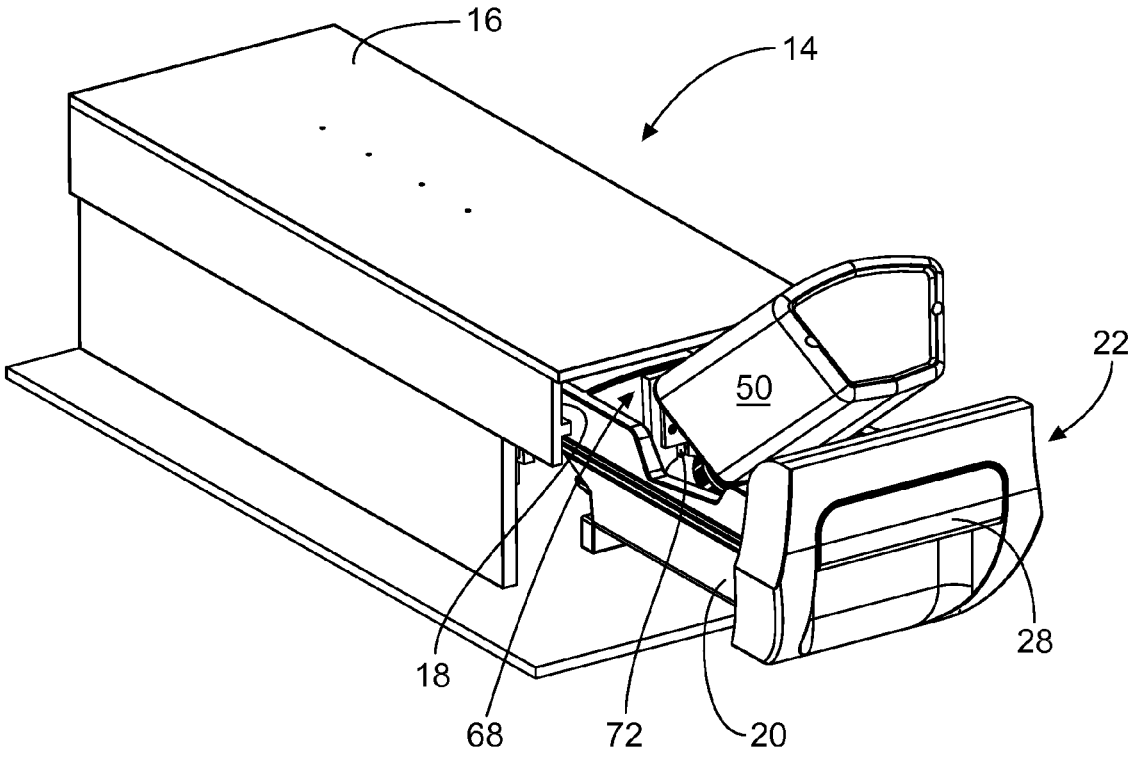
FIG. 3 is a perspective view of the fluid dispensing system of FIG. 2 illustrating a container being partially positioned within the housing.
Figure 4:
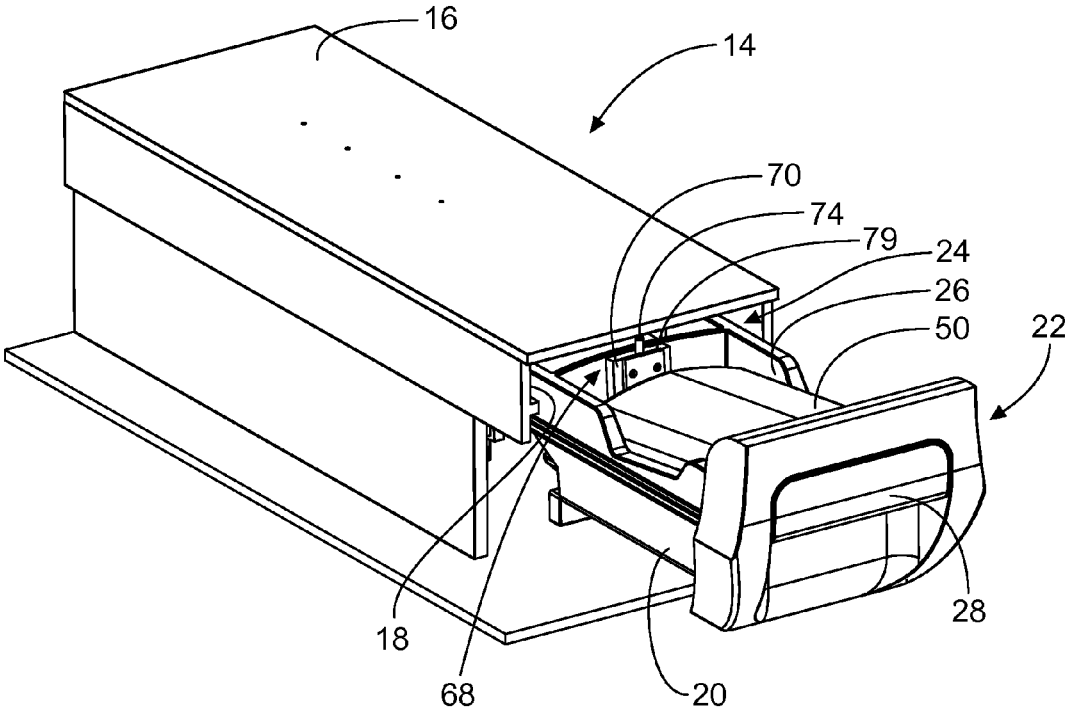
FIG. 4 is another perspective view of the fluid dispensing system of FIG. 2 illustrating the container positioned at least partially within the housing.
Figure 5:
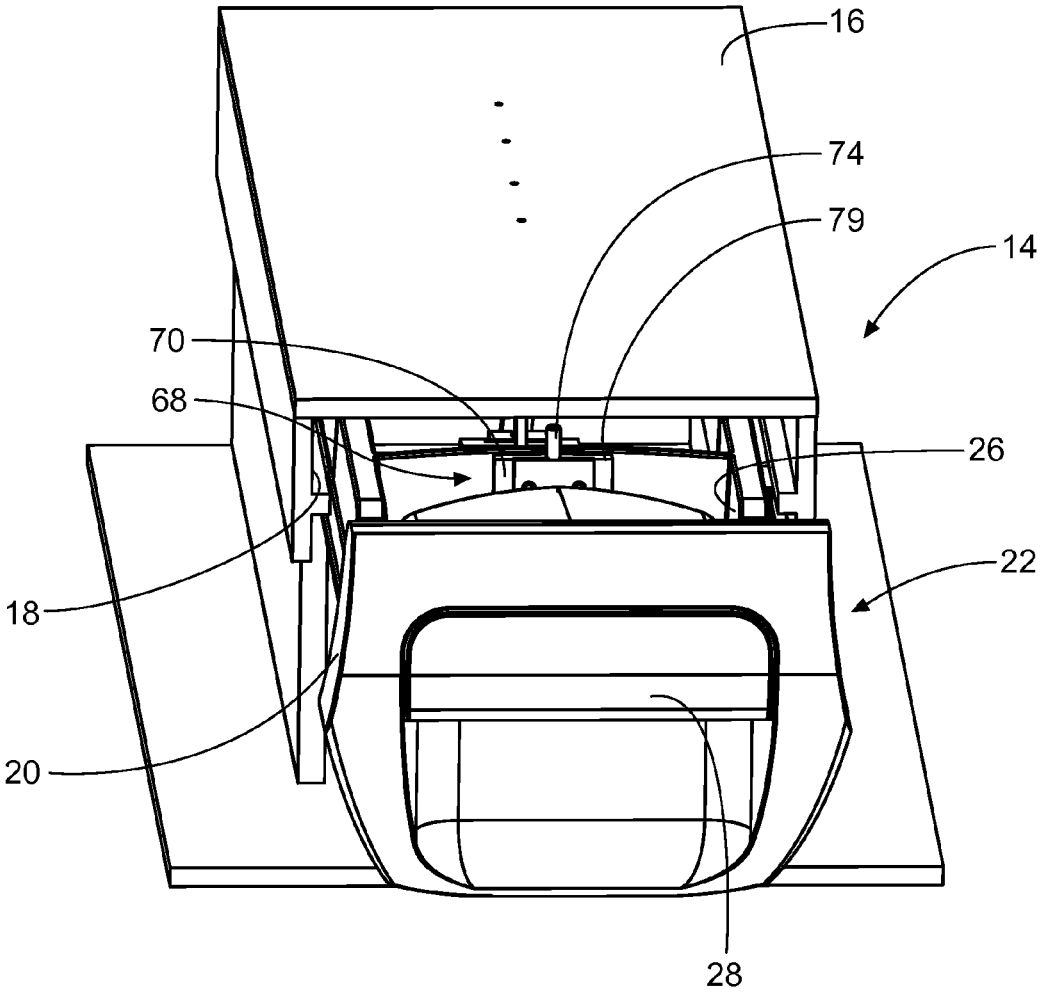
FIG. 5 is a front perspective view of the fluid dispensing system of FIG. 4.
Figure 6:
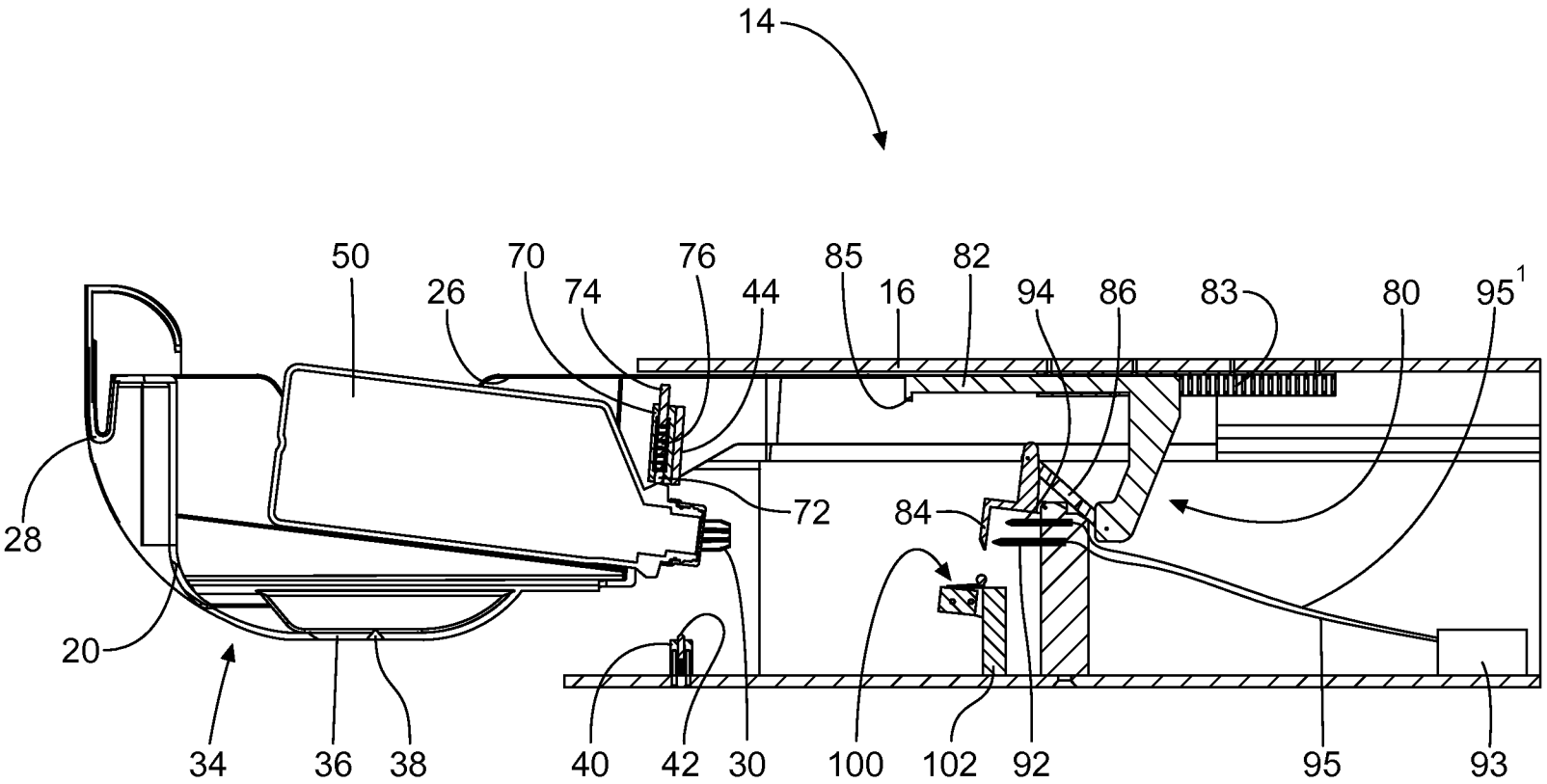
FIG. 6 is a cross-sectional view of the fluid dispensing system of FIG. 4.
Figure 7:
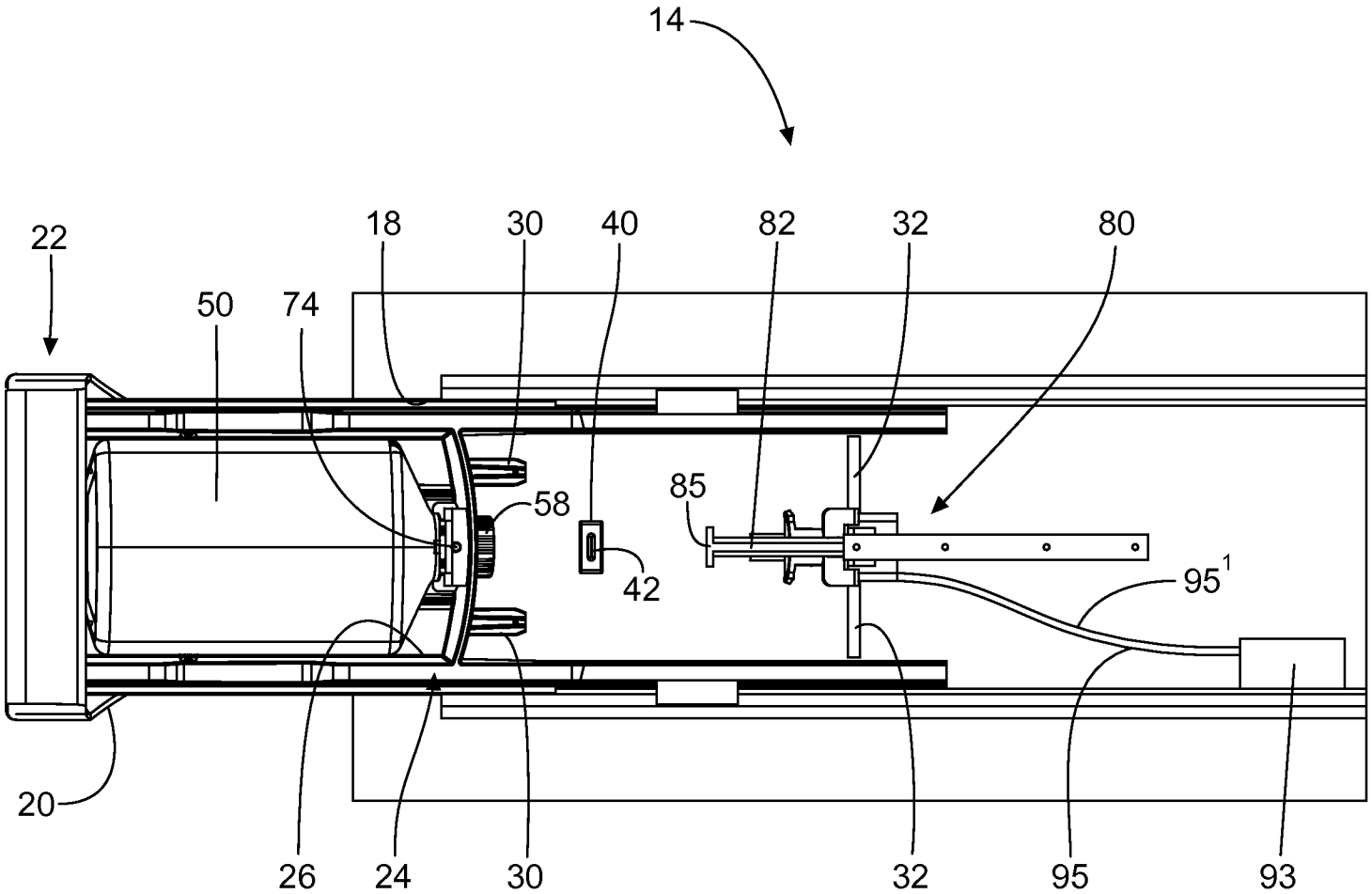
FIG. 7 is a top view of the fluid dispensing system of FIG. 4.
Figure 8:
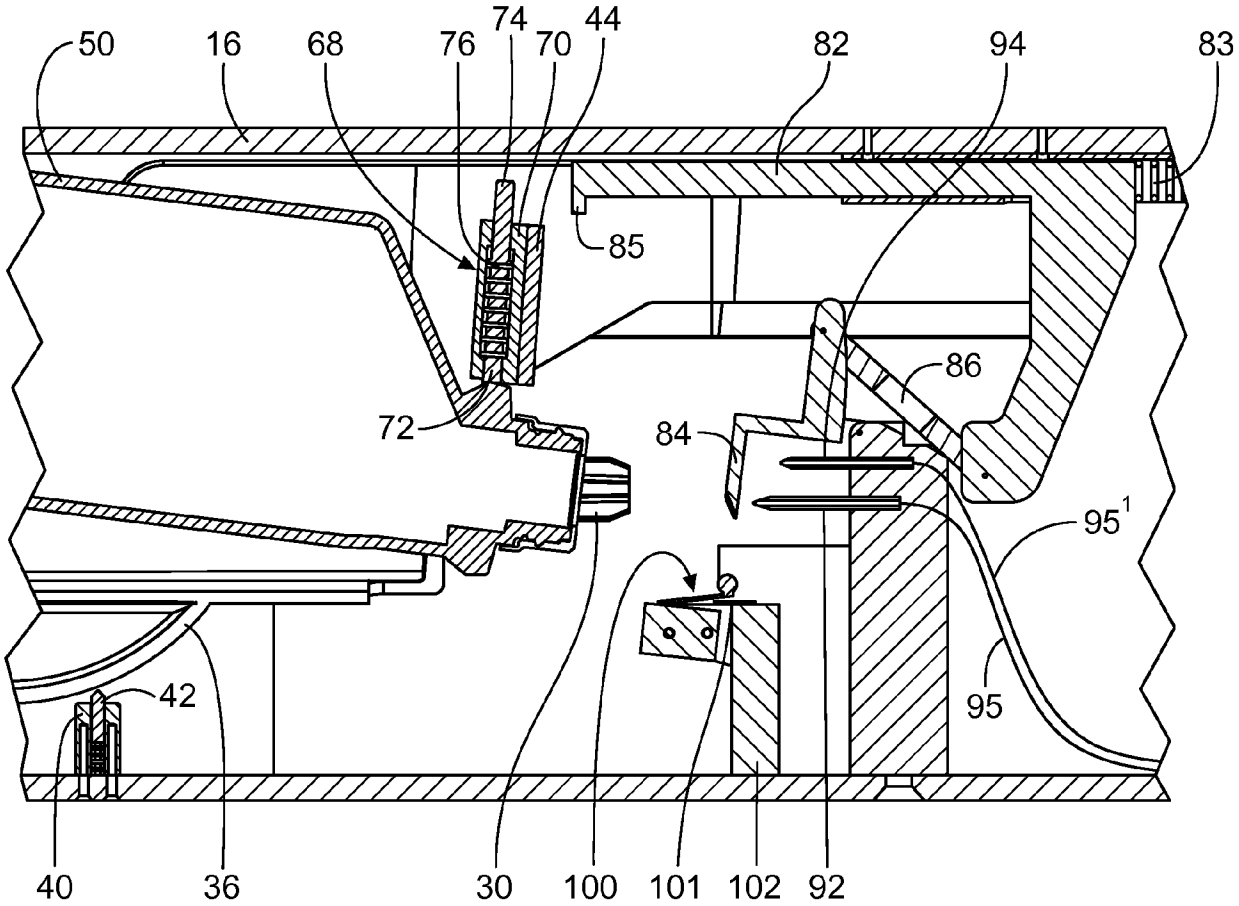
FIG. 8 is a partial cross-sectional view of the fluid dispensing system of FIG. 4 with the housing in a first partially closed position.
Figure 9:
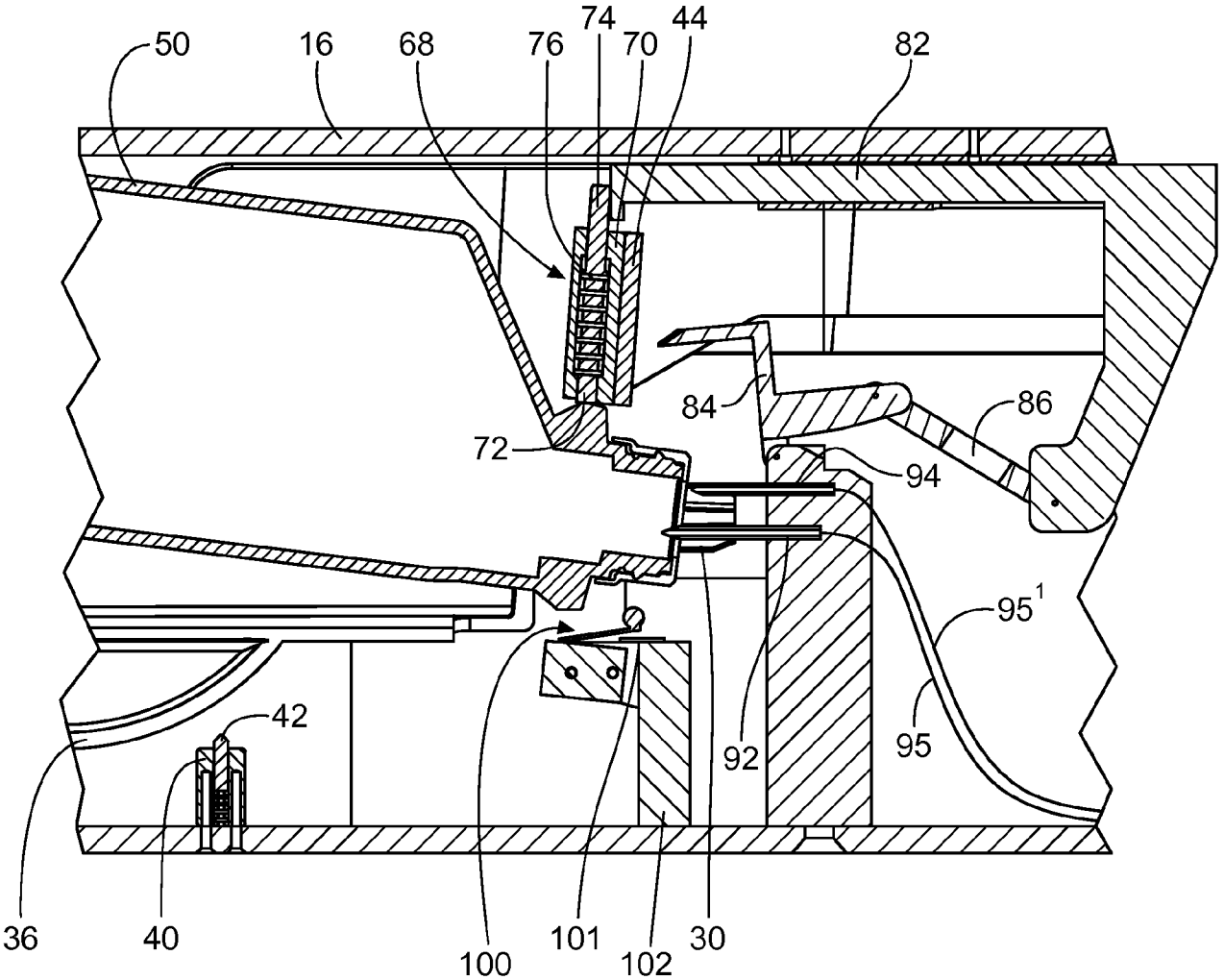
FIG. 9 is a partial cross-sectional view of the fluid dispensing system of FIG. 4 with the housing in a second partially closed position.
Figure 12:
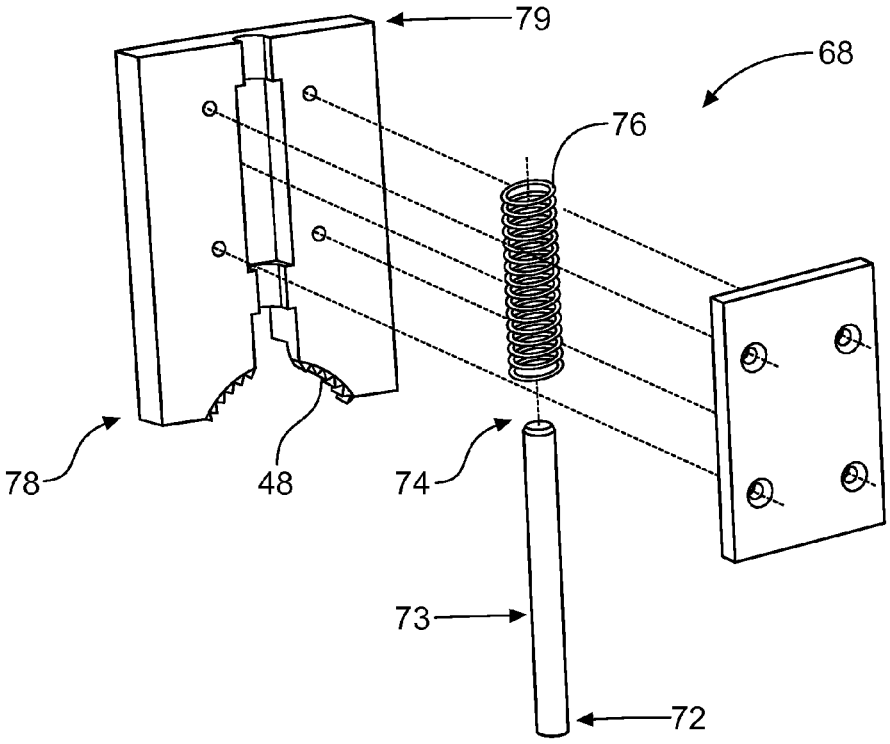
FIG. 12 is an exploded view of an engagement member with a gripping member positioned thereon in accordance with one non-limiting embodiment of the present invention.
Figure 13:
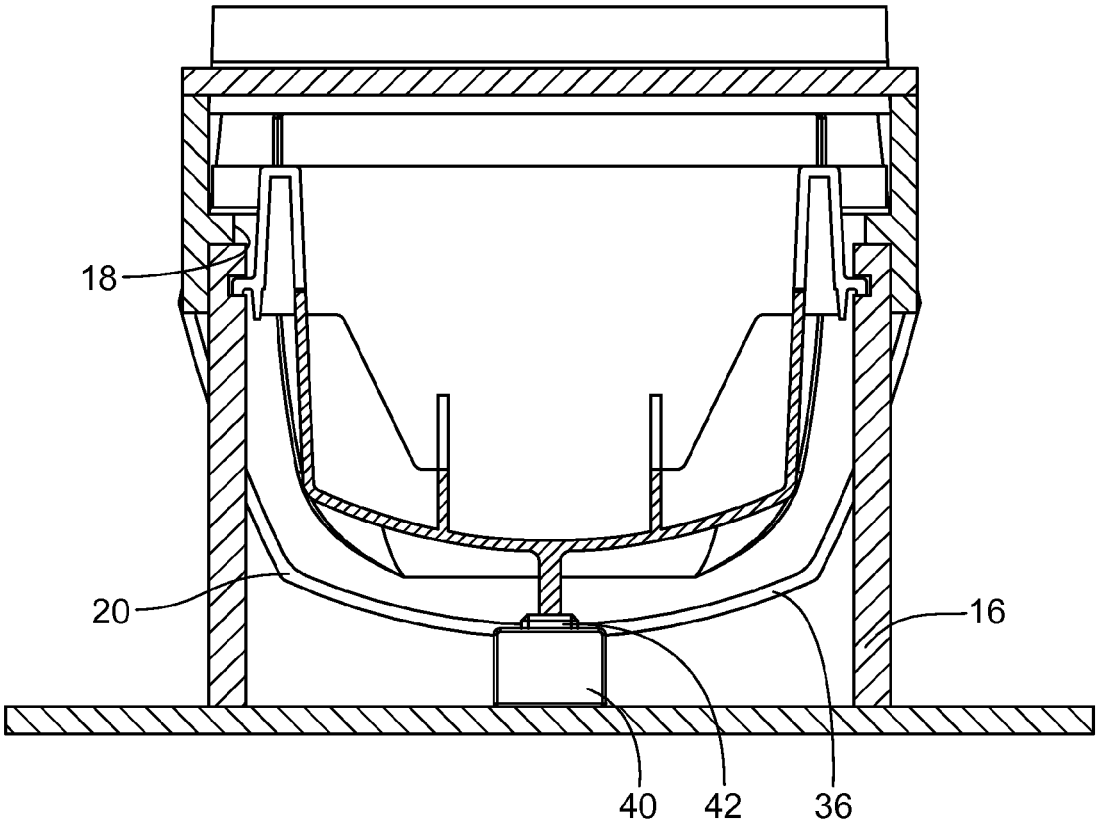
FIG. 13 is a cross-sectional view of an alignment member engaging an aperture on a lower portion of the housing in accordance with one non-limiting embodiment of the present invention.

In various embodiments, referring to FIGS. 2 and 12, the housing 20 can further include a side wall 44 on the second end 24 defining an aperture 46 therein. In at least one embodiment, a portion of a container, such as a neck, an annular ring, a closure mechanism, and/or an adapter having at least one camming surface, for example, can be positioned into and at least partially through the aperture 46 such that fluid can be retracted from the container. In various embodiments, the side wall 44, a side portion of aperture 46, and/or a portion of an engagement member can include a gripping member 48 positioned thereon at any suitable location. In such an embodiment, the gripping member 48 can be configured to grip and/or otherwise engage a portion of the container extending through the aperture 46 to hold the container in a relatively fixed position with respect to the side wall 44 and within the housing 20. In various embodiments, the gripping member can include a textured surface, a recess, a ridge, an angled portion, a narrow waisted region, and/or any other suitable member configured to engage the neck, annular ring, and/or closure mechanism of the container, for example. These various gripping members 48 can be used to frictionally engage, mechanically engage, and/or otherwise engage the portion of the container extending through the aperture in the side wall 44. In various embodiments, the gripping member can enable alignment of the container as it is rocked into the cavity such that the at least one camming surface can contact the engagement member. In one embodiment, an alignment indicator can be provided to inform the user when the container is placed in the proper position in the device. Non-limiting examples of suitable alignment indicators include audible indicators which can be mechanical (i.e. a clicking sound) or electrical (i.e. a beep) or a mechanical indicator such as a spring loaded member i.e. ball and socket or a tongue and groove, where the engagement of the spring loaded member provides a physical indication that the container is properly positioned. In other various embodiments, the annular ring can be engaged with the aperture 46 to ensure positive placement of the container in the housing and essentially lock the container in position such that the container cannot be forced away from the side wall 44 when fluid is withdrawn therefrom. By holding the container in a relatively fixed position within the housing 20, the fluid dispensing system 14 can easily be aligned with the container such that fluid can be properly and accurately withdrawn, with minimal leakage, from the container. Further, the gripping member 48 can allow the fluid dispensing system to be used with a plurality of container configurations; even those which are not specifically designed to precisely fit within the housing 20 (e.g. container configurations which are smaller than the cavity of the housing). In other various embodiments, the gripping member 48 can hold the container in position such that the at least one tube can puncture, pierce, and/or otherwise engage, the closure mechanism of the container.

In various embodiments, referring to FIGS. 2-5, 14-19, and 25, a container, such as container 50, for example, can be configured to be used with the fluid dispensing system 14 and can be at least partially positioned within the cavity 26 of the housing 20. In at least one embodiment, the container 50 can include a body 52, a neck 54 or neck portion, a self-sealing mechanism 56, a cap 58, and/or at least one camming surface 60. In such an embodiment, the body 52 can be formed of a rigid, semi-rigid, and/or flexible material, such as polypropylene, polyethylene, high or low density polyethylene, and/or PET, for example. In various embodiments, the container can be formed using a conventional extrusion blow molding process, an injection stretch blow molding process, and/or any other suitable process, for example. In at least one embodiment, the container can be at least partially formed of a flexible pouch. In one embodiment, the container comprises a flexible pouch contained within the container body. In this embodiment, only one fluid extracting element would be needed, although more than one is also suitable, as the flexible pouch can deform to accommodate decrease in fluid volume.

In various embodiments, the neck 54 can include threads 57 such that the cap 58 can be screwed thereon. In at least one embodiment, the neck 54 can be positioned on the body 52 at a location offset from a longitudinal, central axis 62 of the container 50 to allow for more efficient withdrawal of the fluid from the container when the container is in a substantially horizontal and/or a substantially vertical orientation. In such embodiments, the offset positioning of the neck 54 can also allow the fluid to drain toward the neck as the offset neck can generally be positioned at, below, or proximate to, the lowest portion of the container, for example. Those of skill in the art will understand that embodiments where the container is positioned horizontally, it could be desirable to have the neck positioned below the lowest portion of the container to allow for increased drainage of fluid. In other various embodiments, the neck 54 can be positioned on the central axis 62 of the container 50 or in any other suitable position, such as on a side wall of the container, for example. In various embodiments, the neck 54 can be at least partially engaged with the aperture 46 in the side wall 44 and/or the gripping member 48 (FIG. 2) such that the container 50 can be fixedly engaged with the housing 20 to prevent, or at least inhibit, faulty alignment of the container 50 with the at least one tube of the fluid dispensing system 14. In at least one embodiment, the neck 54 can include an annular ring 64 extending at least partially around a periphery thereof and a closure mechanism 66. The closure mechanism can include the cap 58 and the self-sealing mechanism 56.

In various embodiments, the self-sealing mechanism 56 can be at least partially comprised of a silicon material, and/or any other suitable material configured to re-seal after being pierced or punctured (i.e., puncturable), and can be biased towards a tube engaging portion of the closure mechanism 66 via a spring or other biasing member, for example. In such an embodiment, the biasing of the self-sealing mechanism 56 toward the at least one tube can aid in the puncturing and/or piercing of the at least one tube. In at least one embodiment, the neck 54, the annular ring 64, the cap 58, the adapter, and/or a portion of the container 50, such as the container body 52, for example, can include the at least one camming surface 60 which can extend outwardly therefrom.

In various embodiments, an outer portion of the container can comprise a textured surface to facilitate handling by a user when placing the container into the fluid dispensing system. In at least one embodiment, the textured surface can include ridges, a rough surface, and/or a sleeve having the textured surface, wherein the sleeve can be configured to fit over at least a portion of the container, for example. Various non-limiting examples of portions of the container which can have such a textured surface can include the container body, the neck, and/or any discrete section of the container body, for example.

In various embodiments, the at least one camming surface 60 can be comprised of one or more camming surfaces, for example. In other various embodiments, the at least one camming surface can include one or more cams, lugs, and/or projections. In further various embodiments, the container can be configured to accept an adapter which can fit over at least a portion of the neck and/or the annular ring, wherein the adapter can include the camming surface(s), for example. In such an embodiment, the adapter can allow any suitable container to be configured for use with the fluid dispensing system. In various embodiments, each of the cams, lugs, and/or projections can have the same, similar, or different shapes and sizes, for example. Non limiting examples of suitable shapes can include cones, cylinders, rectangles, squares, and/or any other suitable polygonal shape. In at least one embodiment, the at least one camming surface can include a first portion extending a first distance from the container and a second portion extending a second distance from the container, wherein the first distance can be greater than and/or less than the second distance, for example. In other various embodiments, the at least one camming surface can include at least a first portion, a second portion, and a third portion. In still other various embodiments, the at least one camming surface can include a first lug or cam and a second lug or cam. In such an embodiment, the first lug and the second lug can both be formed integral with the at least one camming surface, for example, and the first lug can extend from the neck, the cap, the annular ring, and/or the container body a distance greater than the second lug, for example. In various embodiments, the plurality of camming surfaces, cams, projections, and/or lugs can be positioned about the periphery of the neck, cap, annular ring, and/or the container body in any suitable configuration. In at least one embodiment, a first camming surface can be positioned: less than about 180 degrees from a second camming surface, less than about 120 degrees from a second camming surface, less than about 90 degrees from a second camming surface, or less than about 45 degrees from a second camming surface, for example. In various embodiments, container 50*a* illustrates another various container configuration, for example. Of course, those of ordinary skill in the art will recognize that any other suitable positioning of a first camming surface with respect to any number of additional camming surfaces may be appropriate in certain contexts and is within the scope of the present disclosure.

In various embodiments, referring to FIGS. 2-6, 8-10, 12, 26, and 27, an engagement member 68 can be included on and/or attached to the housing 20. In at least one embodiment, the engagement member 68 can be included on and/or attached to the side wall 44 of the housing proximate to, and/or partially overlapping with, the aperture 46 in the side wall 44. In other various embodiments, the engagement member 68 can be included on and/or attached to any other suitable portion of the fluid dispensing system 14 and/or the housing 20. In various embodiments, the engagement member 68 can be included within a mounting assembly 70 and can comprise a first portion 72, a second portion 74, and a middle portion 73. In at least one embodiment, the mounting assembly 70 can include a biasing element 76, such as a spring, for example, configured to bias the engagement member 68 toward a first side 78 of the mounting assembly 70 such that the first portion 72 of the engagement member 68 can at least partially extend into the aperture 46. In such an embodiment, when the neck 54, the annular ring 64, and/or the at least one camming surface 60 is at least partially inserted through the aperture 46, the neck 54, annular ring 64, and/or the at least one camming surface 60 can be engaged with the first portion 72 of the engagement member 68 to bias the engagement member away from the neck 54, annular ring 64, and/or the at least one camming surface 60. Such engagement of the first portion 72 can cause the second portion 74 of the engagement member 68 to at least partially extend from the second side 79 of the mounting assembly 70 to allow the engagement member to be engaged with a slider member of a protective plate system within the fluid dispensing system 14. In various embodiments, any other suitable engagement member can be used to engage a portion of the housing 20 and/or the container with the slider member of the protective plate system, for example. In at least one embodiment, the engagement member can be engaged with the slider member to cause a protective plate to uncover the at least one tube such that fluid can be retracted from the container. In such an embodiment, a fluid system may not be activated until the protective plate is in the uncovered position, for example. In various embodiments, the fluid dispensing system can operate without the engage of the engagement member 68, as other portions of the housing 20 and/or the container 50 could contact the slider member of the protective plate system, for example.

In various embodiments, referring to FIGS. 6-11, a protective plate system 80 can be positioned within, attached to, and/or formed integral with the outer shell 16. In at least one embodiment, the protective plate system 80 can include a slider member 82, a protective plate 84, and a linkage 86 configured to connect the slider member to the protective plate. In such an embodiment, the linkage 86 can include a first end connected, such as pivotably connected, for example, to the slider member 82 and a second end connected, such as pivotably connected, for example, to the protective plate 84. In various embodiments, the slider member 82 can include a biasing element 83, such as a spring, for example, configured to bias the protective plate 84 into a position in which it at least partially covers the at least one tube. In operation, as the housing 20 is moved from the first position (distal with respect to the slider member, see e.g., FIG. 8) into the second position (proximal with respect to the slider member, FIG. 10) and the second portion 74 of the engagement member 68 at least partially extends from the mounting assembly 70 when the container 50 is present within the cavity 26, the engagement member 68 is configured to be engaged with a lip portion 85 of the slider member 82 to cause the slider member to move distally within the outer shell 16. In various embodiments, the distal movement of the slider member 82 can causing the linkage 86 to move downwardly and/or distally to pivot the protective plate 84 into a position wherein the at least one tube is at least partially uncovered. As the housing 20 is opened and/or moved from the second position into the first position, the engagement member 68 can allow the slider member to move in the same direction in which the housing 20 is moving, owing the biasing element of the slider member 82. In such an embodiment, the slider member's movement can allow the linkage 86 to move proximally and/or upwardly to thereby allowing the protective plate 84 to pivot into a position, where it at least partially covers the at least one tube. In at least one embodiment, the protective plate system 80 will not be moved if a container is not present in the housing, owing to the fact that the engagement member will not be extended from the mounting assembly 70. In various embodiments, any suitable type of protective plate system configured to be moved between a first position, where the at least one tube is at least partially covered and a second position, wherein the at least one tube is at least partially uncovered, is within the scope of the present disclosure.

In various embodiments, the at least one tube can be provided within the outer shell 16. In at least one embodiment, the at least one tube can include a tube (or tubes) defining an aperture or bore for conveying fluids and/or gases therethrough. The term "gases" may include air or other gases for pressuring, or preventing, or at least inhibiting, a vacuum from being creating within the container 50 when a fluid is being withdrawn from the container. In at least one embodiment, the at least one tube (or tubes) can comprise a hollow, generally cylindrical body defining a circular cross-section. In other various embodiments, the at least one tube (or tubes) may define various hollow body cross-sectional shapes including square, rectangular, triangular, and/or any other suitable polygonal cross-sectional shape. In various embodiments, referring to FIGS. 6, 8-10, and 26-27, the at least one tube can include a fluid extracting element 92 configured to withdraw a fluid 96 from the container 50. The fluid extracting element 92 can be in fluid communication with a fluid system 93, which can include a pump, such as a vacuum pump, for example. In at least one embodiment, a conduit 95 can fluidly connect the fluid system 93 and the fluid extracting element 92 such that the fluid extracting element can have a suction therein to withdraw the fluid from the container. In such an embodiment, the fluid can then be channeled through the conduit 95 and provided to an appropriate portion of the appliance 10, owing to the fluid system 93. The appliance can then use the fluid to run an operating cycle, for example. In various embodiments, the fluid system 93 can be powered by the appliance itself, by a battery, and/or by any other suitable power source. In at least one various embodiment, the container preferably fits properly within the housing for the fluid system 93 to be powered. In one such embodiment, a second camming surface, a lug, a projection, and/or a cam, for example, can activate the power source to supply electrical input to the fluid system 93.

In various embodiments, still referring to FIGS. 6, 8-10, and 26-27, in addition to the fluid extracting element 92, the at least one tube can comprise a vent tube 94 configured to create a pressure differential between the internal space of the container 50 or the fluid 96 and an internal aperture within the fluid extracting element 92 or at the discharge point of fluid extracting element 92 as the extracted fluid is transferred to conduit 95. In at least one various embodiment, the vent tube 94 can flow a fluid and/or a gas through conduit 95' and into the container 50 to create the pressure differential between the container and the fluid retracting element before and/or while the fluid extracting element 92 withdraws fluid from the container. In other various embodiments, the vent tube 94 can be eliminated and a container can be provided with a positive pressure, where the positive pressure can be sufficient such that at least most of the fluid 96 within the container 50 can be withdrawn and/or expelled into the fluid extracting element 92. In other various embodiments, the at least one tube can include other tubes, such as puncturing and/or piercing elements, for example, and/or one or more vent tubes and/or fluid retracting elements, for example.

Figure 10:
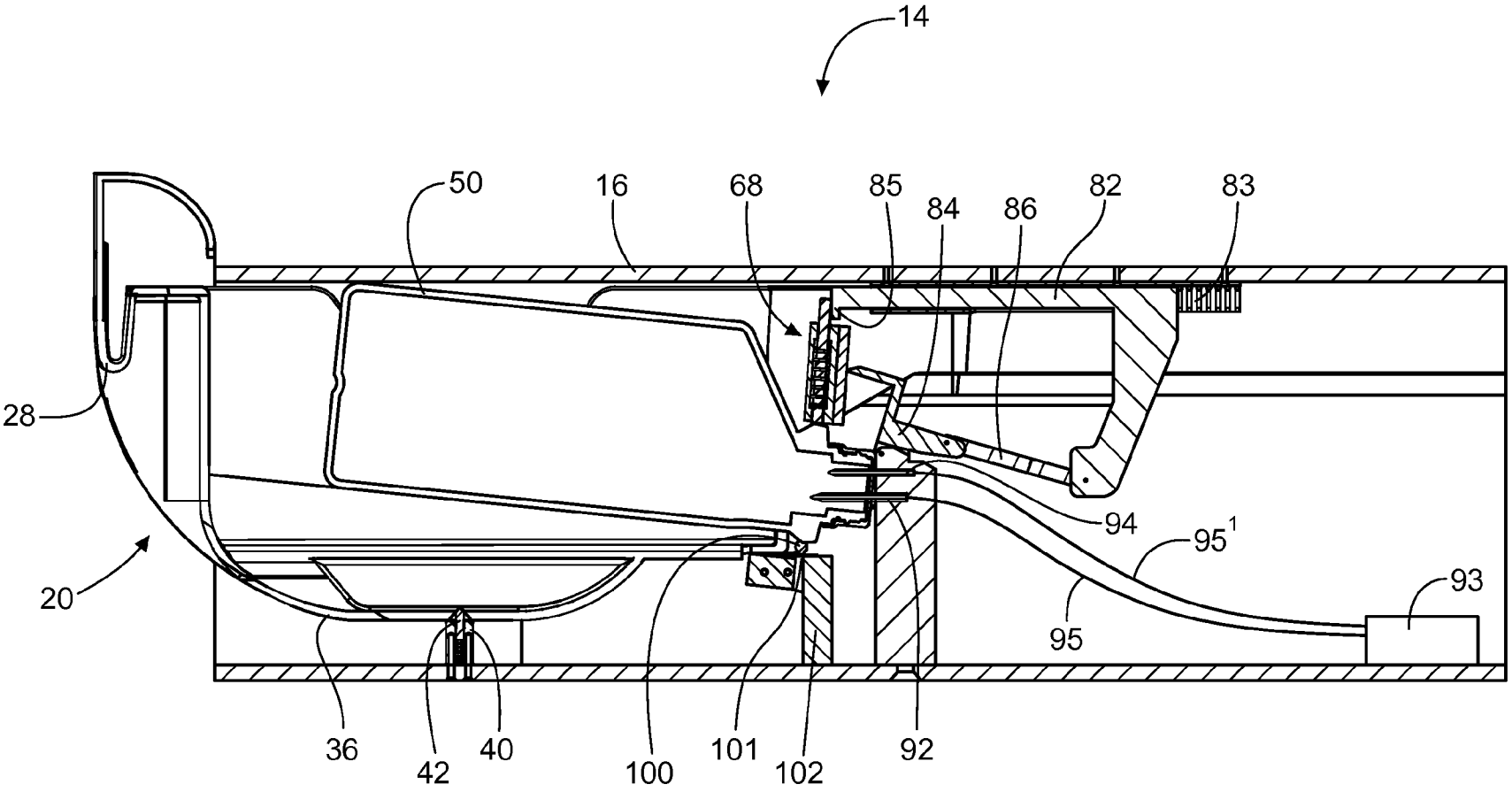
FIG. 10 is a cross-sectional view of the fluid dispensing system of FIG. 4 with the housing in a fully closed position.
Figure 11:
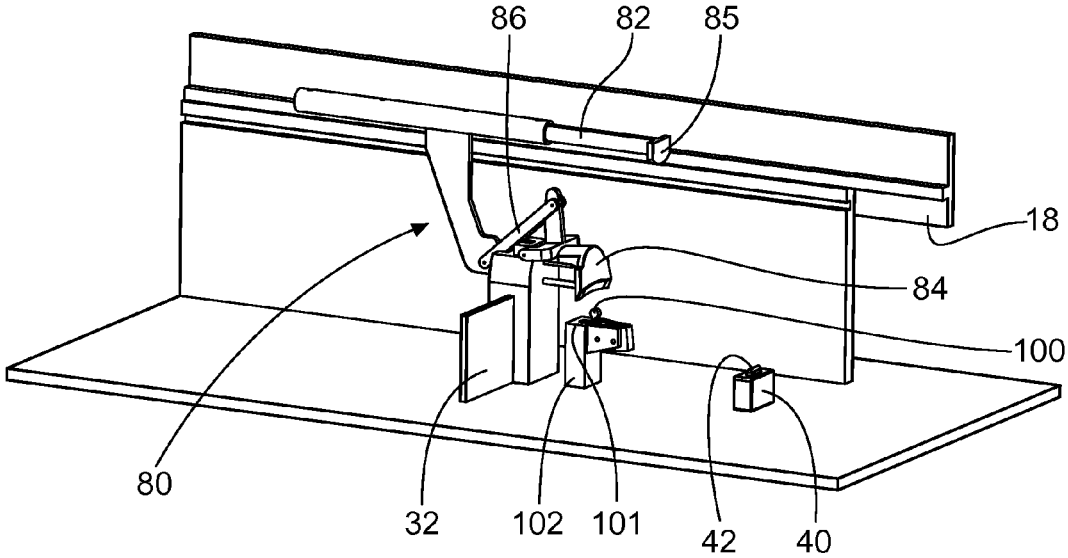
FIG. 11 is a perspective view of a protective plate system and at least one tube in accordance with one non-limiting embodiment of the present invention.

In various embodiments, referring to FIGS. 9, 10, 26, and 27, the at least one tube can be configured to puncture, pierce, and/or otherwise engage the self-sealing mechanism 56 as the housing 20 is slid from the first position (e.g., FIG. 8) and/or the third, intermediate position (e.g., FIG. 9), and into the second position (e.g. FIG. 10). In other various embodiments, the at least one tube can be advanced toward the housing 20, by any suitable mechanical member, when the housing is in the second position such that the at least one tube can again puncture, pierce, and/or otherwise engage the self-sealing mechanism 56, for example. In at least one embodiment, the self-sealing mechanism can be at least partially formed of a resilient re-sealable material, such as silicon, for example. In operation, the at least one tube can pierce, puncture, and/or otherwise engage, the self-sealing mechanism 56 such that the at least one tube can be positioned in fluid communication with the internal space of the container 50 and/or the fluid 96, as the housing 20 is moved between the first position, through the third, intermediate position, and into the second position. In various embodiments, prior to the at least one tube puncturing, piercing, and/or otherwise engaging the self-sealing mechanism 56, the protective plate 84 can be moved to a position where it is not covering the at least one tube as the engagement member 68 pushes the slider member 82 distally within the outer shell 16, as discussed above.

In various embodiments, a second camming surface, lug, projection, and/or cam of the container can be engaged with an electro-mechanical switch 100, and/or other actuation member, positioned within the outer shell 16 when the housing 20 is moved into the second position and/or the third, intermediate position. In at least one embodiment, referring to FIGS. 6, 8-11, 26 and 27, the electro-mechanical switch 100 can be mounted on a support 102 extending inwardly from the outer shell 16. In any configuration, the electro-mechanical switch 100 can be positioned within the outer shell 16 such that it can be engaged by the at least one camming surface, lug, projection, and/or cam, and/or a second camming surface, lug, projection, and/or cam, for example. In various embodiments, the electro-mechanical switch can be configured to actuate, and/or supply power to, the fluid system 93, or other internal component of the fluid dispensing system when a circuit is closed (e.g., the electro-mechanical switch 100 is biased against the contact plate 101) by activation of the electro-mechanical switch by at least one camming surface, lug, projection and/or cam, and/or a second camming surface, lug, projection, and/or cam, to allow the fluid extracting element 92 to withdraw fluid from the container 50. The fluid can then flow through the conduit 95 and be provided to a portion of the appliance 10 such that the appliance can then use the fluid to run an operating cycle.

In various embodiments, more than one electro-mechanical switch can be provided within the outer shell 16. In such an embodiment, a first camming surface can be configured to engage a first electro-mechanical switch and a second camming surface can be configured to engage a second electro-mechanical switch, for example. As the first camming surface engages the first electro-mechanical switch, the appliance can be configured to run a first cycle and/or withdraw a first amount of fluid from the container and, as the second camming surface engages the second electro-mechanical switch, the appliance can be configured to run a second cycle and/or withdraw a second amount of fluid from the container, for example. In other various embodiments, a plurality of electro-mechanical switches and/or other various circuit activating members can be positioned within the outer shell such that as the electro-mechanical switches are engaged by camming surfaces, cams, projections, lugs, and/or other various portions of a containers, the appliance can be instructed to perform a particular function or functions. In such an embodiment, the particular function(s) can include withdrawing fluid from the container and/or injecting a particular amount of the fluid, such as a fragrance, bleach, detergent, wrinkle control fluid, and/or other suitable fluid or gas, for example, into the appliance. In other various embodiments, the particular function(s) can include running an operating cycle for a particular period of time, for example. In still other various embodiments, the particular function(s) can be function(s) suitable for a particular appliance.

In various embodiments, three camming surfaces, cams, projections, and/or lugs can be provided on the container, annular ring, closure mechanism, and/or neck. In such an embodiment, the first camming surface, cam, projection, and/or lug can be configured to engage the engagement member such that the engagement member can engage the slider member to move the protective plate into a position where it is not covering the at least one tube. In various embodiments, the second camming surface, cam, projection, and/or lug can be configured to engage a first electro-mechanical switch to activate and/or supply power to the fluid system. In such an embodiment, the third camming surface, cam, projection, and/or lug can engage a second electro-mechanical switch to advance the at least one tube towards the self-sealing mechanism of the closure mechanism to puncture, pierce, or otherwise engage the self-sealing mechanism with the at least one tube so that fluid can be withdrawn from the container. In at least one embodiment, the various camming surfaces can engage their respective components in a predetermined and/or a sequential order, for example.

Figure 21:
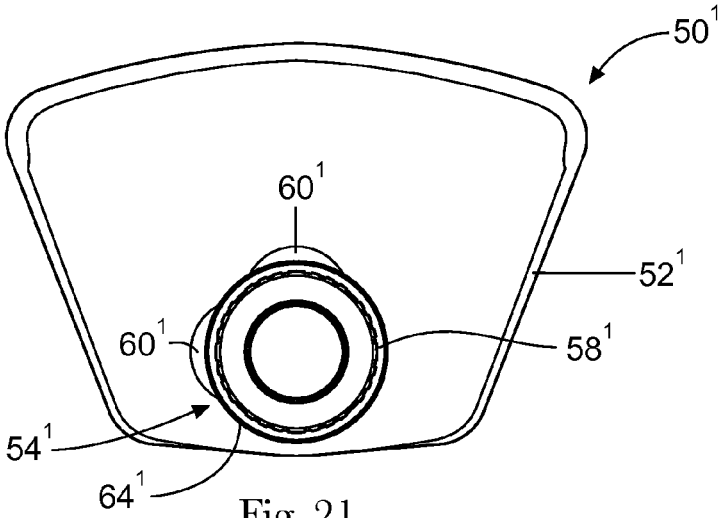
FIG. 21 is a top view of another container in accordance with one non-limiting embodiment of the present invention.
Figure 22:
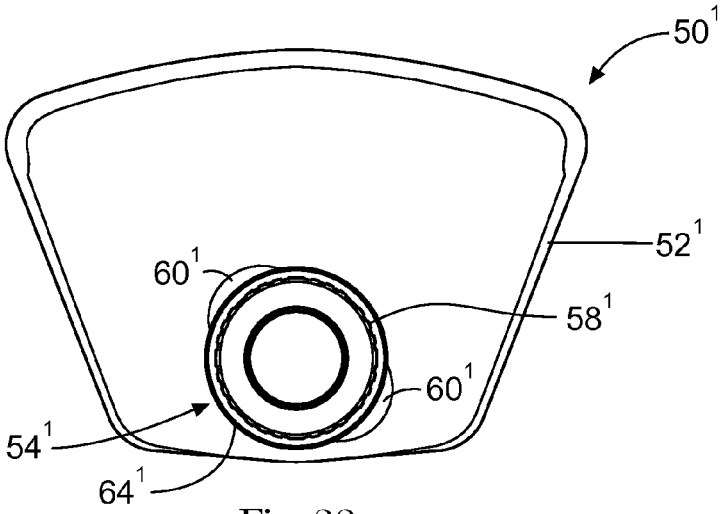
FIG. 22 is a top view of yet another container in accordance with one non-limiting embodiment of the present invention.
Figure 23:
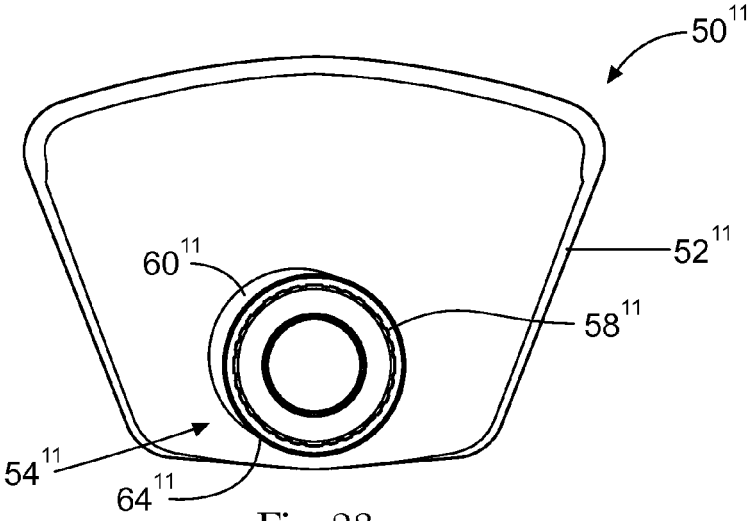
FIG. 23 is a top view of still another container in accordance with one non-limiting embodiment of the present invention.
Figure 24:
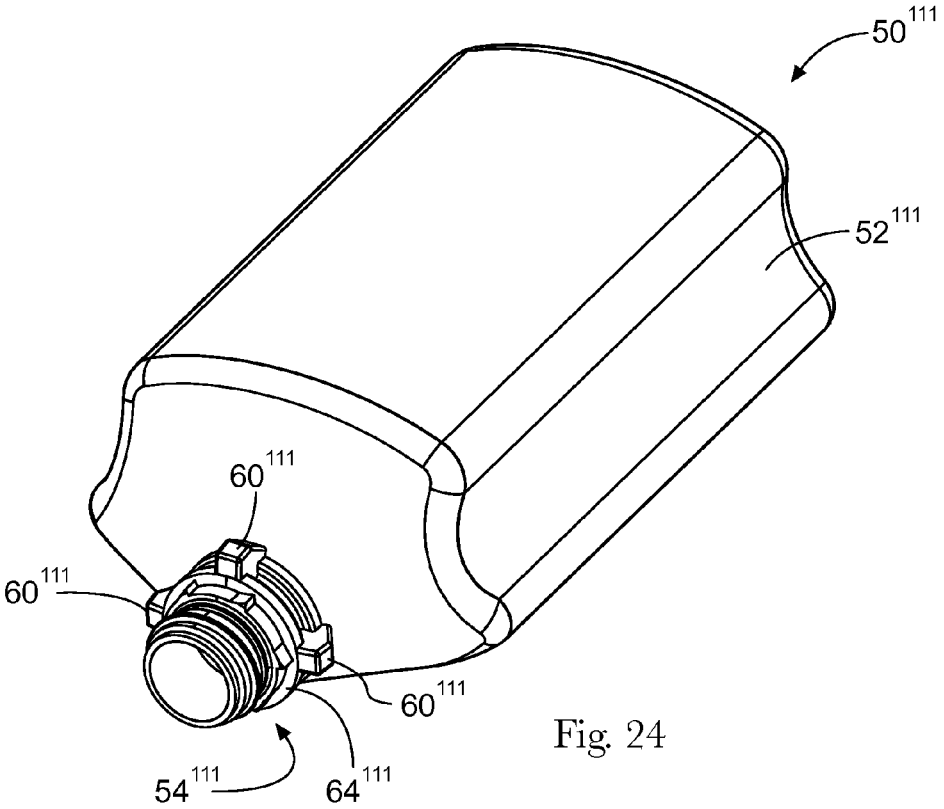
FIG. 24 is a perspective of still another container in accordance with one non-limiting embodiment of the present invention.
Figure 25:
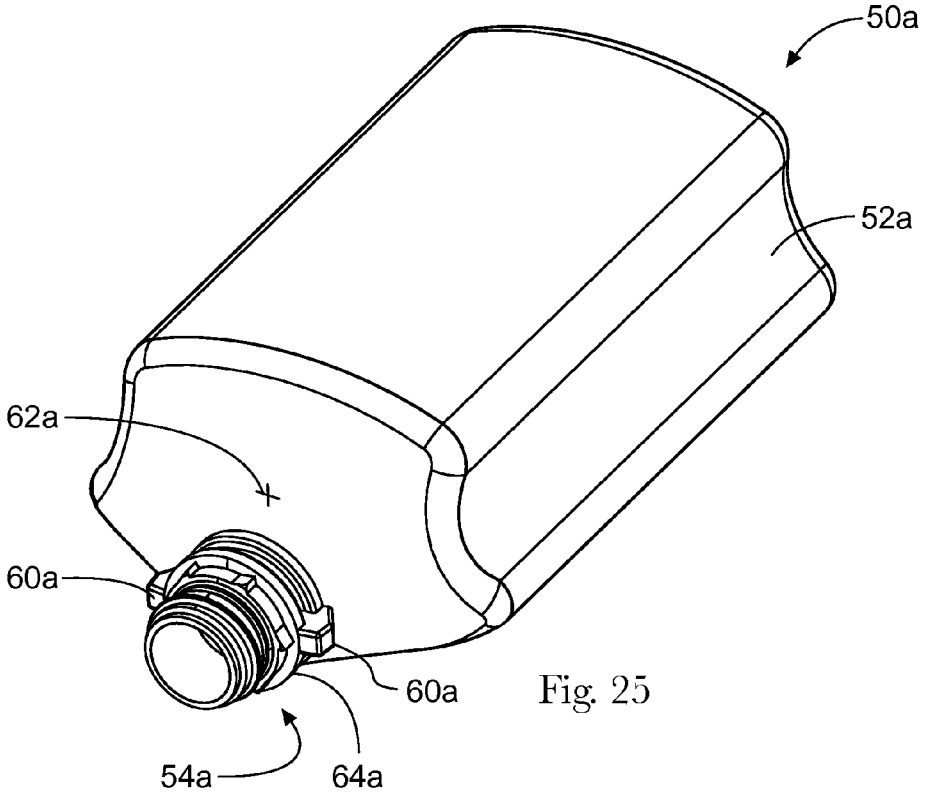
FIG. 25 is a perspective view of yet another container in accordance with one non-limiting embodiment of the present invention.

In various embodiments, other containers having different configurations can be used with the fluid dispensing system 14. In at least one embodiment, the containers can also include different camming surface configurations. In various embodiments, referring to FIGS. 21 and 22, a container 50' can include two camming surfaces 60' extending from at least one of the neck 54', the annular ring 64', the cap 58', and/or the body 52' of the container 50'. In such an embodiment, a center of a first camming surface can be positioned about ninety degrees or approximately 180 degrees from a center of a second camming surface, for example. In various embodiments, the first camming surface can contact an engagement member configured to activate the protective plate system to uncover the at least one tube covered by a protective plate, for example, and the second camming surface can engage an electro-mechanical switch to activate the fluid system, for example. In other various embodiments, referring to FIG. 23, only one camming surface 60" may be provided, but the one camming surface can engage both an engagement member and an electro-mechanical switch, for example. Similar to that described above with respect to camming surface 60', the camming surface 60" can extend from a neck 54", an annular ring 64", a cap 58", and/or a body 52" of a container 50", for example. In such an embodiment, the one camming surface can include different levels, configurations, sizes, and/or heights such that one portion of the camming surface can engage an engagement member a second portion of the camming surface can engage an electro-mechanical switch when the housing is in various positions within the track or slot, for example. In other various embodiments, referring to FIG. 24, three camming surfaces 60'| can be provided. In at least one embodiment, the camming surfaces 60'" can extend from a neck 54'", an annular ring 64'", a cap (not illustrated in FIG. 24), and/or a body 52"" of a container 50'", for example. In such embodiments, a first camming surface can be positioned about 90 degrees from a second and a third camming surface, for example. In at least one embodiment, the first camming surface, the second camming surface, and the third camming surface can be configured to engage an engagement member, an electro-mechanical switch, and/or other various actuators when the housing is in different positions along the track or slot. In such embodiments, the first camming surface can be positioned closer to the cap than the second camming surface, for example, such that the first camming surface can be engaged with a particular component of the fluid dispensing system prior to the second camming surface being engaged with another particular component, for example. Likewise, the third camming surface can also be positioned in front of or behind the other camming surfaces to allow the three or more camming surfaces to engage particular components of the fluid dispensing system in a predetermined and/or sequential order. In other various embodiments, the three or more camming surfaces can engage particular components of the fluid dispensing system simultaneously, for example. In further various embodiments, although not illustrated, other camming surfaces can be positioned in any suitable configuration around a neck, an annular ring, a cap, and/or a body of a container in order to engage particular components of the fluid dispensing system in any particular order. Those of skill in the art will recognize that the various camming surface, lug, projection, and/or cam configurations taught within this disclosure are merely exemplary embodiments. As described above, in at least one embodiment, the camming surfaces can include cams, projections, and/or lugs and can be comprised of any suitable shape, thickness, dimension, and/or configuration.

In various embodiments, the fluid dispensing system can be standard no matter what configuration of a container is used such that each container will work properly with the standard fluid dispensing system. In other various embodiments, the fluid dispensing system can be customized for a particular container type, and/or set of container types, such as by including additional camming surface engaging features, electro-mechanical switches, and/or particular components within an outer shell of the customized fluid detection system. Such fluid dispensing systems, whether standard or customized, can allow a user to control an appliance and/or an operating cycle of the appliance merely by inserting a different container into the housing. As an example, a container with a first configuration can cause the appliance to run a first cycle, while a container with a second configuration can cause the appliance to run a second cycle and so forth. In various embodiments, the fluid dispensing system may not function properly if an improper container is inserted into the housing. Such an improper container could be a competitor's product having a different configuration, for example.

Figure 26:
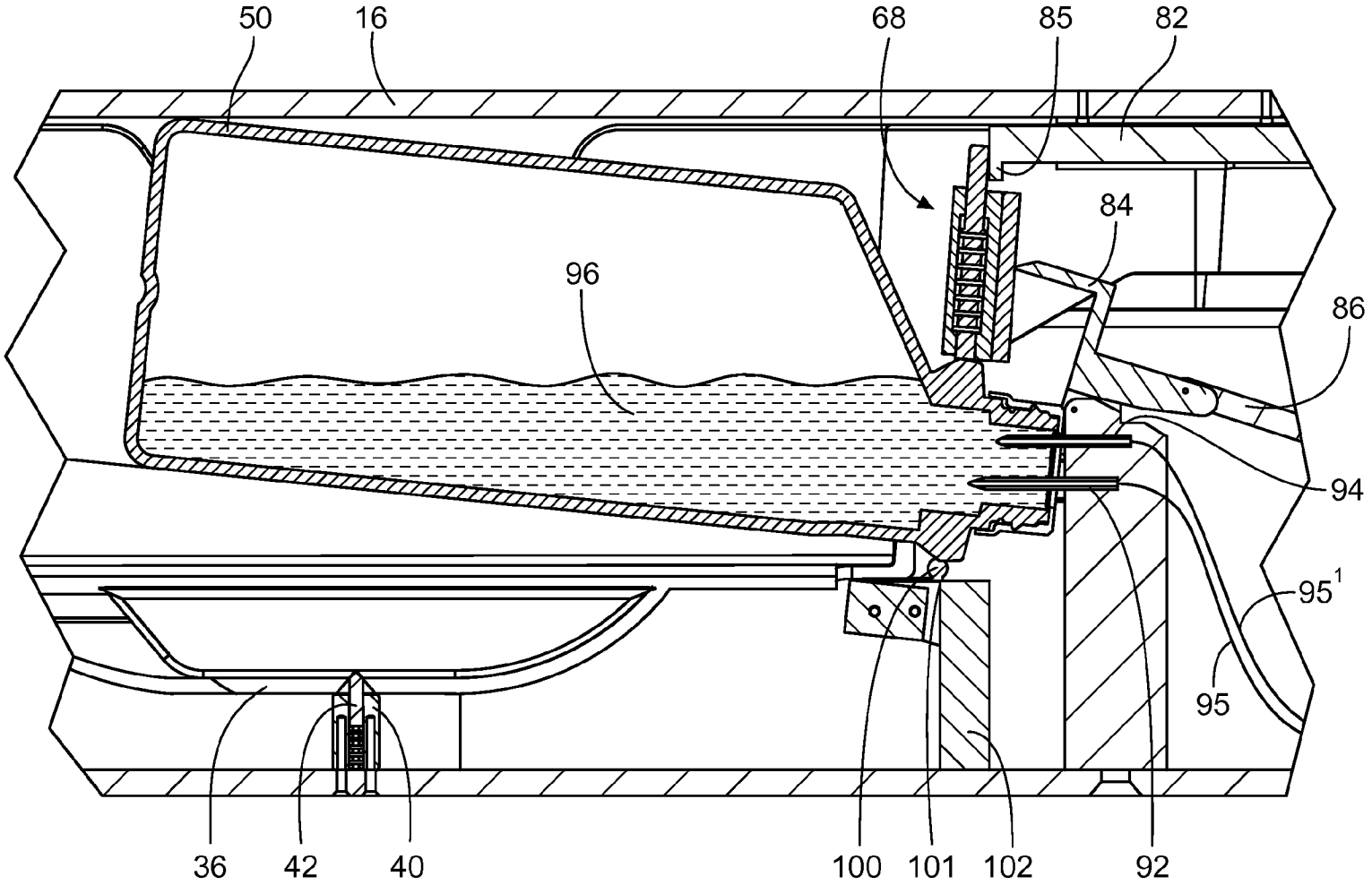
FIG. 26 is a cross-sectional view of a container positioned within the housing, when the housing is in a closed position, illustrating a fluid level above two tubes of the fluid dispensing system in accordance with one non-limiting embodiment of the present invention.
Figure 27:
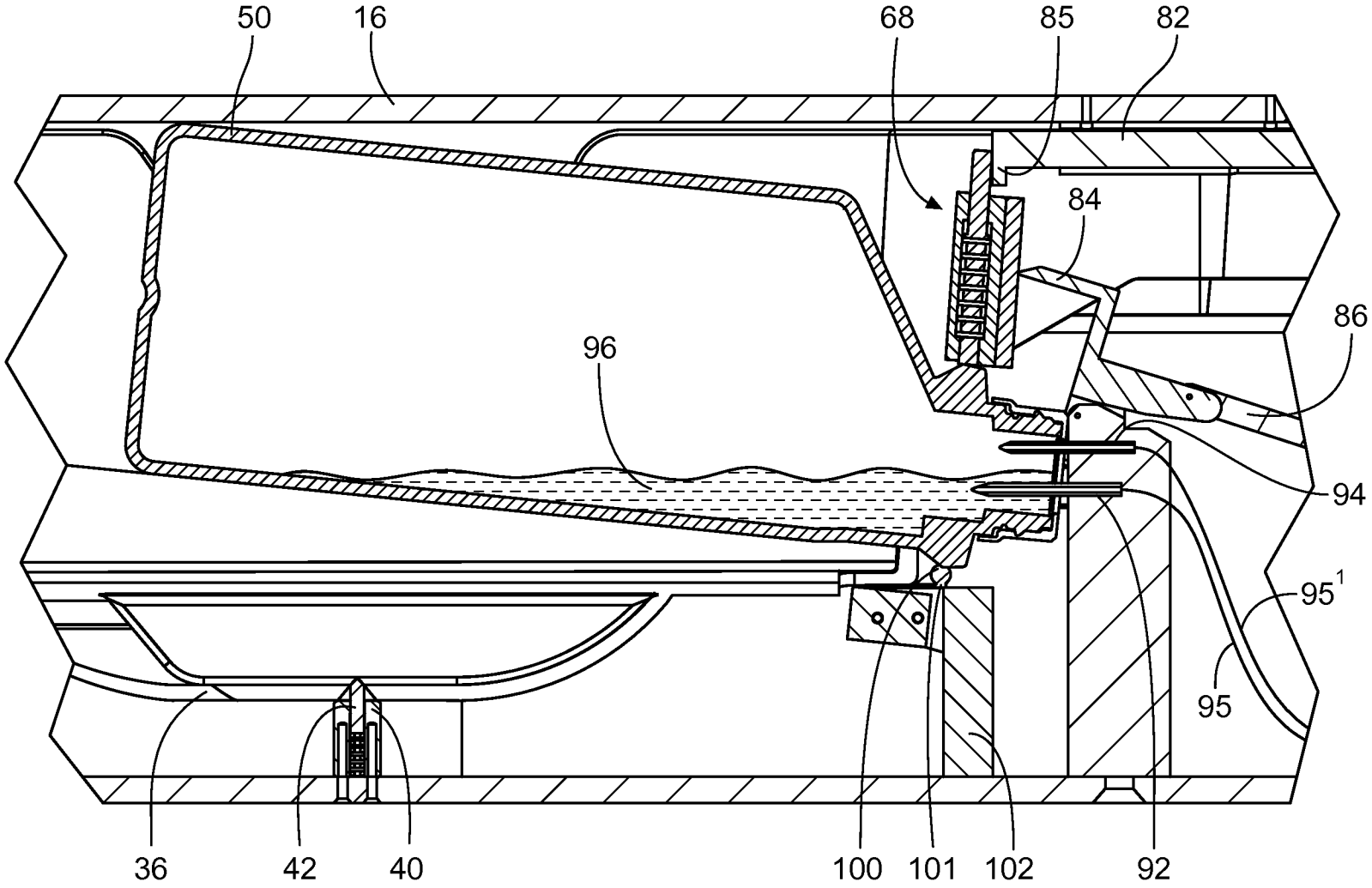
FIG. 27 is a cross-sectional view of a container positioned within the housing, when the housing is in a closed position, illustrating a fluid level intermediate two tubes of the fluid dispensing system in accordance with one non-limiting embodiment of the present invention.

In various embodiments, referring to FIGS. 26 and 27, the fluid 96 being drawn from a substantially horizontal container 50 within the housing is illustrated. In at least one embodiment, the fluid 96 can be extracted through the fluid extracting element 92 while the vent tube 94 flows a fluid and/or a gas into the container through the conduit 95', for example. In such an embodiment, the fluid 96 can be flowed toward a fluid system and/or a pump through the conduit 95. In various embodiments, referring to FIG. 27, almost all of the fluid 96 can be drawn out of the container 96 using the fluid extracting element 92 and vent tube 94 system owing to the substantially horizontal orientation of the container and offset neck.

Figure 28:
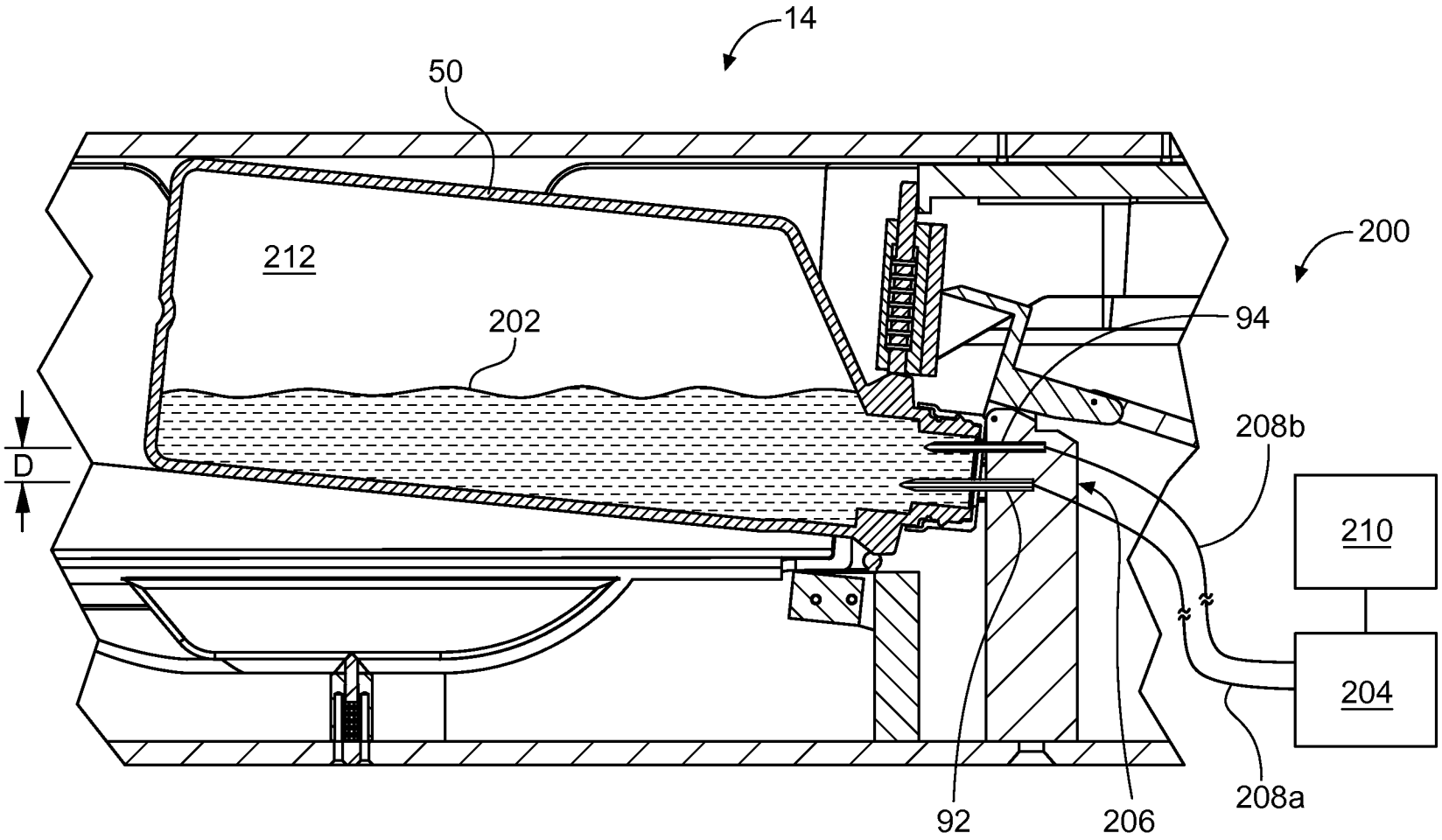
FIG. 28 illustrates one embodiment of a fluid detection system coupled to the fluid dispensing system of FIG. 4.

FIG. 28 illustrates one embodiment of a fluid detection system 200 coupled to the fluid dispensing system 14. In various embodiments, the fluid dispensing system 14 can further include the fluid detection system 200 configured to sense the level of a fluid 202 or a volumetric dose of the fluid 202 within the container 50. In at least one embodiment, the fluid detection system 200 can sense when at least one volumetric dose of the fluid 202 remains within a particular container, for example, such as the container 50. In such an embodiment, the fluid detection system 200 can comprise a circuit 204 configured to detect when the at least one volumetric dose of the fluid 202 remains in the container 50. In various embodiments, the circuit 204 can include a conductivity sensor 206 coupled to the circuit 204. In at least one embodiment, the conductivity sensor 206 comprises the fluid extracting element 92 and the vent tube 94. In such an embodiment, the fluid extracting element 92 and the vent tube 94 each may comprise an electrically conductive portion configured to sense the conductivity of the fluid 202 inside the container 50 when at least some of the fluid 202 is located intermediate the fluid extracting element 92 and the vent tube 94, for example. The fluid extracting element 92 and the vent tube 94 are electrically coupled to the circuit 204 via respective first and second electrically conductive wires 208*a*, 208*b*. In various embodiments, the fluid extracting element 92 and the vent tube 94 may be made from stainless steel or any other electrical conductor suitable for conducting electrical current through the fluid 202. The circuit 204 may generate a potential (e.g., voltage) across the fluid extracting element 92 and the vent tube 94 to generate the electrical current through the fluid 202. The potential may be direct current (DC) or alternating current (AC), without limitations.

In various embodiments, the fluid extracting element 92 and the vent tube 94 can be positioned in a spaced apart relationship, such as a horizontally spaced apart relationship, a vertically spaced apart relationship, or any other suitable spaced apart relationships. In a horizontally spaced apart relationship, the fluid extracting element 92 and the vent tube 94 are vertically oriented relative to the fluid level. To sense either conductivity or resistance in a horizontally spaced apart relationship, the fluid extracting element 92 and the vent tube 94 comprise conductive and non-conductive portions. In at least one embodiment, the fluid extracting element 92 and the vent tube 94 can be positioned in an angular relationship defined by an angle of about 0 degrees to about 180 degrees, for example. In the illustrated embodiment, the fluid extracting element 92 and the vent tube 94 are positioned in a vertical spaced apart relationship, separated by a distance D, and an angle of about 0 degrees.

The circuit 204 is configured to sense whether the fluid extracting element 92 and the vent tube 94 are either in a conducting state or in a non-conducting state. The fluid extracting element 92 and the vent tube 94 are in contact with the fluid 202 at the bottom of the container 50 through the septum opening. The circuit 204 senses whether the fluid extracting element 92 and the vent tube 94 are in an open circuit or a closed circuit state. In one embodiment, the circuit 204 may sense the conductivity of the fluid 202 between the fluid extracting element 92 and the vent tube 94. Generally, fluids such as detergents, fabric softeners, bleaches, and/or fragrances, have a substantially high conductivity due to the high water content. In another embodiment, the circuit 204 may measure the electrical resistance of the fluid 202 between the fluid extracting element 92 and the vent tube 94. Those skilled in art will appreciate that electrical conductivity is a measure of a material's (e.g., the fluid 202) ability to conduct an electric current. When an electrical potential difference (e.g., voltage difference) is placed across the fluid extracting element 92 and the vent tube 94 the movable charges in the fluid 202 flow, giving rise to an electric current, which is detected or sensed by the circuit 204. It will be appreciated that conductivity is the reciprocal (inverse) of electrical resistivity. As shown in FIG. 28, for example, the level of the fluid 202 is great enough such that the fluid 202 contacts both the fluid extracting element 92 and the vent tube 94. Accordingly, the circuit 204 senses this condition as a closed circuit state. Logic provided in the circuit 204 can interpret the closed circuit state as there being more than at least one dose of the fluid 202 remaining in the container 50.

Figure 29:
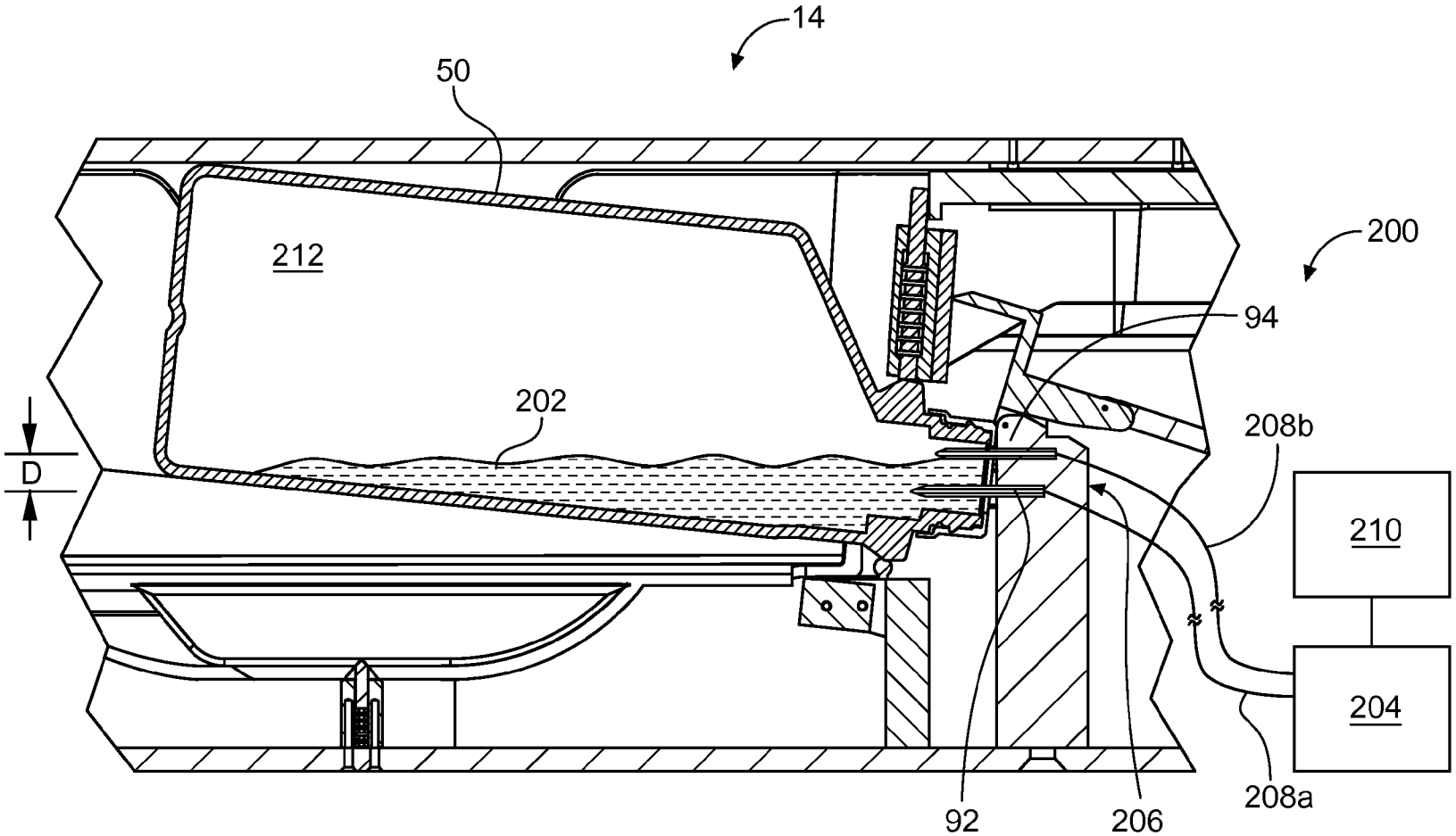
FIG. 29 illustrates one embodiment of a fluid detection system coupled to the fluid dispensing system of FIG. 4, wherein the level of the fluid is approximately at the threshold with the fluid in contact with the fluid extracting element and the vent tube.

As shown in FIG. 29, the level of the fluid 202 is approximately at the threshold with the fluid 202 in contact the fluid extracting element 92 and the vent tube 94. As long as the fluid 202 contacts both the fluid extracting element 92 and the vent tube 94, the circuit 204 will sense this as a closed circuit state because there is conductivity between the fluid extracting element 92 and the vent tube 94. In one embodiment, the distance D between the fluid extracting element 92 and the vent tube 94 and the relative distance to the bottom of the container 50 can be defined such that the amount of the fluid 202 occupying this volume is approximately equal to at least one volumetric dose of the fluid 202. In the illustrated embodiment, the volume of the fluid 202 occupying the space between the fluid extracting element 92 and the vent tube 94 can be calibrated to about 100 millimeters. It will be appreciated that this volumetric dose may be predetermined and selected based on specific implementations of the fluid sensing system and should not be limited in this context. For example, it may be desirable that between approximately one or two volumetric doses remain in the container 50 when the fluid detection system 202 detects that at least one volumetric dose remains in the container 50. The cross-sectional area of the container 50 between the fluid extracting element 92 and the vent tube 94 relative to the cross-sectional area of the container 50 may be configured such that at least one full volumetric dose is in the container 50 when the last dose is detected by the circuit 204. For example, the cross-sectional area between the fluid extracting element 92 and the vent tube 94 relative to the cross-sectional area of the container 50 may be selected such that the total volume of fluid 202 remaining in the container 50 when the circuit 204 detects at least one volumetric dose may be 60% more than one dose. This may be necessary to compensate for the uncertainty of predicting the actual amount of fluid 202 remaining in the container 50 relative to the upper fluid extracting element 92 when the last dose is detected by the circuit 204. In various embodiments, the actual amount of fluid 202 remaining in the container 50 when the at least one volumetric dose is detected by the circuit can be approximately 75% up to approximately 150%. This provides the consumer with an adequate dose of fluid 202 on the actual last dose extracted by the fluid extracting system 14. The fluid extracting system 14 may be configured to extract two doses after the last volumetric dose is detected to ensure that the container 50 is substantially empty. It will be appreciated that other configurations may be employed and, therefore, the embodiments are not limited in this context.

Figure 30:
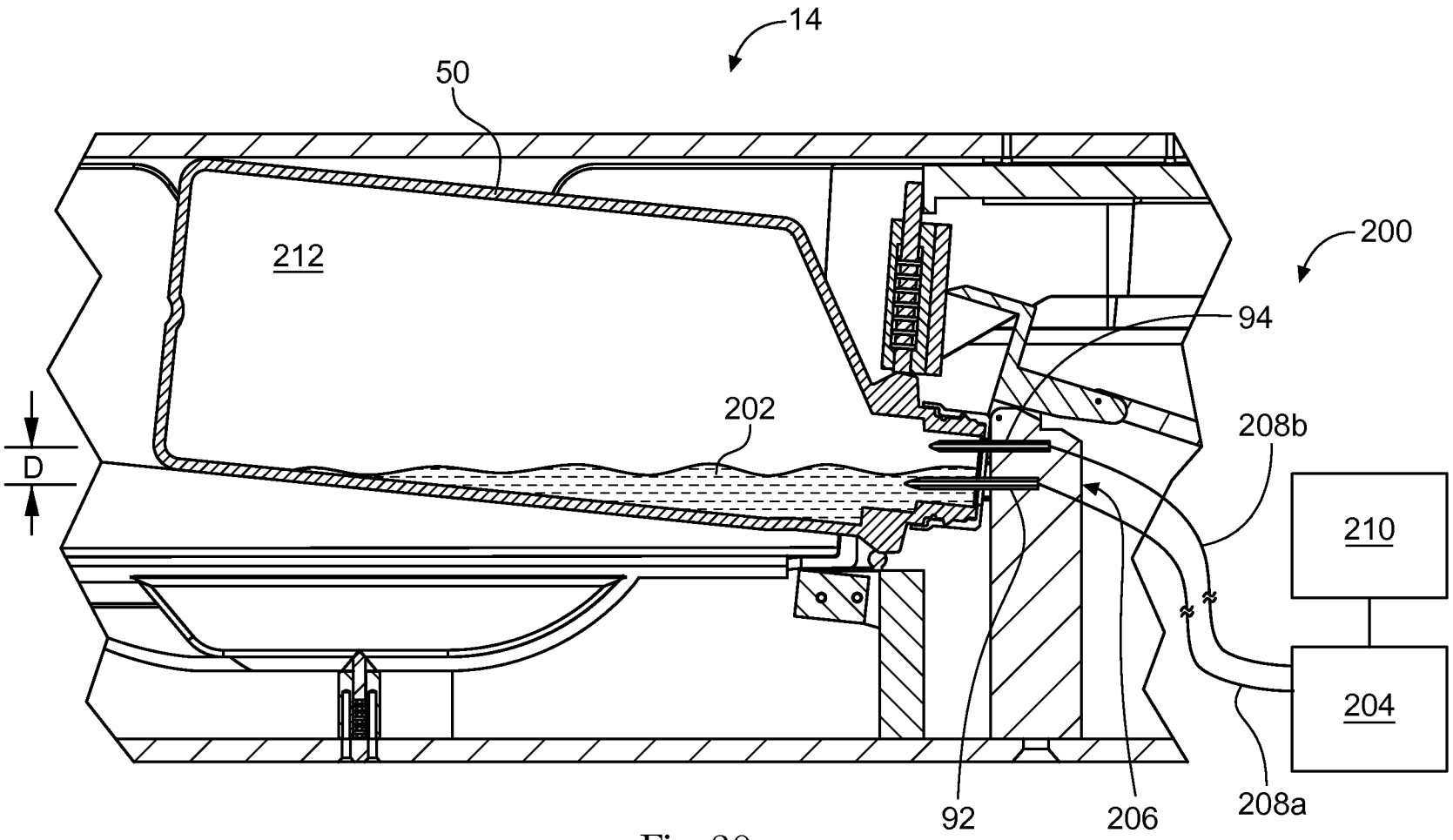
FIG. 30 illustrates one embodiment of a fluid detection system coupled to the fluid dispensing system of FIG. 4, wherein the level of the fluid is just below the vent tube and just above the fluid extracting element such that the fluid is not in contact with the vent tube and is in contact with the fluid extracting element.

In FIG. 30, the fluid 202 level is shown just below the vent tube 94 such that the fluid 202 is not in contact with the vent tube 94 and is in contact with the fluid extracting element 92. The circuit 204 senses this condition as an open circuit state because there is substantially no conductivity between the fluid extracting element 92 and the vent tube 94. An open circuit state provides an indication that the container 50 is nearly empty. Accordingly, when the fluid 202 level drops below the vent tube 94 the conductivity change is sensed by the circuit 204 and provides an indication to the user by way of a user interface 210 that the container 50 and the fluid dispensing system 14 is low on fluid 202 and will require replacement after one more use. In other embodiments, the shape or geometric configuration of the container 50 may be configured such that the container 50 may contain approximately one or two doses of the fluid 202 when the conductivity between the fluid extracting element 92 and the vent tube 94 is interrupted.

It will be appreciated that the circuit 204 may be configured as a general purpose or particular circuit to sense the volume of the fluid 202 within the container 50 using various technologies. In one embodiment, the circuit is configured to sense the conductivity between the fluid extracting element 92 and the vent tube 94 through the fluid 202. For conciseness and brevity, the specific details of the various implementations of the circuit 204 are not described. Those skilled in art will appreciate that the circuit 204 may be implemented in a variety of forms and is described in general terms only. Similarly, for conciseness and brevity, the specifics of the various implementations of the user interface 210 are not described. Those skilled in art will appreciate that the user interface 210 may be implemented in a variety of forms and is described in general terms only.

Figure 31:
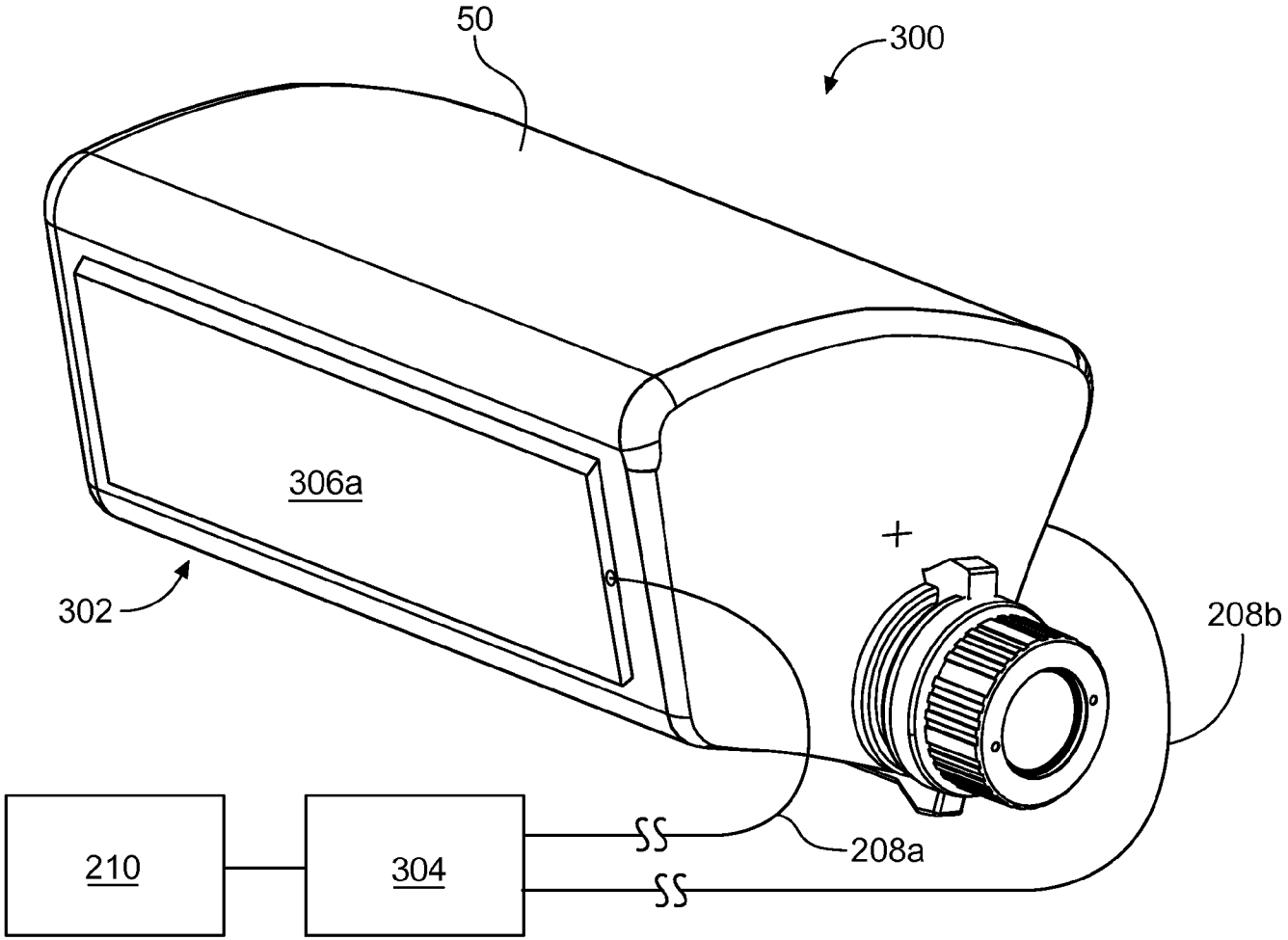
FIG. 31 is a perspective view of one embodiment of a fluid detection system configured to couple to the fluid dispensing system of FIG. 4.

FIG. 31 is a perspective view of one embodiment of a fluid detection system 300 configured to couple to the fluid dispensing system 14. In the embodiment illustrated in FIG. 31, the fluid detection system 300 comprises a capacitive sensor 302 coupled to a circuit 304 configured to sense the capacitance as a function of the fluid 202 volume in the container 50. The fluid detection system 300 may be configured to sense the presence or absence of the fluid 202 or the quantity of the fluid 202 in the container 50 by measuring the difference between the dielectric properties of air 212 (FIG. 33) (or other extraction fluid) and the fluid 202 in the container 50. A change in the fluid 202 volume causes a change in the total dielectric of the capacitive sensor 302 that can be measured by the circuit 304. In one embodiment, the circuit 304 comprises a microcontroller, an analog-to-digital (A/D) converter, and a reference capacitor. The capacitance fluid detection system 300 may be particularly implemented to accommodate variations in the position of the container 50, the thickness of the walls of the container 50, the materials that the container 50 is made of (e.g., plastic, glass), and the type of fluid, that alter the dielectric measurements.

Figure 32:
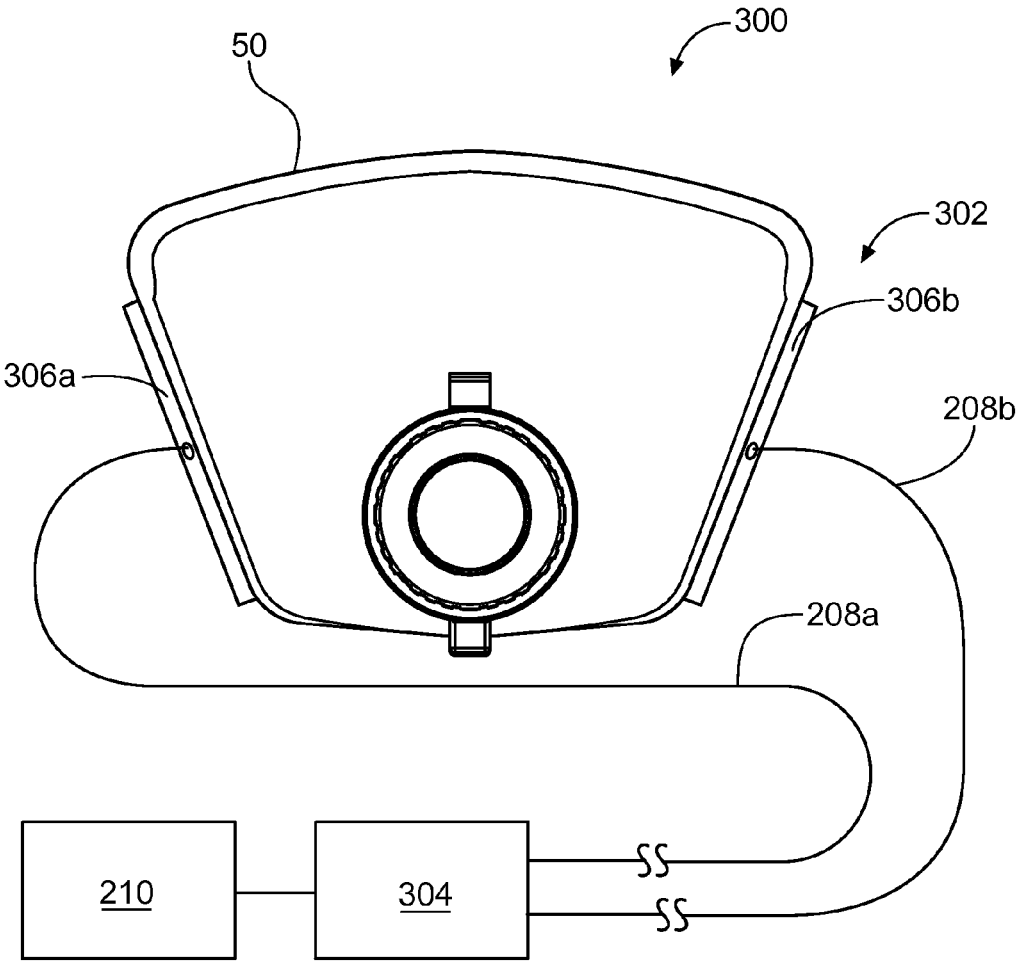
FIG. 32 is a front view of the embodiment of the fluid detection system of FIG. 31.

FIG. 32 is a front view of the embodiment of the fluid detection system 300 of FIG. 31. With reference to FIGS. 31-32, in one embodiment the capacitive sensor 302*a* is configured as a parallel plate capacitor separated by a dielectric comprised of the fluid 202 and, as the fluid is withdrawn from the container, a combination of the fluid 202 and air 212 or other pressurizing medium used to extract the fluid 202 from the container 50. A first electrode 306*a* and second electrode 306*b* form the first and second conductive plates of the capacitive sensor 302. The first and second electrodes 306*a,b* define an opening to receive the body portion of the container 50 therebetween. The first and second electrodes 306*a,b* are coupled to the circuit 304 via the respective first and second electrically conductive wires 208*a,b*. The circuit 304 is configured to sense capacitance changes between the first and second electrodes 306*a,b* as a function of the amount of the fluid 202 inside the container 50. The circuit 304 may be configured to provide an indication to the user by way of the user interface 210. In one embodiment, the indication may provide information regarding the amount of fluid 202 located in the container. In one embodiment, the indication alerts the user that the container 50 contains at least one more dose of fluid 202, and therefore, that the fluid dispensing system 14 is low on fluid 202 and will require replacement after one more use.

In the embodiment illustrated in FIGS. 31 and 32, the first and second electrodes 306*a,b*, have a rectangular configuration and are made of an electrically conductive material such as, for example, stainless steel, aluminum, copper, brass, steel, or combinations or alloys thereof. Each one of the conductive rectangular first and second electrodes 306*a,b* is about 5 centimeters wide to about 18 centimeters long. More preferably, each one of the conductive rectangular first and second electrodes 306*a,b* is about 6.5 cm wide by about 16.5 cm long. The distance between the first and second electrodes 306*a,b* is about 8.5 centimeters, however, the distance between the first and second electrodes 306*a,b* may be suitably selected to accommodate a particular container size. It will be appreciated by those skilled in the art that the dimensions of the first and second electrodes 306*a,b* and the distance between them may be determined based on the overall size of the container 50. Therefore, these dimensions are provided for illustrative purposes only and the embodiments are not limited in this context.

Figure 33:
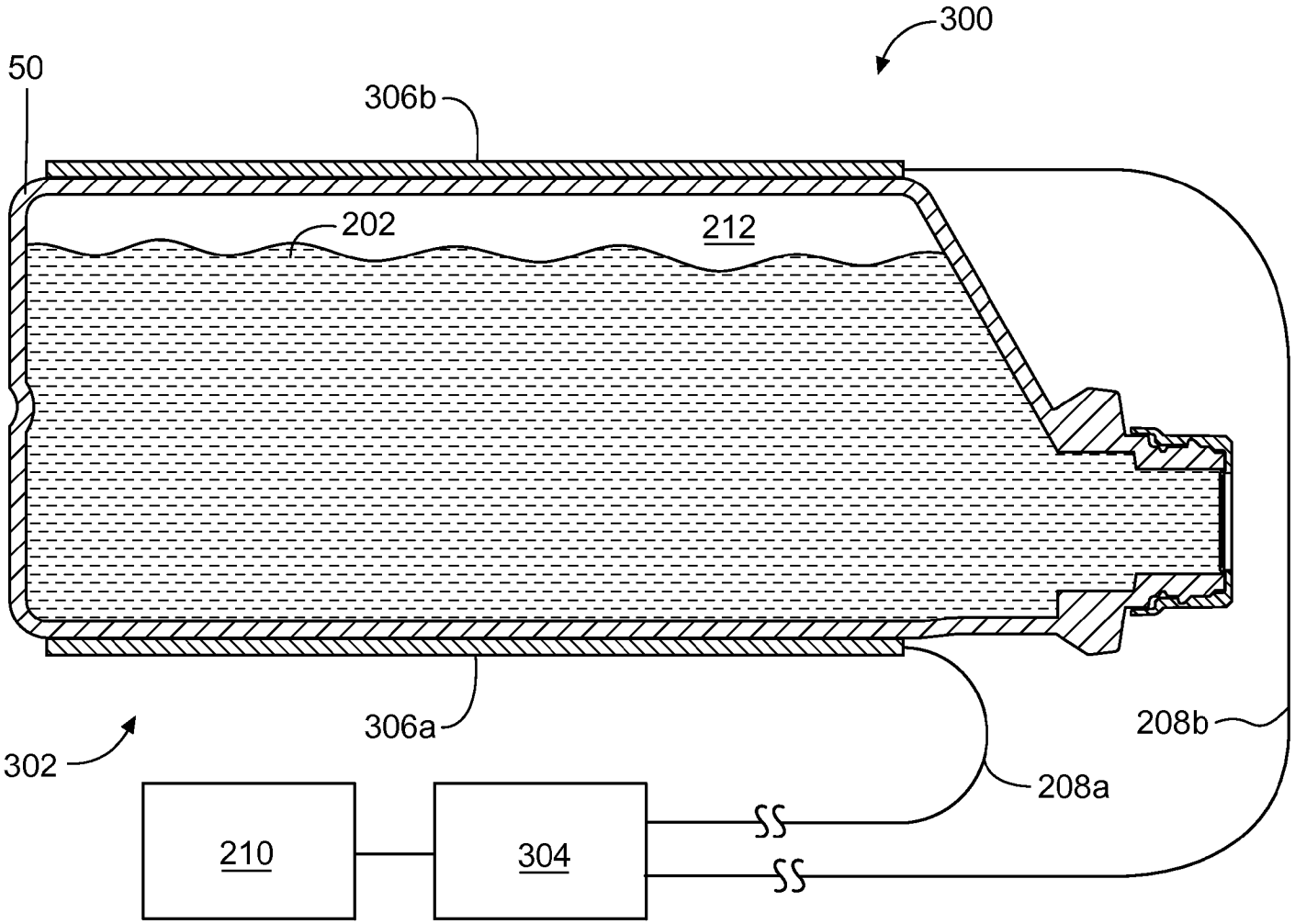
FIG. 33 is a cross-sectional view of one embodiment of the capacitive fluid detection system.

FIG. 33 is a cross-sectional view of one embodiment of the capacitive fluid detection system 300. In the embodiment illustrated in FIG. 33, the first and second electrodes 306*a,b* are located on the top and the bottom of the bottle 50, rather than the sides of the bottle 50 as shown in FIGS. 31 and 32. The operation of the capacitive fluid detection system 300 remains the same as that described with reference to FIGS. 31-32.

Figure 34:
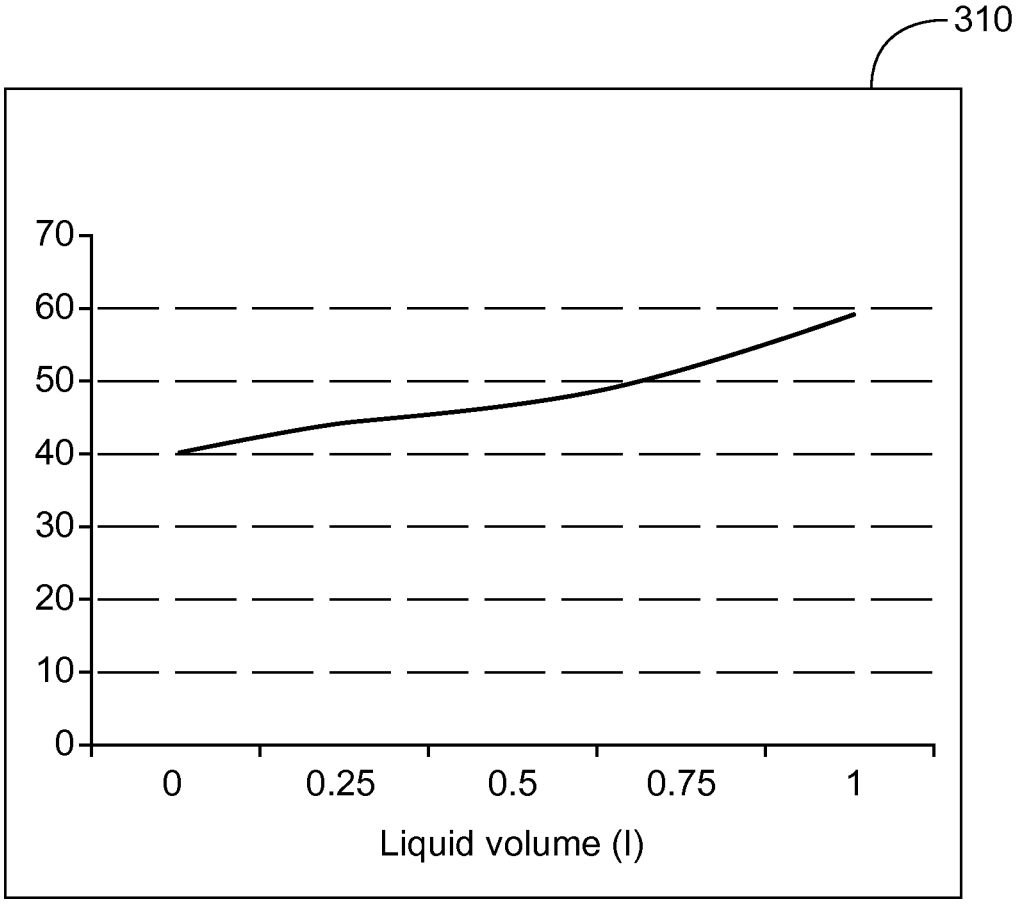
FIG. 34 is a graph depicting capacitance as a function of fluid volume for the capacitive fluid detection system of FIG. 31.

FIG. 34 is a graph 310 depicting capacitance as a function of fluid 202 volume for the capacitive fluid detection system 300 of FIG. 31. Liquid volume in liters (l) is shown along the horizontal axis and capacitance in picofarads (pF) is shown along the vertical axis. As previously discussed, the circuit 304 determines variations in the capacitance between the first and second electrodes 306*a,b* as the fluid 202 in the container is extracted and the volume previously occupied by the fluid 202 is replaced with air 212 or other extraction fluid. When the container 50 is located between the first and second electrodes 306*a,b* the capacitance can be correlated to volume of fluid 202 in the container 50. Thus, the capacitance measured by the circuit 304 is a function of the fluid 202 volume in the container 50. The data illustrated in the graph 310 was obtained by filling the container 50 with a solution consisting of 1 liter of water containing 50 milliliters of DOWNY® fabric softener. As the container 50 was filled with the solution, the capacitance was measured using the circuit 304. As shown in the graph 310, the capacitance increases proportionally with increases in the fluid 202 in the container 50. More particularly, as graphically illustrated by the graph 310, the circuit 304 measured a change in capacitance of about 20 picofarads (40 to 60 picofarads) as the volume of fluid 202 in the container was filled from 0 to 1 liter with the solution.

Figure 35:
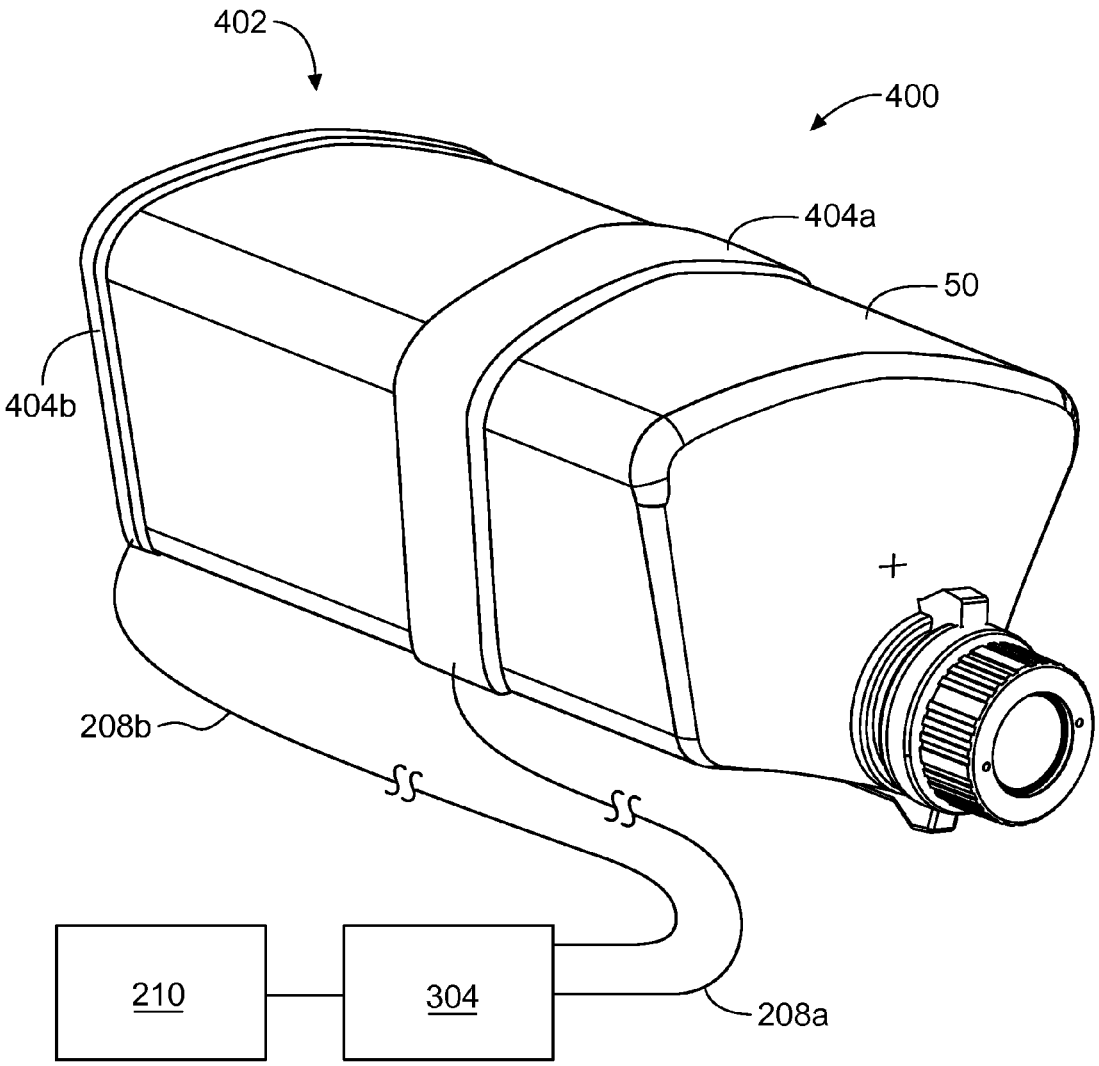
FIG. 35 is a perspective view of one embodiment of a fluid detection system configured to couple to the fluid dispensing system of FIG. 4.

FIG. 35 is a perspective view of one embodiment of a fluid detection system 400 configured to couple to the fluid dispensing system 14. In the embodiment illustrated in FIG. 35, the fluid detection system 400 comprises a capacitive sensor 402 coupled to a circuit 304 configured to sense the capacitance as a function of the volume of fluid 202 in the container 50. The fluid detection system 400 may be configured to sense the presence or absence of the fluid 202 or the quantity of the fluid 202 in the container 50 by measuring the difference between the dielectric properties of air 212 (FIG. 37) (or other extraction fluid) and the fluid 202 in the container 50. A change in the fluid 202 volume causes a change in the total dielectric of the capacitive sensor 402 that can be determined by measuring the capacitance using the circuit 304.

Figure 36:
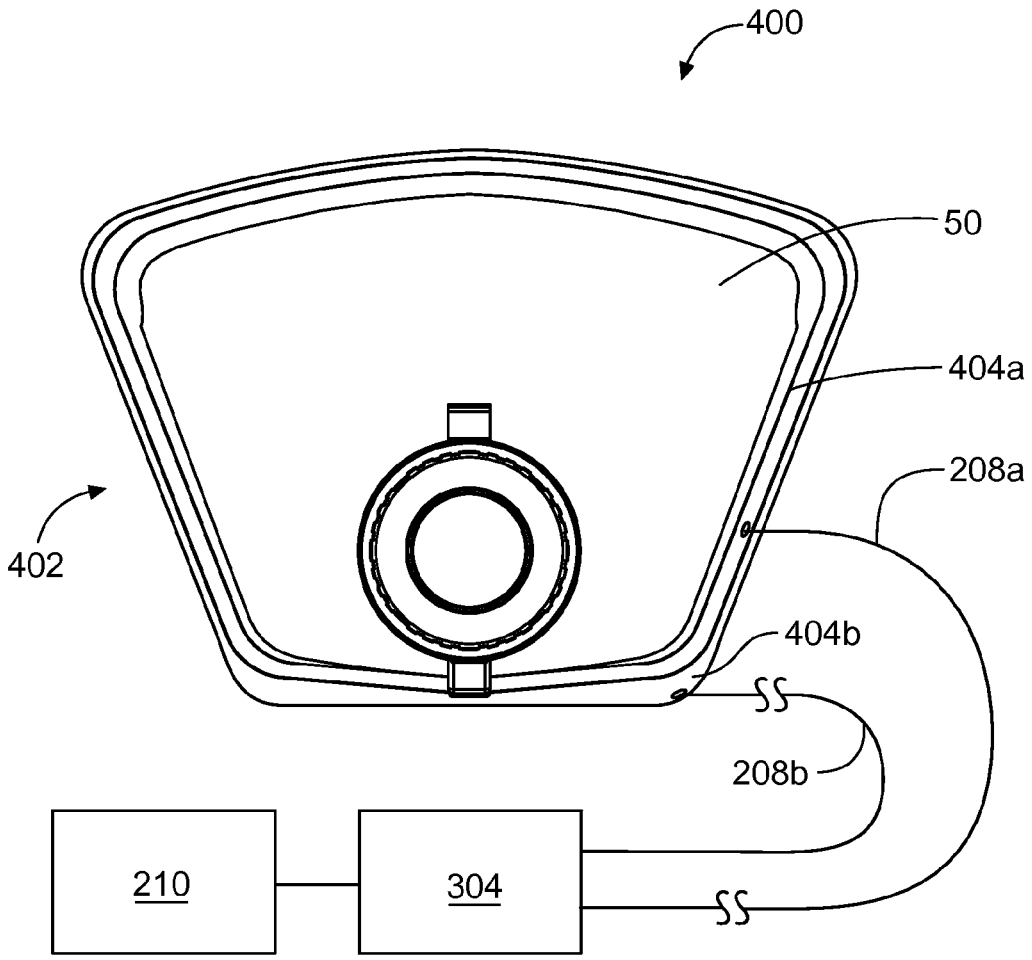
FIG. 36 is a front view of the embodiment of the fluid detection system of FIG. 35.
Figure 37:
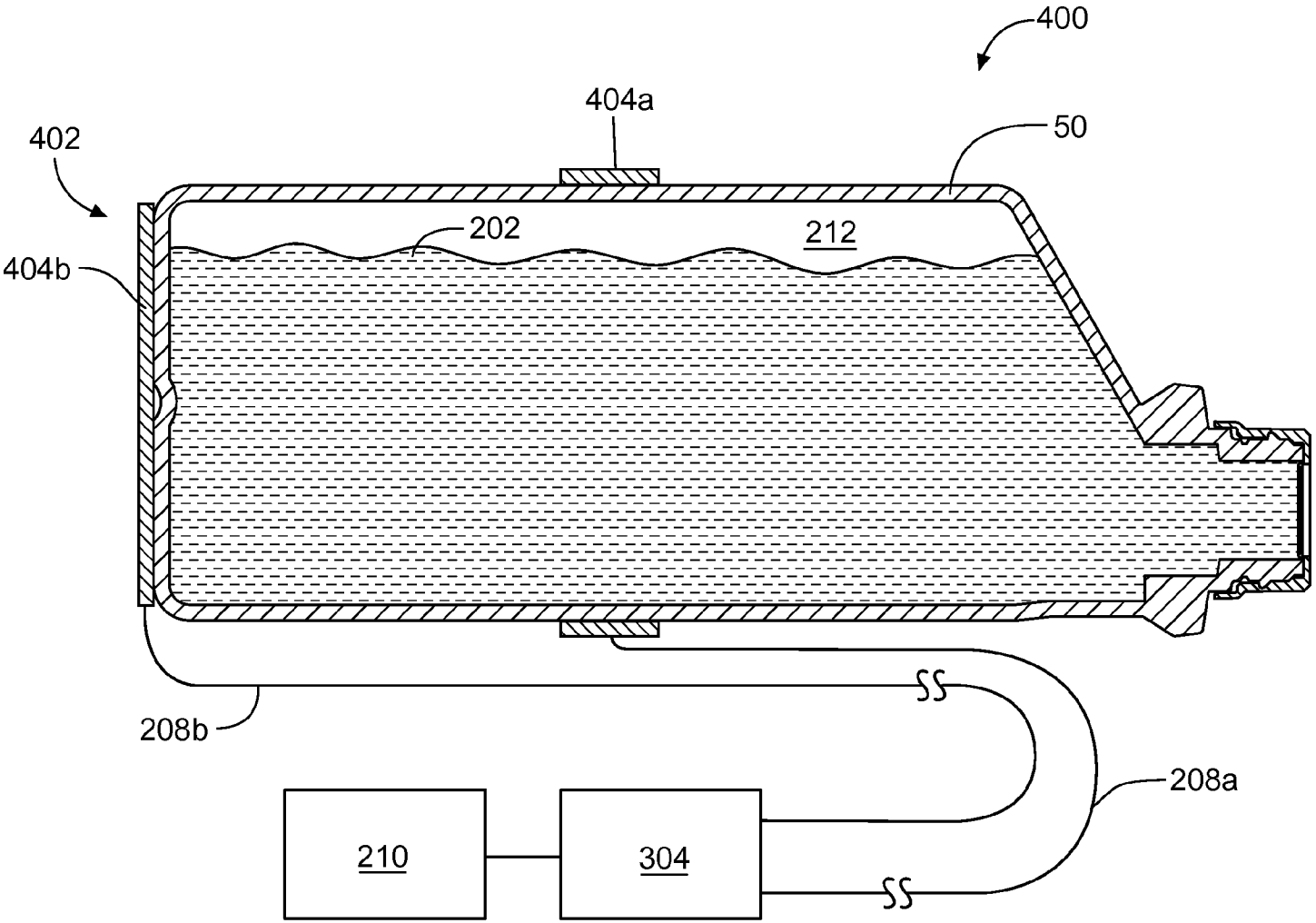
FIG. 37 is a cross-sectional view of the container and one embodiment of the fluid detection system.

FIG. 36 is a front view of the embodiment of the fluid detection system 400 of FIG. 35. FIG. 37 is a cross-sectional view of the container 50 and one embodiment of the fluid detection system 400. With reference to FIGS. 35-37, in one embodiment the capacitive sensor 402 comprises a first electrode 404*a*, and a second electrode 404*b*. The first electrode 402*a* is configured as an electrically conductive ring electrode defining an opening to receive a body portion of the container 50 therethrough. In one embodiment, the ring electrode may have a width of about 3 centimeters. In other embodiments, the width may be selected based on the physical dimensions of the container 50 and the type of fluid 202 to be detected. The second electrode 402*b* is configured as an electrically conductive plate electrode to receive a bottom portion of the container 50. The first and second electrodes 402*a,b* are made of an electrically conductive material such as, for example, stainless steel, aluminum, copper, brass, steel, or combinations or alloys thereof. The first and second electrodes 404*a,b* define an opening to receive the body portion of the container 50 therebetween. The first and second electrodes 404*a,b* are coupled to the circuit 304 via the respective first and second electrically conductive wires 208*a,b*. The circuit 304 is configured to sense capacitance changes between the first and second electrodes 404*a,b* as a function of the amount of fluid 202 inside the container 50, or the amount of fluid 202 in combination with the air 212 or other extraction fluid. In the illustrated embodiment, the circuit 304 is configured to sense capacitance changes between the electrically conductive ring electrode 404*a* and the electrically conductive plate electrode 404*b* based on the volume of the fluid 202 inside the container 50 in combination with air 212. The circuit 304 may be configured to provide an indication to the user by way of the user interface 210. In one embodiment, the indication may provide information regarding the amount of fluid 202 located in the container. In one embodiment, the indication alerts the user that the container 50 contains at least one more dose of fluid 202, and therefore, that the fluid dispensing system 14 is low on fluid 202 and will require replacement after one more use.

Figure 38:
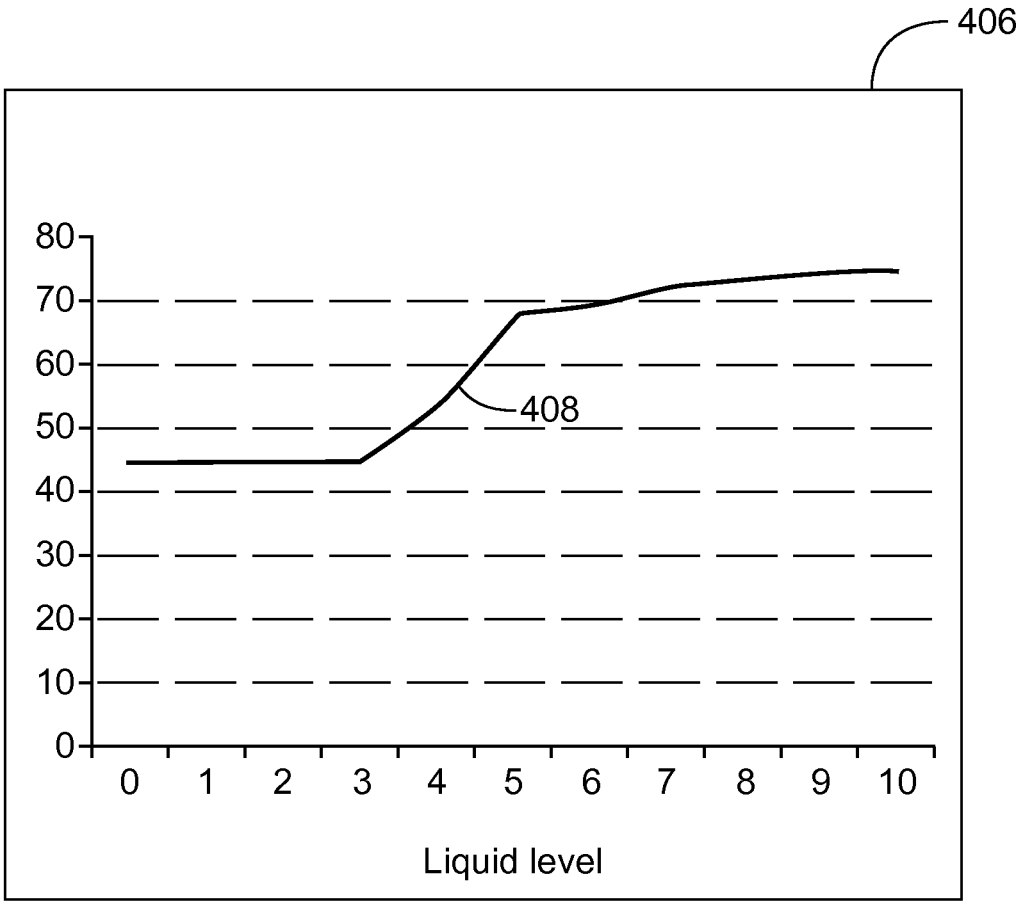
FIG. 38 is a graph depicting capacitance as a function of fluid level for the capacitive fluid detection system of FIG. 35.

FIG. 38 is a graph 310 depicting capacitance as a function of fluid 202 level for the capacitive fluid detection system 400 of FIG. 35, wherein the fluid container is positioned in a vertical orientation with the neck and closure mechanism is positioned above the container body when in use. Liquid Level Index (on the X axis and shown as Liquid Level) of from 0 to 10, of a container having a volume of 1 liter (l) is shown along the horizontal axis and capacitance in picofarads (pF) is shown along the vertical axis. As previously discussed, the circuit 304 determines the capacitance between the first and second electrodes 402*a,b*. When the container 50 is located through the first electrode 402*a* and the bottom of the container 50 is placed in contact with the second electrode 402*b* the capacitance can be correlated to the fluid 202 level in the container 50. Thus, the measured capacitance is a function of the fluid 202 level. As the container 50 is filled with the fluid 202 the capacitance increases proportionally with the fluid 202 level. More particularly, as graphically illustrated in the graph 406, the capacitance changes by about 30 picofarads (about 45 to about 75 picofarads) as the container 50 is filled with the fluid 202 from 0 to 10, where 0 correlates to an empty container and 10 correlates to a full container having 1 liter of composition contained therein. As shown in the graph 406, this topology provides a sharper indication or abrupt increment 408 when the liquid level passes through the conductive portion of the first electrode 402*a*. As shown in FIG. 38, the capacitance variation is substantially linear with respect to the fluid 202 level. The abrupt increment 408 occurs when the fluid 202 passes through the metal ring configuration of the first electrode 402*a*. The abrupt increment 408 becomes sharper as the width of the metal ring is reduced due to the vertical orientation of the fluid container. However, as the width of the metal ring is reduced, the capacitance variation is reduced because the metal area is reduced.

Those of skill in the art will understand that the container can also be used in a horizontal orientation wherein the metal ring is constantly in contact with any fluid present within the container. Without intending to be bound by theory, it is believed that increases in fluid level will result in a incremental increase in capacitance.

The capacitance based fluid detection systems 300, 400 may be calibrated in accordance to the dielectric constant of the fluid 202 or the air 212, or any other extraction fluid, or any combination thereof. In addition, the capacitance based fluid detection systems 300, 400 may be calibrated in accordance with the geometric configuration of the container 50, the dimensions of the electrodes 306*a*, 306*b*, 402*a*, 402*b*, the distance between the electrodes 306*a*-306*b*, 402*a*-402*b*, the materials surrounding the container 50, or any combination thereof. It will be appreciated that expected capacitance measurement values will be in the tens or hundreds of picofarads. Accordingly, those skilled in the art will appreciate the desire to reduce substantially all external parasitic capacitances and employ good shielding methods to reduce the influence from external electric fields. Nevertheless, the embodiments are not limited in this context.

Figure 39:
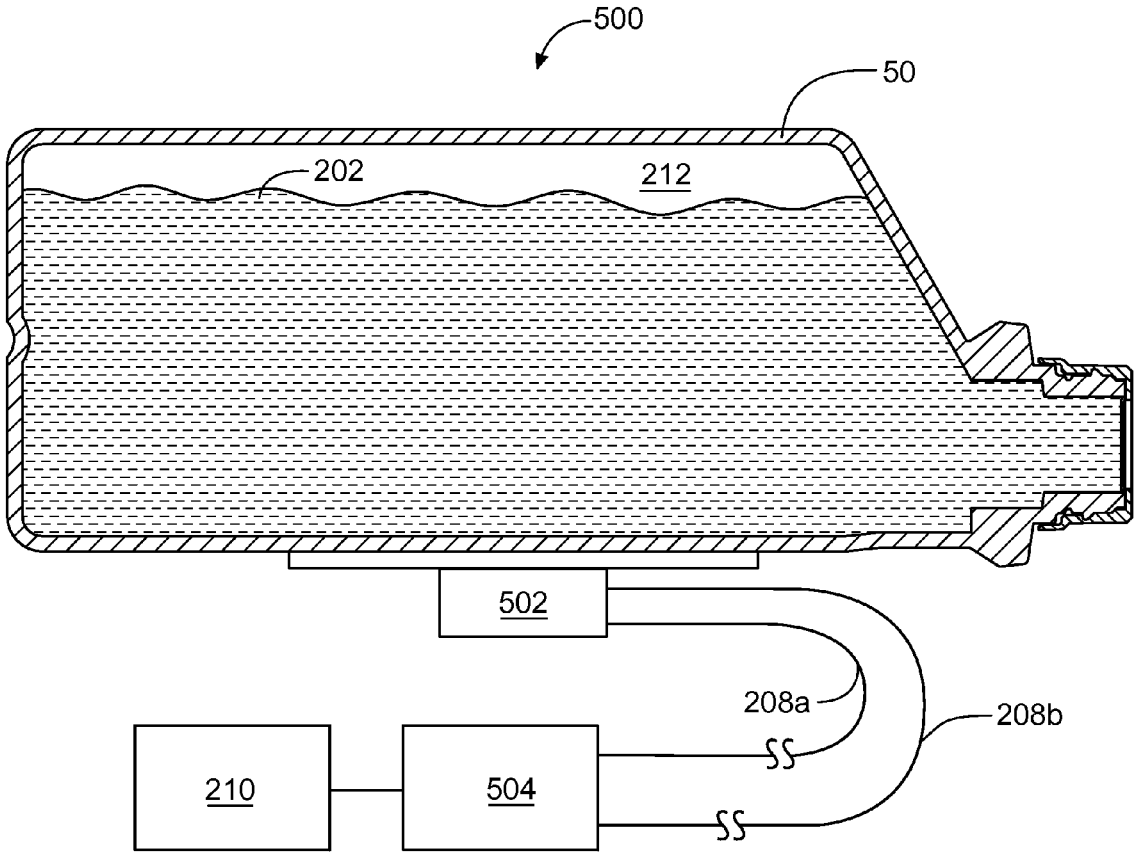
FIG. 39 is a cross-sectional view of the container and one embodiment of a fluid detection system configured to couple to the fluid dispensing system of FIG. 4.

FIG. 39 is a cross-sectional view of the container 50 and one embodiment of a fluid detection system 500 configured to couple to the fluid dispensing system 14. In the embodiment illustrated in FIG. 39, the fluid detection system 500 comprises a load cell 502 coupled to a circuit 504 via the first and second electrically conductive wires 208*a,b*. In one embodiment, the fluid detection system 500 determines the weight of the container 50 and infers the amount or volume of fluid 202 present in the container 50 as a function of the measured weight. In one embodiment, the load cell 502 is configured to convert forces acting on its surface to electrical signals that can be processed by the circuit 502. As described in more detail below, in one embodiment the load cell 502 comprises an internal resistor bridge that changes electrical resistance as a function of weight, e.g., the amount of fluid 202 in the container 50. The circuit 504 is configured to sense the resistance changes in the internal resistance bridge as a function of the amount of the fluid 202 inside the container. The circuit 204 provides an indication to the user by way of the user interface 210. In one embodiment, the indication may provide information regarding the amount of fluid 202 located in the container. In one embodiment, the indication alerts the user that the container 50 contains at least one more dose of fluid 202, and therefore, that the fluid dispensing system 14 is low on fluid 202 and will require replacement after one more use.

The load cell 502 may have a variety of configurations. Generally, the load cell 502 is an electronic device (transducer) for converting forces into electrical signals. Through a mechanical arrangement, the force being sensed deforms a strain gauge. The strain gauge converts the deformation (strain) to electrical signals, which can be processed by the circuit 504. In one embodiment, the internal resistor bridge of the load cell 502 comprises four strain gauges arranged in a Wheatstone bridge configuration. In other configurations, the load cell 502 may comprise one or more strain gauges suitably arranged to convert forces into electrical signals. The electrical output signal of the load cell 502 is typically in the order of a few millivolts and needs to be amplified by way of an instrumentation amplifier. The amplified output may be processed by an A/D converter before it is provided to a microcontroller. The microcontroller processes the converted output of the load cell 502 by an algorithm to calculate the force applied to the load cell 502.

In one embodiment, therefore, the circuit 504 may comprise an instrumentation amplifier, an A/D converter, and a microcontroller configured for reading and processing signals output by the load cell 502. The input power to the internal resistive bridge may be supplied by a conventional direct current (DC) voltage source, which also may be a component of the circuit 504. The output of the resistive bridge is coupled to an instrumentation amplifier to amplify the signal. The voltage may be amplified to match the input range of the A/D converter in the microcontroller, for example. In one embodiment, the output voltage of the load cell 502 may be up to a maximum output span of 20 mV/V. In other words, if a 10 VDC supply voltage is applied at the input of the resistive bridge, the maximum span will be 200 mV under full load conditions. Thus, a 100 lbs load cell produces a maximum output voltage of about 200 mV when the load cell 502 detects a force proportional to 100 lbs. A 10 lbs load cell produces the maximum of 200 mV when the load cell 502 detects a force proportional to 10 lbs. The conversion factor is 227 g/mV using the 10V excitation voltage.

The output voltage response of the load cell 502 with respect to input weight is substantially linear. Thus, those skilled in the art will appreciate that the as the weight of the container 50 varies according to amount of the fluid 202 contained therein, the load cell 502 produces a substantially linear output voltage that is proportional to the weight of the container 50. As previously discussed, the circuit 504 may be configured to supply the power to the resistive bridge, amplify the output voltage, convert the output voltage using an A/D converter, and process the A/D converter output with a microcontroller to determine the fluid 202 volume or level and provide an indication to the user interface 210, as previously discussed.

In one embodiment, the load cell 502 may be a mini-beam load cell, such as a 3.75 kg mini-beam load cell made by Flintec. The mini-beam load cell may be employed, for example, in low level weight measurement applications. The mini-beam cell comprises an internal resistor bridge and interfaces with the circuit 504 as previously discussed. An instrumentation amplifier may be coupled to the output of the resistor bridge to amplify the signal to match the input range of the A/D converter in the microcontroller. The mini-beam load cell provides about 0.6 mv/V at full range of about 3.75 kg. Accordingly, using a 10 VDC excitation voltage equates to about 625 g/mV conversion factor. The output of the min-beam load cell is substantially linear.

The load cell 502 may be mounted below a false bottom plate to thermally isolate the load cell 502 from heat sources, for example. The fluid container 50 and an enclosure therefore may be configured such that the weight of the container 50 at one end contacts the load cell 502 in a repeatable manner. Variation in container weight and/or fluid density and the position of the container 50 relative to the load cell 502 platform are variables that should be taken into consideration for optimal operation of the fluid detection system 500.

Various embodiments of the load cell 502 may be employed in the fluid detection system 500 for weighing the container 50. Suitable load cells provide linear, monotonic, and repeatable results. Suitable load cells may include planar beam single point, shear and bending beam, compression, and tension load cells, for example. These types of load cells and sensors may be obtained from various manufacturers such as, for example, CUI Inc. (PN SR.D-15S), Measurement Specialties, Inc. (FX1901-0001-0010-L), and Flintec (similar to Type PBW), for example, each manufacture.

Figure 40:
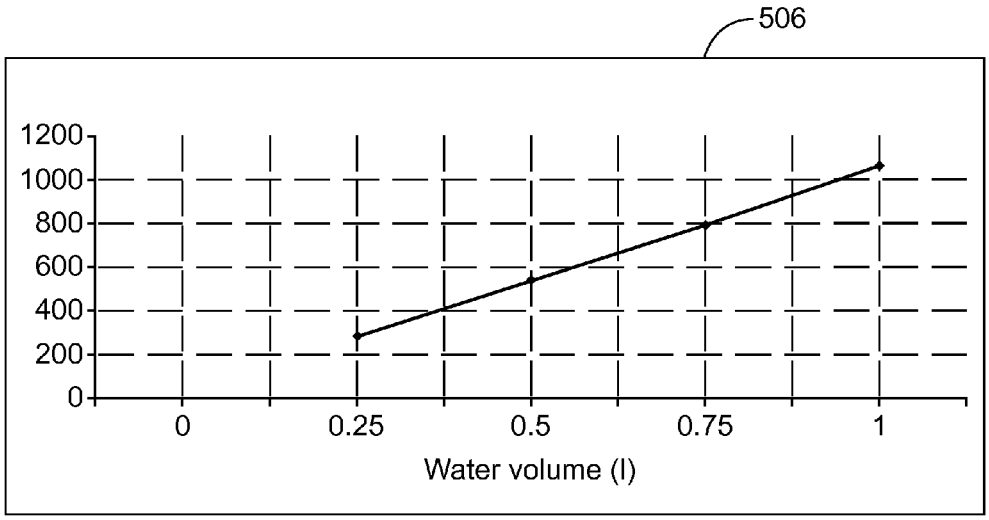
FIG. 40 is a graph depicting the weight of the container as a function of fluid volume in the container.

FIG. 40 is a graph 506 depicting the weight of the container 50 as a function of fluid 202 volume in the container 50. The container was incrementally filled with water and weight measurements were taken. The graphical results are shown in the graph 506. The water volume is shown along the horizontal axis in liters (l) and weight in grams (g) is shown along the vertical axis. As graphically depicted in FIG. 40, the weight of the container 50 varies linearly with the volume of fluid (e.g., water) in the container 50.

Figure 41:
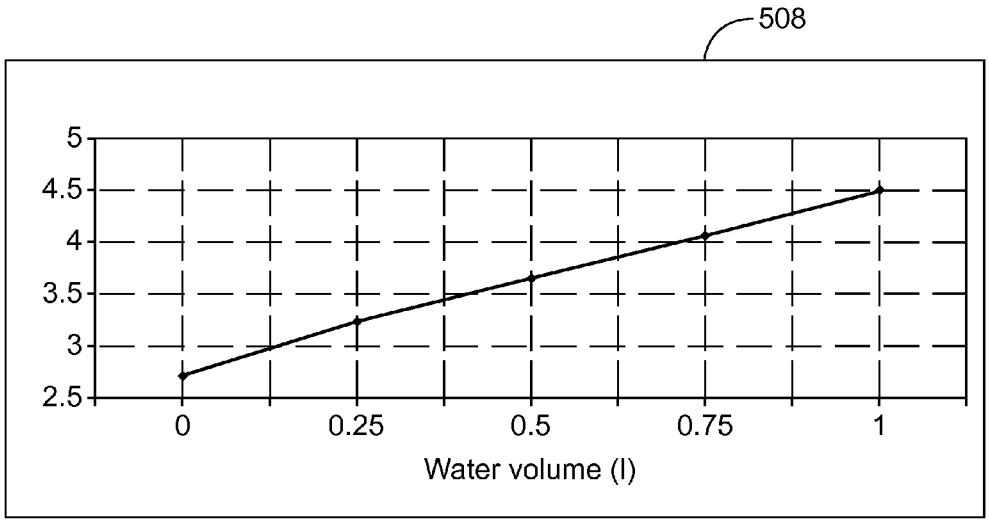
FIG. 41 is a graph depicting the output voltage of one embodiment of the load cell as a function of fluid volume in the container.

FIG. 41 is a graph 508 depicting the output voltage of one embodiment of the load cell 502 as a function of fluid 202 volume in the container 50. As discussed with reference to the graph 506 in FIG. 40, the fluid 202 used to generate the graph 508 is water. Water volume is shown along the horizontal axis in liters (l) and output voltage of one embodiment of the load cell 502 is shown along the vertical axis in millivolts (mV). As shown in FIG. 41, the load cell 502 provides a substantially linear output voltage in response to the weight of the container 50, which is linearly proportional to volume as shown in the graph 506 of FIG. 40.

Figure 42:
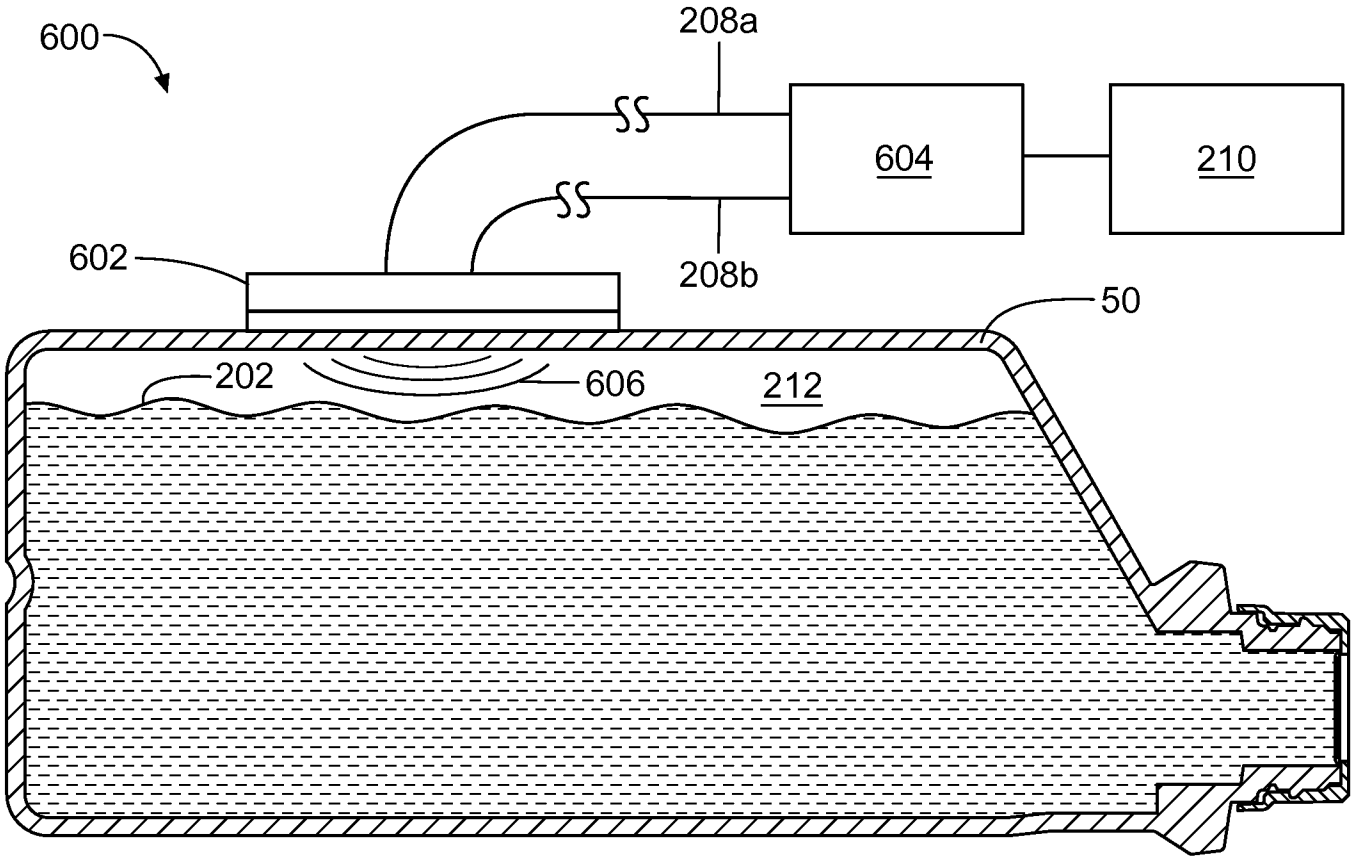
FIG. 42 is a cross-sectional view of the container and one embodiment of a fluid detection system configured to couple to the fluid dispensing system.

FIG. 42 is a cross-sectional view of the container 50 and one embodiment of a fluid detection system 600 configured to couple to the fluid dispensing system 14. In the embodiment illustrated in FIG. 42, the fluid detection system 600 comprises an ultrasonic transducer 602 coupled to a circuit 604 via the first and second electrically conductive wires 208*a,b*. The ultrasonic transducer 602 works by resonating a frequency and converting energy into acoustic energy wave 606 to infer the fluid 202 level inside the container 50. In one embodiment, the ultrasonic transducer 602 comprises a down facing sensor, such a Migatron RPS-409A, for example, with an unobstructed ultrasonic path to the fluid 202. The acoustic energy 606 in the form of ultrasonic sound waves is bounced off the surface of the fluid 202 and the ultrasonic transducer 602 determines the time of flight (e.g., transmit time and return time) of the transmitted acoustic energy wave 606 to determine the fluid 202 level. In other embodiment, transmission of acoustic energy wave 606 may be employed simply to detect the presence of the fluid 202 or a change in state. The ultrasonic transducer 602 comprises a transmitting crystal that sends sound waves and a receiving crystal to receive the sound waves that bounce off the target. The circuit 604 may comprise the necessary excitation sources to drive transmitting crystal and the signal processing capacity to analyze the signals from the receiving crystal and measure the time of flight to determine the fluid 202 level in the container 50. In some implementations, the ultrasonic transducer 602 may comprise a single crystal that may be excited for transmission of ultrasound energy waves 606 and then turned off for reception of the ultrasound energy waves that bounce off the target. In one embodiment, the indication may provide information regarding the amount of fluid 202 located in the container. In one embodiment, the indication alerts the user that the container 50 contains at least one more dose of fluid 202, and therefore, that the fluid dispensing system 14 is low on fluid 202 and will require replacement after one more use.

For example, another fluid detection system method also uses ultrasonic energy and works through walls of the container 50. The sensor generates an acoustic signal, directs it through the wall of the container 50 and senses the reflected ultrasonic pulses to determine air versus liquid. This technology may be employed in limited applications with container 50 formed of suitable types of plastics.

Figure 43:
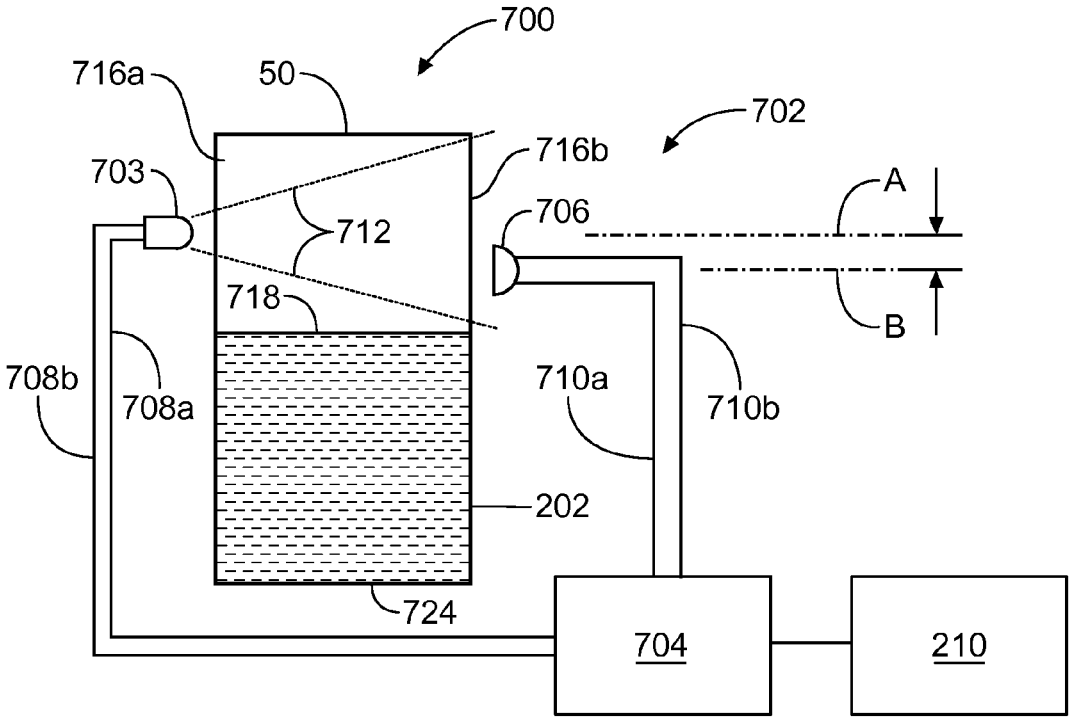
FIG. 43 is a schematic diagram of one embodiment of a fluid detection system configured to couple to the fluid dispensing system of FIG. 4.

FIG. 43 is a schematic diagram of one embodiment of a fluid detection system 700 configured to couple to the fluid dispensing system 14. In the embodiment illustrated in FIG. 43, the fluid detection system 700 comprises an optical detection system 702 coupled to a circuit 704. In one embodiment, the optical detection system 702 comprises a light emitting device 703 located external to a first translucent side 716*a* of a body of the container 50 along a first axis A to transmit light 712 therethrough. The light emitting device 703 may emit light at any suitable wavelength. The optical detection system 702 also comprises a photo detector 706 located external to a second translucent side 716*b* of the body of the container 50 along a second axis B to receive the transmitted light 712. In one embodiment, the light emitting device 703 may be implemented as a light emitting diode (LED). In various embodiments, the LED may be configured to emit light at any suitable visible or invisible wavelength. In various embodiments, the emission wavelength may be selected according to the sensitivity of the photo detector 706. In one embodiment, the LED is configured to emit light in the clear-green spectrum. The fluid detection system 700 provides a cost effective, compact, and suitable fluid detection technique for high, low, or intermediate level detection in substantially all containers made of clear material. The fluid detection system 700 may be configured to detect opaque as well clear fluids. Those skilled in the art will appreciate, however, that of the opaque fluids which create films or residues on the container wall, it may be preferable to provide a opaque fluid which creates thinner films such that the fluid detection system does not incorrectly perceive the film as the level of fluid within the container. The circuit 704 is configured to drive the light emitting device 703 by way of first and second electrically conductive wires 708*a*, 708*b*, and the circuit 704 also is configured to sense the output of the photo detector 706 by way of first and second electrically conductive wires 710*a*, 710*b*.

As shown in FIG. 43, in one embodiment, the second axis B is offset from the first axis A by a distance $D_1$. In this configuration, the light emitting device 703 and the photo detector 706 are not at the same distance relative to the bottom 724 of the container 50. In the illustrated embodiment, the photo detector 706 disposed along with the second axis B is not aligned with the light emitting device 703 disposed along the first axis A. However, the photo detector 706 is located within the viewing range of the light emitting device 703 to receive the transmitted light 712 therefrom. When either air or water is located in front of both the light emitting device 703 and the photo detector 706, a substantial portion of the light 712 emitted by the light emitting device 703 reaches the surface of the photo detector 706. As shown in FIG. 43, the photo detector 706 senses the light 712 transmitted by the light emitting device 703 when the fluid level 718 inside the container 50 is below the second axis B.

Figure 44:
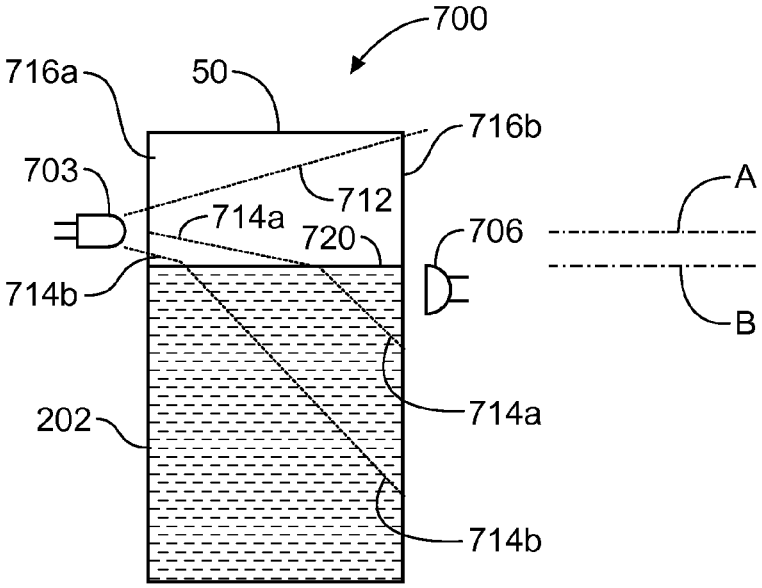
FIG. 44 is a schematic diagram of one embodiment of the fluid detection system of FIG. 43 wherein the fluid level is located between a transmission axis A of a light emitting device and a reception axis B of a photo detector.

In FIG. 44, the fluid level 720 is located between the transmission axis A of the light emitting device 703 and the reception axis B of the photo detector 706. Accordingly, a portion of the light 712 transmitted by the light emitting device 703 hits the surface of the fluid 202. This is represented by incident light rays 714*a*, 714*b* that hit the surface of the fluid 202 with an incident angle θ such that the incident light rays 714*a*, 714*b* refract. As shown in FIG. 44, the fluid level 720 is below the first axis A and above the second axis B. Thus, the refracted light rays 714*a,b* are not received by the photo detector 706, which senses significantly less light 712 transmitted by the light emitting device 703. Thus, the photo detector 706 senses low light levels.

In one embodiment, the photo detector 706 may be implemented as part number SFH 5711-2/3-Z from OSRAM. This particular embodiment comprises a complete module, which includes the photo detector 706 and a logarithmic amplifier, a function which may be implemented in the circuit 704. The output of the photo detector can simply be connected to a load resistor. The value of the resistor determines the light sensitivity of the system. The photo detector output current can be expressed as: Iout=S*log(Ev/Eo), where Ev is the light luminance lux (lx); Eo is equal to 1 lx, and S is the sensitivity S=10 μA/dec. The output current is converted into voltage by the load resistor. In various embodiments the load resistor may have a value of a several kilo Ohms, and in one embodiment, the load resistor may have a value of about 164 kilo Ohms.

Figure 45:
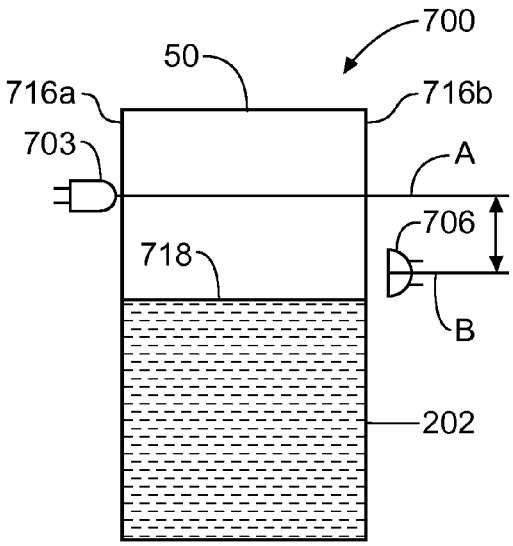
FIG. 45 is a schematic diagram of one embodiment of the fluid detection system of FIG. 43, wherein the distance $D_1$ between first and second axes A, B is about 2 centimeters.

In the embodiment illustrated in FIG. 45, the distance $D_1$ between the first and second axes A, B is about 2 centimeters, for example. It will be appreciated, however, that the distance $D_1$ may be selected based on the size of the container 50 and the amount of fluid 202 to be detected, for example. Therefore, the embodiments are not limited in this context.

Figure 46:
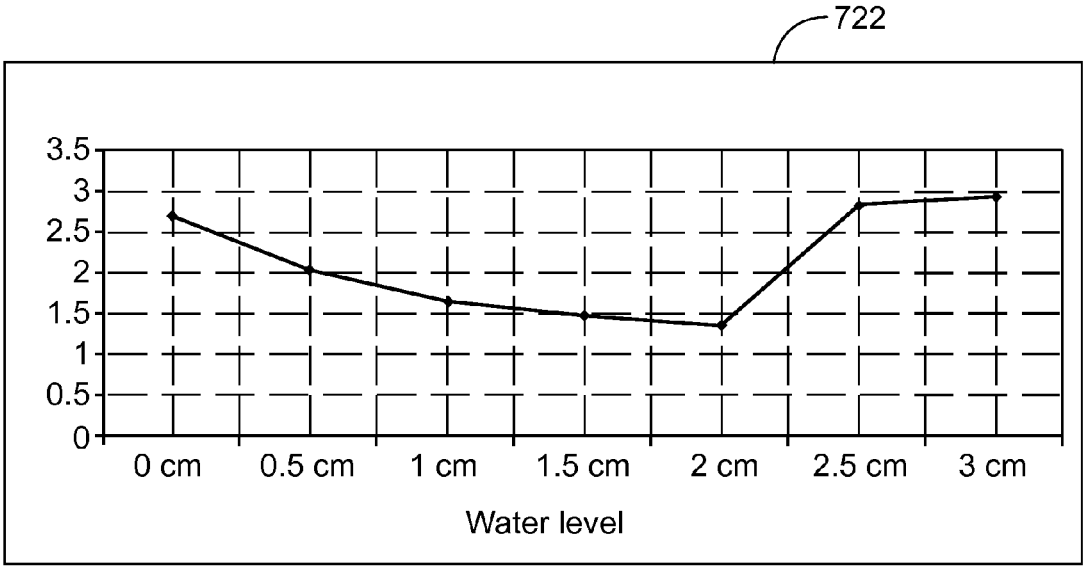
FIG. 46 is a graph depicting the water level as a function of output voltage of the photo detector as shown in FIG. 45.

With the distance between the first and second axes A, B set to about 2 centimeters the container 50 was filled with water and the output voltage of the photo detector 706 was recorded and various water levels. These test results are illustrated graphically in FIG. 46 where the water level in centimeters (cm) is shown along the horizontal axis and the output voltage of the photo detector 706 in volts (V) is shown along the vertical axis. The 0 centimeter level corresponds to the point where the fluid level 718 is slightly below the second axis B of the photo detector 706, which is about 2 centimeters below the first axis A of the light emitting device 703. At the 2.5 centimeter level the fluid 202 covers both the light emitting device 703 and the photo detector 706. As shown in the graph 722, the fluid 202 level can be detected as the fluid 202 level passes between the first and second axes A, B of the respective light emitting device 703 and photo detector 706. As the fluid 202 blocks the transmitted light 712, there is a substantial reduction on the output voltage of the photo detector 706. When the fluid level 718 drops below the second axis B, e.g., below the photo detector 706, the output voltage is above 2.5 V. The output voltage drops to a minimum of 1.3 V when the fluid level 718 coincides with the first axis A. The output voltage then quickly increases again to levels near 3 V. This behavior is substantially consistent and repeatable, although actual voltage readings depend on several factors such as the distance between the light emitting device 703 and the photo detector 706, their relative orientation, the shape of the container 50, the drops or films on the walls, and bubbles formed in the fluid 202. The minimum voltage reading of 1.3 V, when the fluid level is between the first and second axis A, B, however, is always present.

Figure 47:
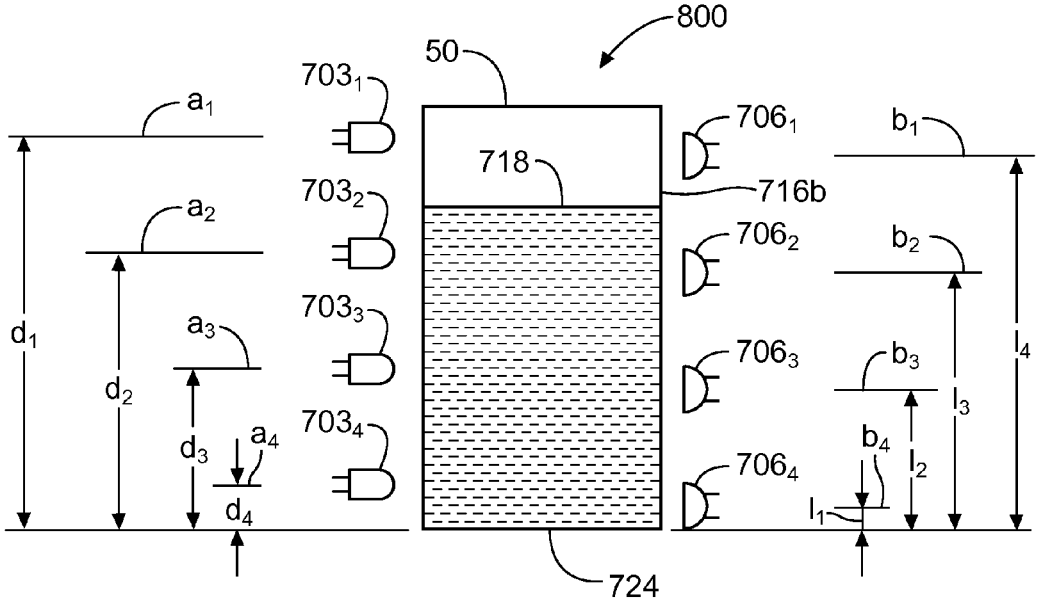
FIG. 47 illustrates one embodiment of a fluid detection system that is configured to couple to the fluid detection system of FIG. 4.

FIG. 47 illustrates one embodiment of a fluid detection system 800 that is configured to couple to the fluid detection system 14. In the embodiment illustrated in FIG. 47, the optical detection system 800 comprises at least one additional light emitting device, e.g., light emitting devices $706_2$, $706_2$, $706_3$, or $706_4$, located external to the first translucent side 716*a* of the body of the container 50 to transmit light along corresponding axes $a_1$, $a_2$, $a_3$, or $a_4$. The optical detection system 800 comprises at least one additional photo detector, e.g., photo detectors 706$_1$, 706$_2$, 706$_3$, or 706$_4$, located external to the second translucent side 716*b* of the body of the container 50 to receive the transmitted light along corresponding axes $b_1$, $b_2$, $b_3$, or $b_4$. The axes $a_1$, $a_2$, $a_3$, or $a_4$ are offset from the axes $b_i$, $b_2$, $b_3$, or $b_4$. The circuit 704 (FIG. 43) is configured to drive the light emitting devices 703$_1$ to 703$_4$ and to sense an output of the photo detectors 706$_1$ to 706$_4$.

In the embodiment illustrated in FIG. 47, the four light emitting devices 703$_1$ to 703$_4$ are located external to the first translucent side 716*a* of the body of the container 50. Each of the light emitting devices 703$_1$ to 703$_4$ defines a corresponding optical transmission axis $a_1$, $a_2$, $a_3$, $a_4$. The light emitting devices 703$_1$ to 703$_4$ are arranged at respective distances $d_1$, $d_2$, $d_3$, $d_4$ from a reference plane taken at the bottom 724 of the container 50. The distances $d_1$ to $d_4$ coincide with the respective optical transmission axes $a_1$ to $a_4$. The four photo detectors 706$_1$ to 706$_4$ are located external to the second translucent side 716*b* of the body of the container 50. Each of the photo detectors 706$_1$ to 706$_4$ defines corresponding optical detection axes $b_1$ to $b_4$. The optical transmission axes $a_1$ to $a_4$ are offset form the optical detection axes $b_1$ to $b_4$, as previously discussed with reference to FIGS. 43-45. The photo detectors 706$_1$ to 706$_4$ are arranged at respective distances 1$_1$, 1$_2$, 1$_3$, 1$_4$ from the reference plane taken at the bottom 724 of the container 50. The photo detectors 706$_1$ to 706$_4$ are arranged to detect the light transmitted by the light transmitting devices 703$_1$ to 703$_4$. It will be appreciated that up to n (where n is any positive integer) light emitting devices and corresponding photo detectors may be employed to accommodate various sizes and configurations of the container 50. In the embodiment illustrated in FIG. 47, the light emitting devices 703$_1$, 703$_2$, 703$_3$, and 703$_4$ are located at respective distances from the reference plane at the bottom 724 of the container 50 of: 13 centimeters, 9 centimeters, 5 centimeters, and 1 centimeter. The corresponding photo detectors 706$_1$, 706$_2$, 706$_3$, and 706$_4$ are located at respective distances from the reference plane at the bottom of the container 50 of: 12 centimeters, 8 centimeters, 4 centimeters, and 0.5 centimeters.

Figure 48:
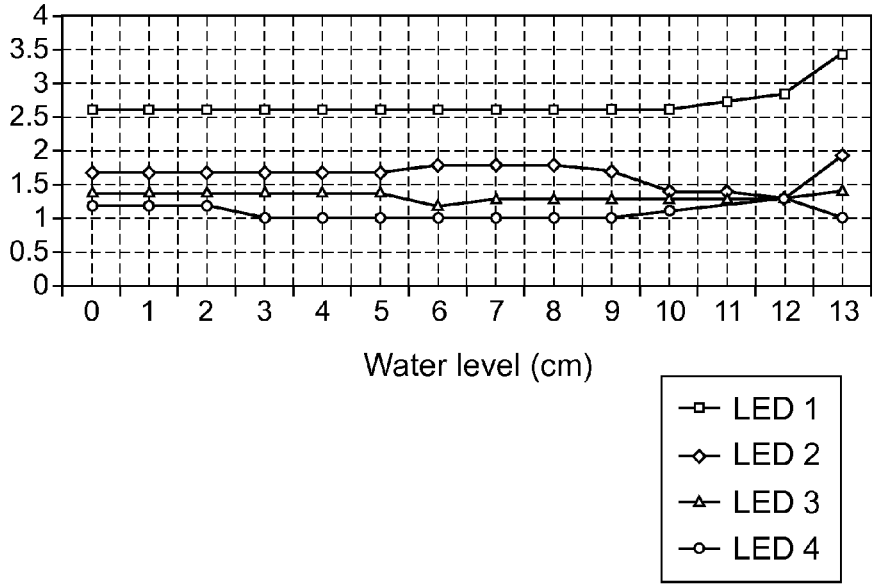
FIG. 48 is a graph depicting the water level as a function of output voltage of the photo detector as shown in FIG. 47.

FIG. 48 graphically depicts the output voltage in volts (V) of the first photo detector 706$_1$ based on the relative locations of the light emitting devices 703$_1$ to 703$_4$ and the photo detectors 706$_1$ to 706$_4$ with the fluid level 718 located just below the first detection axis $b_1$ and just above the second emission axis $a_2$. The water level in centimeters (cm) is shown along the horizontal axis and the output voltage of the first photo detector 706$_1$ in volts (V) is shown along the vertical axis. The measurements were taken using the embodiment described with reference to FIG. 47.

Those skilled in the art will appreciate that the embodiments of the fluid detection systems discussed herein are not exhaustive. Other suitable fluid detection systems may be coupled to the fluid dispensing system 14 without limiting the scope thereof. Therefore, the scope of the embodiments of the fluid detection systems 100, 200, 300, 300, 400, 500, 600, 700, and 800 are not limited in this context.

In various embodiments, the fluid dispensing system and the containers, discussed above, can be provided as a kit. In at least one embodiment, the components of the kit can include all of the components and features of the components discussed above. In one exemplary embodiment, a kit can be configured to provide a fluid to an appliance, wherein the kit can comprise at least one container including a neck and a closure mechanism which can be configured to puncturably seal the container, wherein the neck and/or the closure mechanism can form at least one camming surface and an annular ring extending around a portion of a periphery of one of the neck and the closure mechanism. In such an embodiment, the at least one container of the kit can be used with a fluid dispensing system that can comprise a housing configured to accept at least a portion of the container, a track configured to be engaged with the housing, wherein the housing can be slidably movable along the track at least between a first position and a second position, a fluid extracting element which can be engaged with at least a portion of the container to withdraw a fluid therefrom at least when the housing is in the second position. In various embodiments, the fluid dispensing system can also comprise a fluid system in fluid communication with the fluid extracting element, wherein the at least one camming surface can be configured to actuate the fluid system at least when the housing is in the second position to create a pressure differential between the fluid extracting element and the container to allow the fluid extracting element to the withdraw fluid from the container.

In other various embodiments, the present disclosure can also include a method of supplying fluid to a fluid dispensing system. In at least one embodiment, the method can utilize the components discussed above and/or other various components, for example. In at least one exemplary embodiment, the method can comprise inserting and/or rocking a container including a fluid therein into a housing when the housing is in a first position. In at least one embodiment, the method can include sliding the housing into a second position thereby withdrawing a protective plate and actuating a second electromechanical switch using at least one camming surface positioned on the container to cause a fluid extracting element to engage a portion of the container. In various embodiments, the method can further include creating a pressure differential between the fluid extracting element and the container and withdrawing the fluid from the container using the fluid extracting element to supply the fluid to the fluid dispensing system.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fluid dispensing system for an appliance, the fluid dispensing system configured to be used with a container comprising at least one camming surface, the fluid dispensing system comprising:

a drawer configured to accept at least a portion of the container;

a track configured to be engaged with the drawer, wherein the drawer is slidably movable along the track at least between a first position and a second position;

a fluid extracting element configured to be engaged with at least a portion of the container to withdraw fluid therefrom when the drawer is in the second position; and a fluid system in fluid communication with the fluid extracting element, wherein the at least one camming surface is configured to actuate the fluid system when the drawer is in the second position to create a pressure differential and allow the fluid extracting element to withdraw fluid from the container.

2. The fluid dispensing system of claim 1, wherein the drawer comprises:

an engagement member, wherein when present, the at least one camming surface of the container is configured to act against a first portion of the engagement member when the drawer is in the first position and the second position to allow a second portion of the engagement member to at least partially extend from the drawer; and a protective plate system comprising:

a slider member configured to be engaged with the second portion of the engagement member to slidably move the slider member between a first position and a second position; and a protective plate configured to at least partially cover the fluid extracting element when the slider member is in the first position, wherein the protective plate is configured to allow access to the fluid extracting element when the slider member is in the second position.

3. The fluid dispensing system of claim 1, comprising a tube having an aperture therethrough for conveying a gas, wherein the tube is configured to flow the gas into the container to create a pressure differential or maintain atmospheric pressure to allow the fluid extracting element to withdraw the fluid from the container.

4. The fluid dispensing system of claim 1, wherein the fluid system comprises a pump in fluid communication with one of the container and the fluid extracting element to provide the pressure differential and allow the fluid extracting element to withdraw the fluid from the container.

5. The fluid dispensing system of claim 1, comprising:

a fluid detection system configured to detect a volumetric dose of the fluid inside the container; and a circuit to detect at least one volumetric dose of the fluid remaining inside the container, wherein said fluid detecting system comprises at least one of the following:

a conductivity sensor coupled to the circuit, the conductivity sensor comprising:

the fluid extracting element, wherein the fluid extracting element comprises an electrically conductive portion configured to sense the conductivity of the fluid inside the container; and a tube having an aperture therethrough for conveying a gas located in a spaced apart relationship to the fluid extracting element, and wherein the tube comprises an electrically conductive portion and is configured to sense the conductivity between the fluid extracting element and the tube;

a capacitive sensor coupled to the circuit, the capacitive sensor comprising: a first electrode; and a second electrode spaced apart from the first electrode defining an opening to receive a body portion of the container therebetween; wherein the circuit is configured to sense capacitance changes between the first and second electrodes as a function of an amount of the fluid inside the container; and a load cell coupled to the circuit, the load cell comprising an internal resistor bridge that changes electrical resistance as a function of weight; wherein the circuit is configured to sense resistance changes in the internal resistance bridge as a function of the amount of the fluid inside the container.

6. The fluid dispensing system of claim 1, comprising a container comprising:

a neck;

a closure mechanism, wherein at least one of the neck and the closure mechanism forms:

at least one camming surface extending from one of the neck and the container; and an annular ring extending around at least a portion of a periphery of one of the neck and the closure mechanism; and a container body attached to the neck, wherein the closure mechanism is configured to puncturably seal the container.

7. The fluid dispensing system of claim 6, wherein the at least one camming surface of the container comprises:

a first cam configured to act against an engagement member at least when the drawer is in the first position; and a second cam configured to act against an actuator of the fluid system when the drawer is in the second position, wherein the first cam and the second cam are positioned on an annular ring, and wherein the first cam is positioned less than 180 degrees from the second cam, and wherein the neck is configured to be engaged with a portion of the drawer to fixedly engage the container with the drawer such that the neck is aligned with the fluid extracting element.

8. A fluid dispensing system for an appliance, the fluid dispensing system configured to be used with a container comprising at least one camming surface, the fluid dispensing system comprising:

a housing configured to accept at least a portion of the container in a fixed substantially horizontal orientation;

a track configured to be engaged with the housing, wherein the housing is slidably movable along the track at least between a first position and a second position;

a fluid extracting element configured to be engaged with at least a portion of the container to withdraw fluid therefrom when the housing is in the second position; and a fluid system in fluid communication with the fluid extracting element, wherein the at least one camming surface is configured to actuate the fluid system when the housing is in the second position to allow the fluid extracting element to withdraw the fluid from the container, wherein the substantially horizontal orientation is at an angle between about one to about eleven degrees from the horizontal axis.

9. The fluid dispensing system of claim 8, and a fluid level detection system configured to detect a level of the fluid within the container.

10. The fluid dispensing system of claim 9, wherein the container comprises a self-sealing mechanism, and wherein the fluid extracting element is configured to puncture the self-sealing mechanism to withdraw the fluid from the container.

11. The fluid dispensing system of claim 9, comprising a tube having an aperture therethrough for conveying a gas, wherein the tube is configured to convey the gas into the container to pressurize the container and thereby aid the fluid extracting element in withdrawing the fluid from the container.

12. The fluid dispensing system of claim 9, further comprising at least one electro-mechanical switch, wherein a first portion of the at least one camming surface is configured to be engaged with the at least one electro-mechanical switch to cause the fluid dispensing system to run a first cycle, and wherein a second portion of the at least one camming surface is configured to be engaged with the at least one electromechanical switch to cause the fluid dispensing system to run a second cycle.

13. The fluid dispensing system of claim 9, further comprising a container, said container comprising:

a neck;

a closure mechanism, wherein at least one of the neck and the closure mechanism forms:

at least two camming surfaces extending from one of the neck and the container; and an annular ring extending around at least a portion of a periphery of one of the neck and the closure mechanism; and a container body connected to the neck, wherein the closure mechanism is configured to puncturably seal the container.

* * * * *